US011661732B2

(12) United States Patent
Gomo et al.

(10) Patent No.: US 11,661,732 B2
(45) **Date of Patent: *May 30, 2023**

(54) MODULAR DRAIN ASSEMBLY FOR POD CONSTRUCTED ROOM

(71) Applicant: Zurn Industries, LLC, Milwaukee, WI (US)

(72) Inventors: David Michael Gomo, Lake City, PA (US); Robert Anthony DiPlacido, Erie, PA (US); Michael Thomas Benesh, Erie, PA (US); Christopher J. Say, Erie, PA (US); John Matthew Lawrence, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/804,837

(22) Filed: May 31, 2022

(65) Prior Publication Data

US 2022/0364349 A1 Nov. 17, 2022

Related U.S. Application Data

(63) Continuation of application No. 17/504,010, filed on Oct. 18, 2021, now Pat. No. 11,408,164, which is a (Continued)

(51) Int. Cl.
*E03F 5/04* (2006.01)
*E03C 1/122* (2006.01)

(Continued)

(52) U.S. Cl.
CPC ..... *E03F 5/0407* (2013.01); *E03C 1/122* (2013.01); *E03F 5/0409* (2013.01); *E03F 5/06* (2013.01);

(Continued)

(58) Field of Classification Search
CPC ..... E03F 5/04; E03F 5/0407; E03F 5/0408; E03F 5/0409; E03C 1/12; E03C 1/122;

(Continued)

(56) References Cited

U.S. PATENT DOCUMENTS 4,562,602 A 1/1986 Cuschera
4,745,712 A 5/1988 O'Leary (Continued)

FOREIGN PATENT DOCUMENTS

AU 2017101316 A4 11/2017
DE 2948050 A1 6/1981

(Continued)

OTHER PUBLICATIONS

International Search Report with Written Opinion for related Application No. PCT/US2020/065714 dated Mar. 19, 2021 (22 Pages).

*Primary Examiner* — Christopher Upton
(74) *Attorney, Agent, or Firm* — Michael Best & Friedrich LLP

(57) ABSTRACT

A drain assembly for installation in a shower floor, the drain assembly including a drain body including an upper surface defining a top side, and a lower surface opposite the upper surface defining a bottom side. The drain assembly also defines an aperture extending along an axis through the drain body between the upper surface and the lower surface and includes an outlet having a flange and an elongated body. When assembled, the elongated body is configured to extend below the lower surface of the drain body when the flange rests on the upper surface. The drain assembly also includes one or more fasteners configured to couple the outlet to the drain body to form a water-tight seal therebetween, where each of the one or more fasteners are accessible from the top side.

30 Claims, 64 Drawing Sheets

Related U.S. Application Data continuation of application No. 17/125,736, filed on Dec. 17, 2020, now Pat. No. 11,149,429.

(60) Provisional application No. 63/070,720, filed on Aug. 26, 2020, provisional application No. 62/949,031, filed on Dec. 17, 2019.

(51) Int. Cl.
*E03F 5/06* (2006.01)
*E04B 1/348* (2006.01)
*E04F 17/00* (2006.01)

(52) U.S. Cl.
CPC ..... *E04B 1/34861* (2013.01); *E04B 1/34869* (2013.01); *E04F 17/00* (2013.01)

(58) Field of Classification Search
CPC ..... E04F 17/00; E04B 1/348; E04B 1/34807; E04B 1/34861; E04B 1/34869
USPC ..... 210/163, 164, 170.01; 52/79.1, 302.1, 52/745.02, 745.2
See application file for complete search history.

(56) References Cited

U.S. PATENT DOCUMENTS

| | | | | |
|---|---|---|---|---|
| 5,903,937 | A | 5/1999 | Clarke | |
| 8,850,633 | B2 | 10/2014 | Erlebach | |
| 9,332,883 | B1 | 5/2016 | Angelella | |
| 11,149,429 | B2 | 10/2021 | Gomo et al. | |
| 11,408,164 | B2 * | 8/2022 | Gomo | E03F 5/0407 |
| 2003/0037498 | A1 | 2/2003 | Bishop | |
| 2003/0159366 | A1 | 8/2003 | Christensen | |
| 2007/0017578 | A1 | 1/2007 | Dallmer | |
| 2010/0176041 | A1 | 7/2010 | Schlueter | |
| 2013/0014451 | A1 | 1/2013 | Russell et al. | |
| 2015/0275497 | A1 | 10/2015 | Nyce | |

FOREIGN PATENT DOCUMENTS

| | | | |
|---|---|---|---|
| EP | 2177677 | A2 | 4/2010 |
| WO | 9222714 | A1 | 12/1992 |

* cited by examiner

FIG 7A
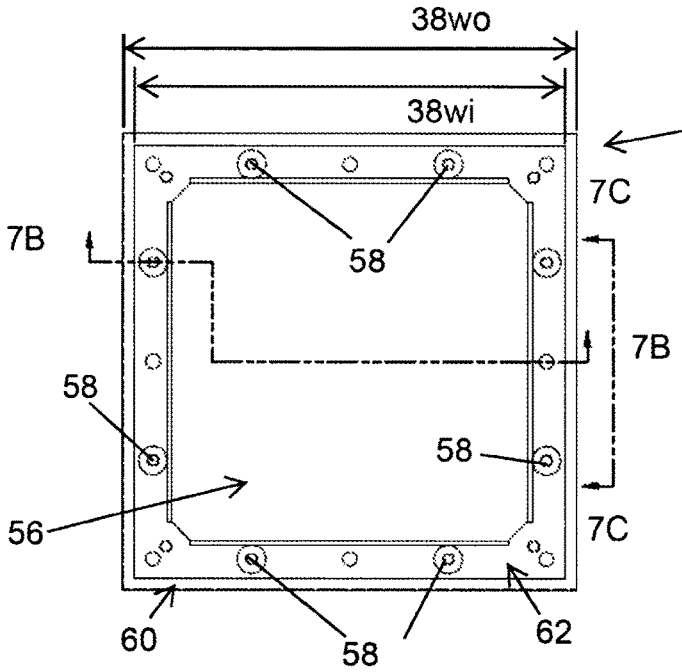
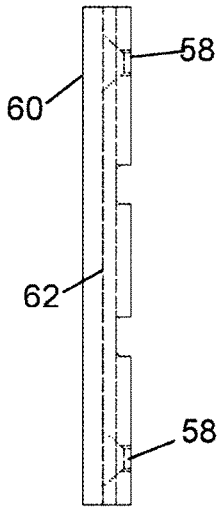
FIG. 7C
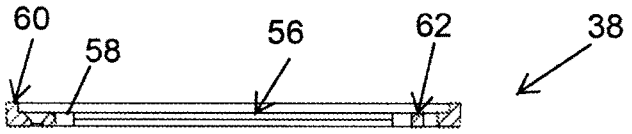
FIG. 7B

MODULAR DRAIN ASSEMBLY FOR POD CONSTRUCTED ROOM

CROSS REFERENCE TO RELATED APPLICATIONS

The present application is a continuation of U.S. application Ser. No. 17/504,010 filed Oct. 18, 2021. U.S. application Ser. No. 17/504,010, in turn, is a continuation of U.S. patent application Ser. No. 17/125,736 filed Dec. 17, 2020, which claims priority to U.S. Provisional Patent Application No. 62/949,031 filed Dec. 17, 2019 and U.S. Provisional Patent Application No. 63/070,720, filed Aug. 26, 2020. U.S. patent application Ser. No. 17/125,736 has issued as U.S. Pat. No. 11,149,429. The entire contents of each of the foregoing applications are incorporated by reference herein.

FIELD

The present disclosure relates to a drain for a modular bathroom and more specifically, to a method of installing the drain after the bathroom has been installed within a structure.

SUMMARY

In some embodiments, a method of installing the modular room in a building is disclosed. The modular room includes a floor, at least three walls extending upward from the floor and a ceiling coupled to an upper end of the walls. The modular room defines an aperture in the floor, and a drain body is positioned in the aperture in the floor of the modular room such that the drain body does not extend beyond a lower surface of the floor of the modular room. The method includes positioning the modular room on a floor of the building, such that the drain body is spaced above the floor of the building. The method further includes aligning the installed drain body with a plumbing pipe of the building, and coupling the modular room to the building to inhibit movement of the modular room with respect to the building. The method further includes inserting an outlet through an opening of the drain body such that the outlet extends beyond the lower surface of the floor to mate with the plumbing pipe of the building after the drain body is aligned with the plumbing pipe of the building.

In some embodiments, a drain assembly, for installation in a floor of a modular room, includes a drain body having an upper surface and a lower surface. The drain body defines an aperture extending along an axis through the drain body between the upper surface and the lower surface. The drain assembly further includes an outlet having a flange and an elongated body. The elongated body is insertable through the aperture in a downward direction along the axis such the flange rests on the upper surface. The elongated body extends below the lower surface of the drain body when the flanges rests on the upper surface. The outlet being receives fluid flow from the drain body and direct the fluid flow away from the drain body.

In some embodiments, a modular room is ready to be installed in a building. The modular room includes a floor having an upper surface, and a lower surface. The floor defines a floor height between the upper surface and the lower surface, and the floor defines an aperture extending therethrough. The modular room further includes at least three walls having a lower end connected to the floor and an upper end extending away from the floor, a ceiling connected to the upper end of the walls, and a drain body positioned in the aperture in the floor. The drain body has an upper surface and a lower surface. The drain body defines a drain body height between the upper surface and the lower surface. The drain body height is less than the floor height, such that the drain body does not extend above the upper surface of the floor or below the lower surface of the flow while the drain body is positioned in the aperture in the floor.

In some embodiments, a drain assembly for installation in a shower floor, the drain assembly including a drain body including an upper surface defining a top side, and a lower surface opposite the upper surface defining a bottom side, where the upper surface includes a recessed portion formed therein and at least one angled surface configured to direct fluid toward the recessed portion, and where the drain body defines an aperture extending along an axis through the drain body between the upper surface and the lower surface, and an outlet including a flange and an elongated body, the elongated body removably insertable through the aperture along the axis such that the flange rests on the upper surface, the elongated body configured to extend below the lower surface of the drain body when the flange rests on the upper surface, the outlet configured to receive fluid flow from the drain body and direct the fluid flow away from the drain body, and one or more fasteners configured to couple the outlet to the drain body to form a water-tight seal therebetween, where each of the one or more fasteners are accessible from the top side.

In some embodiments, a shower floor assembly including a body having an upper surface defining a top side and a lower surface opposite the upper surface defining a bottom side, where the body includes a recessed portion formed therein and at least one angled surface configured to direct fluid toward the recessed portion, an aperture formed in the body and extending along an axis through the body between the upper surface and the lower surface, an outlet including a flange and an elongated body, the elongated body removably insertable through the aperture along the axis such that the flange rests on the upper surface, the elongated body configured to extend below the lower surface of the drain body when the flange rests on the upper surface, the outlet being configured to receive fluid flow from the body and direct the fluid flow away from the body, and at least one fastener configured to couple the outlet to the drain body to form a water-tight seal therebetween, where the at least one fastener is accessible from the top side.

In some embodiments, a shower assembly including a floor having an upper surface defining a top side and a lower surface opposite the upper surface defining a bottom side, where the floor includes a recessed portion formed therein and at least one angled surface configured to direct fluid toward the recessed portion, an aperture formed in the floor and extending along an axis through the body between the upper surface and the lower surface, an outlet including a flange and an elongated body, the elongated body removably insertable through the aperture along the axis, the elongated body configured to extend below the lower surface of the floor, the outlet being configured to receive fluid flow from the upper surface and direct the fluid flow away from the floor, and at least one fastener configured to couple the outlet to the floor to form a water-tight seal therebetween, where the at least one fastener is accessible from the top side.

In some embodiments, a drain assembly for installation in a modular room, the drain assembly including a drain body including an upper surface defining a top side, and a lower surface opposite the upper surface defining a bottom side, where the upper surface includes a recessed portion formed therein, and where the drain body defines an aperture extending along an axis through the recessed portion between the upper surface and the lower surface, and an outlet including an elongated body, the elongated body removably insertable through the aperture along the axis such that the elongated body configured to extend below the lower surface of the drain body when coupled to the drain body, the outlet being configured to receive fluid flow from the drain body and direct the fluid flow away from the drain body, and at least one fastener configured to couple the outlet to the drain body to form a water-tight seal therebetween, where the at least one fastener is accessible from the top side.

Other aspects of the disclosure will become apparent by consideration of the detailed description and accompanying drawings.

BRIEF DESCRIPTION OF THE DRAWINGS

FIG. 7A is a top view of a frame that may be installed in the bathroom pod of FIG. 1.

FIG. 7B is a cross-sectional view of the frame of FIG. 7A, viewed along section 7B-7B.

FIG. 7C is a cross-sectional view of the frame of FIG. 7A, viewed along section 7C-7C.

FIG. 27F is an alternative configuration of FIG. 27A-E.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect.

Figure 1:
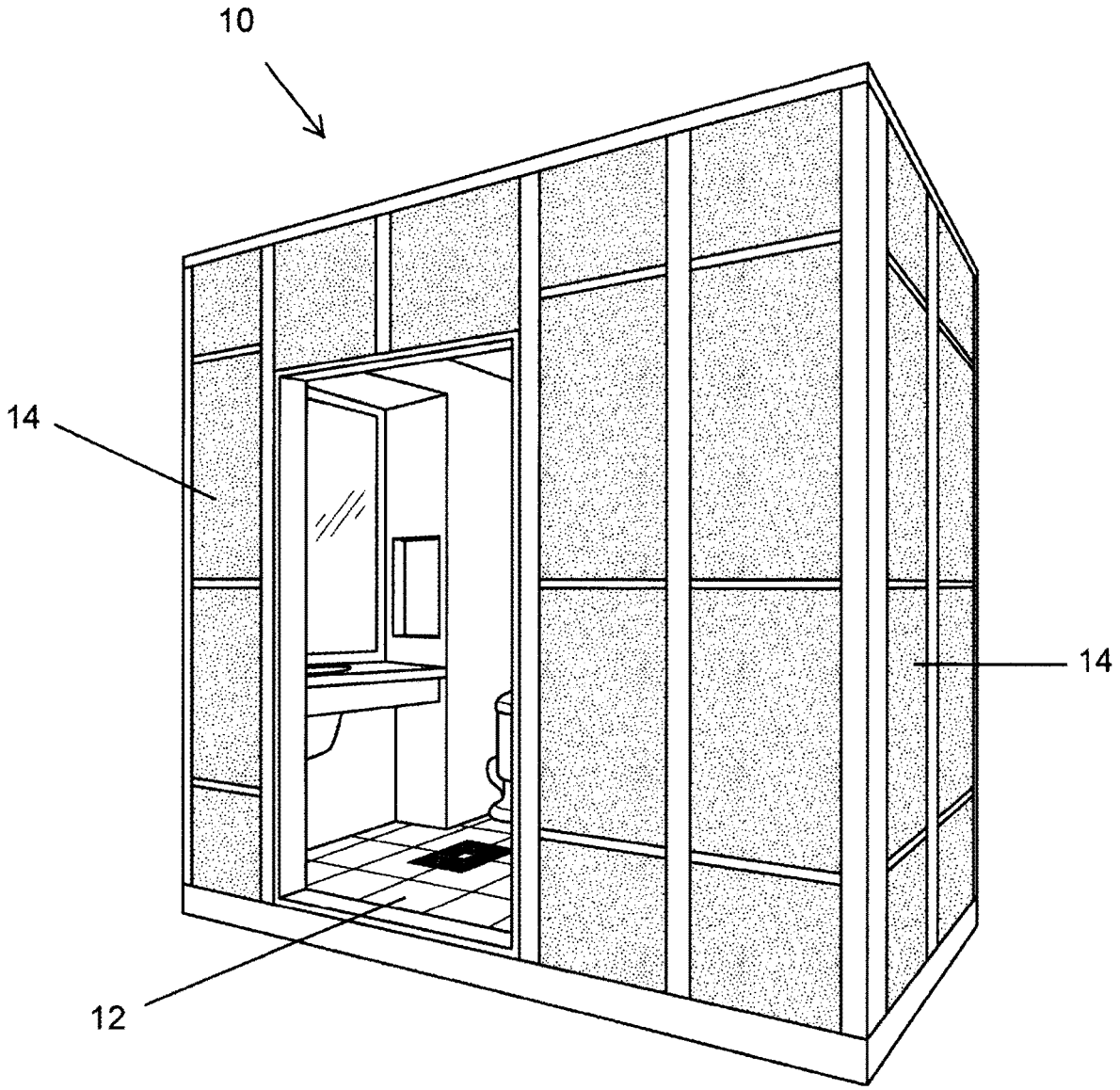
FIG. 1 is a perspective view of a bathroom pod.

As shown in FIG. 1, a modular room or pod 10 is a room that is constructed separately from, and then installed as an assembly into, a building. The pod 10 may be mass-produced, so that each finished pod 10 is substantially the same as other pods 10. In the illustrated embodiment, the pod 10 is a bathroom pod that may be installed in residential buildings, hospitals, hotels, or other similar structures. It is noted that pods for other uses are contemplated and are within the scope of the present disclosure. The bathroom pod 10 is constructed to be substantially ready to use. In other words, fixtures like showers, sinks, and toilets are installed while the pod 10 is being built. Plumbing and electrical connections are also configured, thus allowing the pod 10 to be easily connected to the water and electrical systems of the main building (i.e., apartment, hospital, hotel, etc.) after the pod 10 is installed in the main building. During installation of the pod 10 in a building, the pod 10 can be moved to align any drain installed in pod 10 to be aligned with the plumbing structure of the building.

The illustrated pod 10 includes a floor 12 and a plurality of walls 14. The walls 14 are coupled to the floor 12 in order to define an outer extent of the pod 10. In the illustrated embodiment, the floor 12 is made from a piece of plywood. A stencil or pattern (not shown) is used to outline an area of the floor 12, which allows the area to be repeated on separate bathroom pods 10. The walls 14 are also made from plywood, although the floor 12 and/or walls 14 may be made from a different material.

Figure 2:
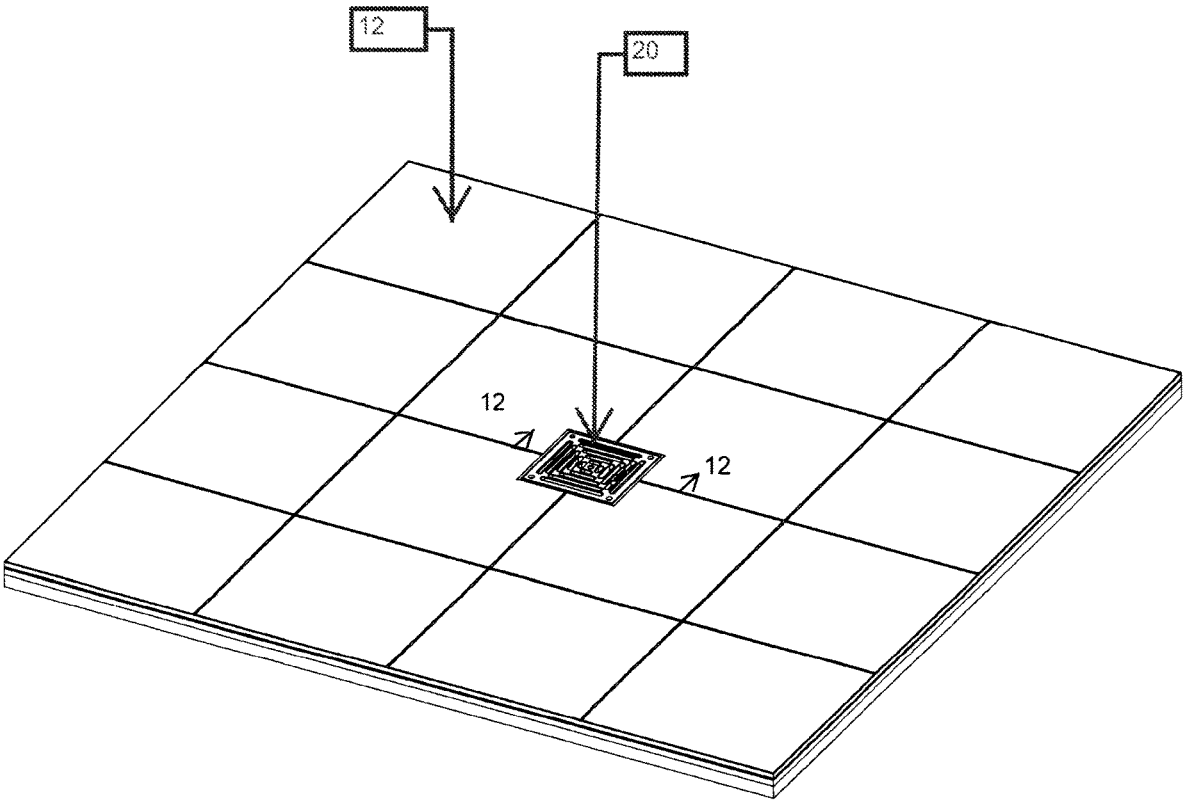
FIG. 2 is a perspective view of a floor with a drain installed.

FIG. 2 illustrates the floor 12 including a drain assembly 20 extending through an opening in the floor 12. The drain assembly 20 permits water to move from the floor 12 into the drain assembly 20. For example, if the pod 10 is a shower, the drain assembly 20 permits water to drain from the floor 12 into the drain assembly 20.

Figure 3:
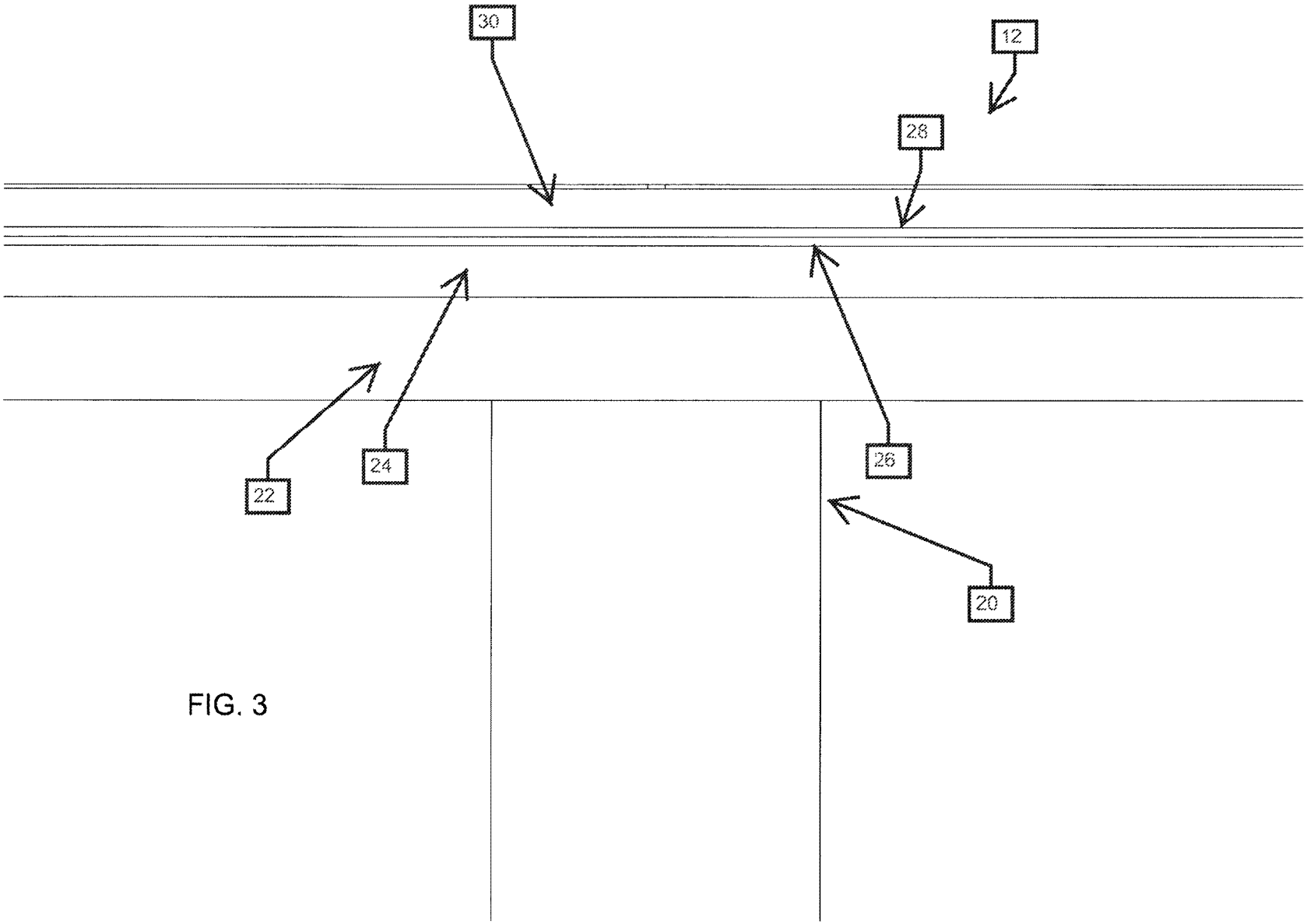
FIG. 3 is a side view of the floor with the drain installed.

FIG. 3 illustrates a cross-section of the floor 12 in greater detail. The floor 12 includes a base layer 22, a first layer 24, a second layer 26, a third layer 28 and a fourth layer 30. The base layer 22 is constructed of typical flooring material(s), such as plywood.

After the walls 14 are coupled to the base layer 22, the first layer 24 (e.g., a rock layer) is coupled to the base layer 22. In the illustrated embodiment, an adhesive (e.g., glue, epoxy, etc.) is applied between the base layer 22 and the first layer 24 in order to secure the first layer in place. The first layer 24 is applied so as to partially or completely cover the base layer 22.

The second layer 26 is applied to the floor 12 after the first layer 24 is set. In the illustrated embodiment, the second layer 26 is a mud that is spread over the surface of the first layer 24. The mud 26 may be spread to completely cover the first layer 24. In some embodiments, the mud 26 is applied unevenly so a greater amount is applied proximate to the walls 14, and less mud 26 is applied proximate a center of the base layer 22. This creates a sloped surface that facilitates drainage of water. In other words, more mud 26 may be applied proximate the edges of the shower, and less mud 26 is applied proximate a center of the shower in order to facilitate water draining from the shower.

The third layer 28 is applied to the floor 12 after the second layer 26 is set. In the illustrated embodiment, the third layer 28 is a sheet or membrane of waterproof material. The membrane 28 covers the base layer 22, the first layer 24, and the second layer 26, and acts as a barrier to prevent water or other liquids from seeping into the floor base layer 22, the first layer 24 and the second layer 26.

The fourth layer or top surface 30 is applied to the floor 12 above the membrane 28. The top surface 30 may be a finished surface that may remain exposed. In some embodiments, the top surface 30 includes tile. An adhesive may be applied to a surface of each tile in order to couple the tile to the membrane 28. A sealant (e.g., grout) may be applied between each of the tiles. The pod 10 is then transferred to the main building structure once completed (i.e., all of the fixtures are installed). An upper face of the top surface 30 is considered to be the upper floor surface.

Figure 4:
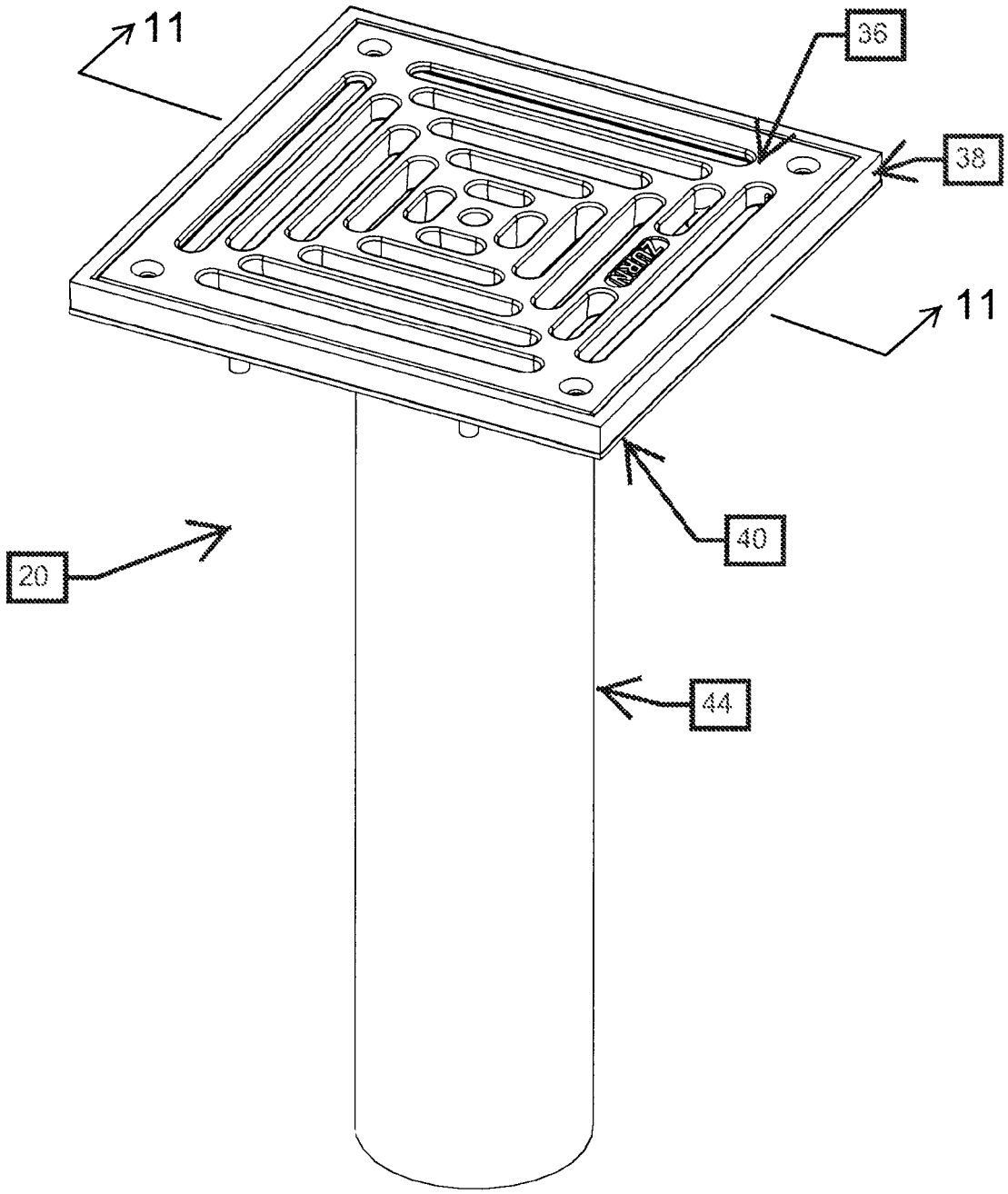
FIG. 4 is a perspective view of the drain.
Figure 5:
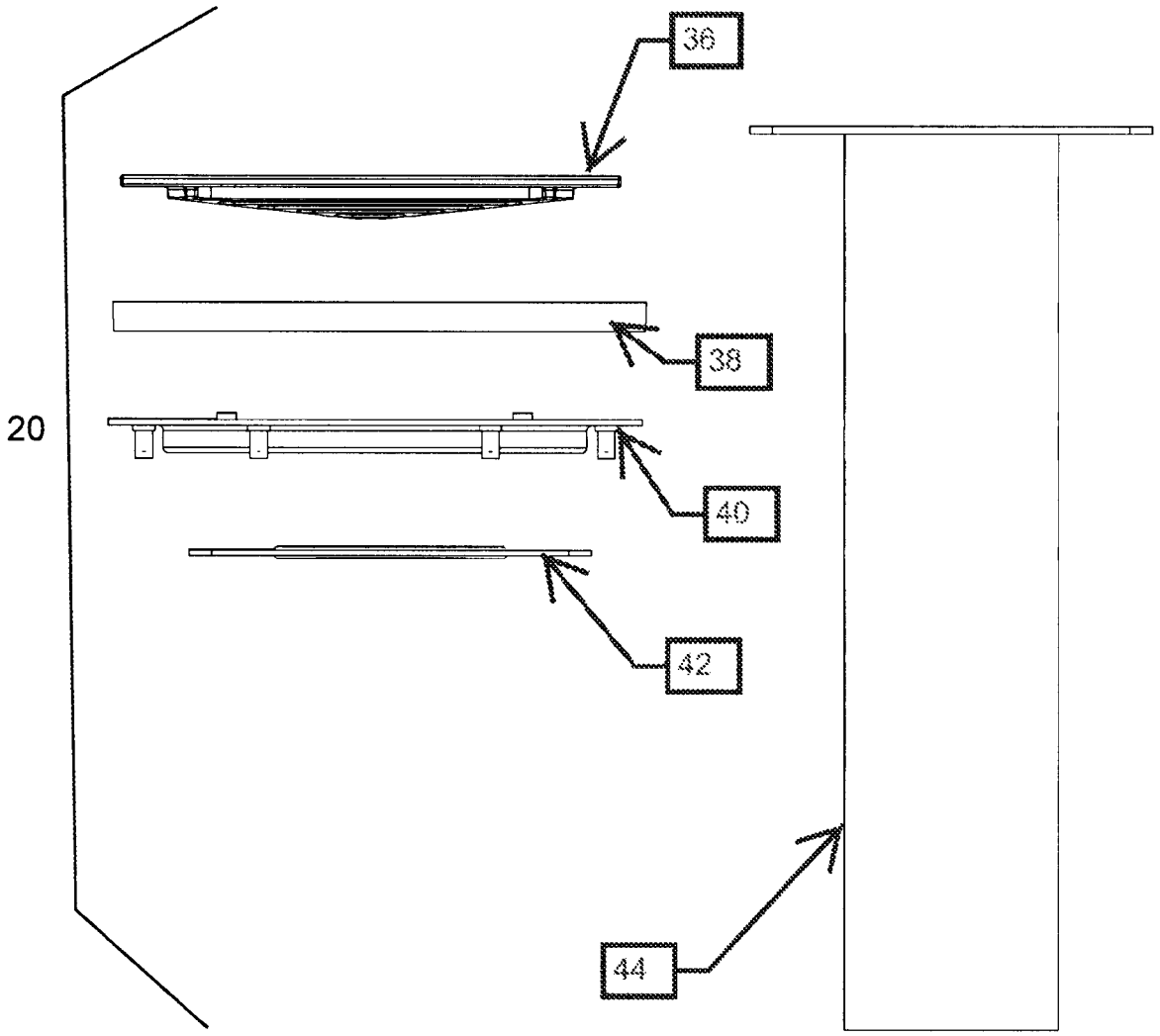
FIG. 5 is an exploded side view of the drain.

FIGS. 4 and 5 illustrate the drain assembly 20 removed from the floor 12. The drain assembly 20 includes a grate 36, a frame 38, a drain body 40, a gasket 42 and an outlet 44.

Figure 6C:
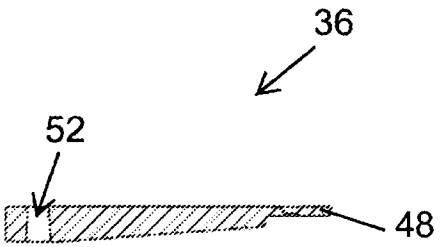
FIG. 6C is a cross-sectional view of the frame of FIG. 6A, viewed along section 6C-6C.
Figure 6A:
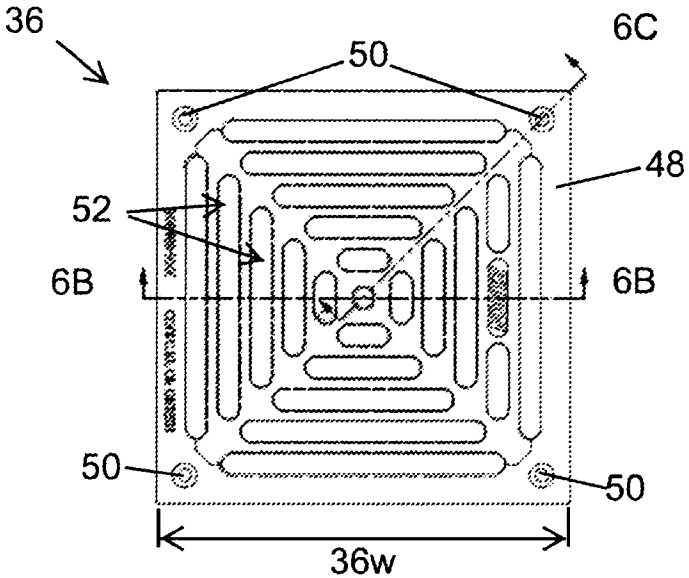
FIG. 6A is a top view of a grate of the drain.
Figure 6B:
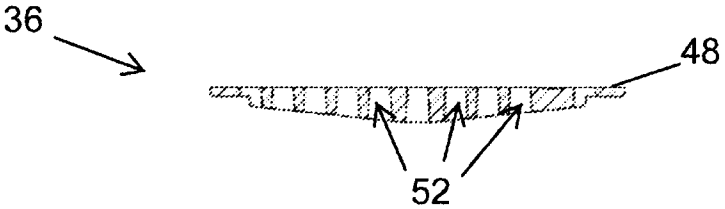
FIG. 6B is a cross-sectional view of the grate of FIG. 6A, viewed along section 6B-6B.

FIGS. 6A-6C illustrate the grate 36 in greater detail. The illustrated grate 36 is square and has a planar upper surface and a tapered lower surface. The grate 36 includes a lip 48 and fastening apertures 50 extending through the lip 48. A center of the strainer 36 is slotted and includes a plurality of openings 52. The openings 52 may be disposed in a variety of shapes and sizes. The grate has a grate width 36*w*.

FIGS. 7A-7C illustrate the frame 38 in greater detail. The illustrated frame 38 includes an opening 56 and a plurality of apertures 58 disposed around the opening 56. The frame 38 also includes a raised lip 60 extending around a perimeter of the frame 38 and a recessed surface 62 extending inward from the raised lip 60. The plurality of apertures 58 are formed in the recessed surface 62. In the illustrated embodiment, the frame 38 has a generally square shape which corresponds to the shape of the grate 36. The frame 38 has an outer frame width 38*wo* measured at an exterior of the raised lip 60 and an inner frame width 38*wi* measured at an interior of the raised lip 60.

Figure 8A:
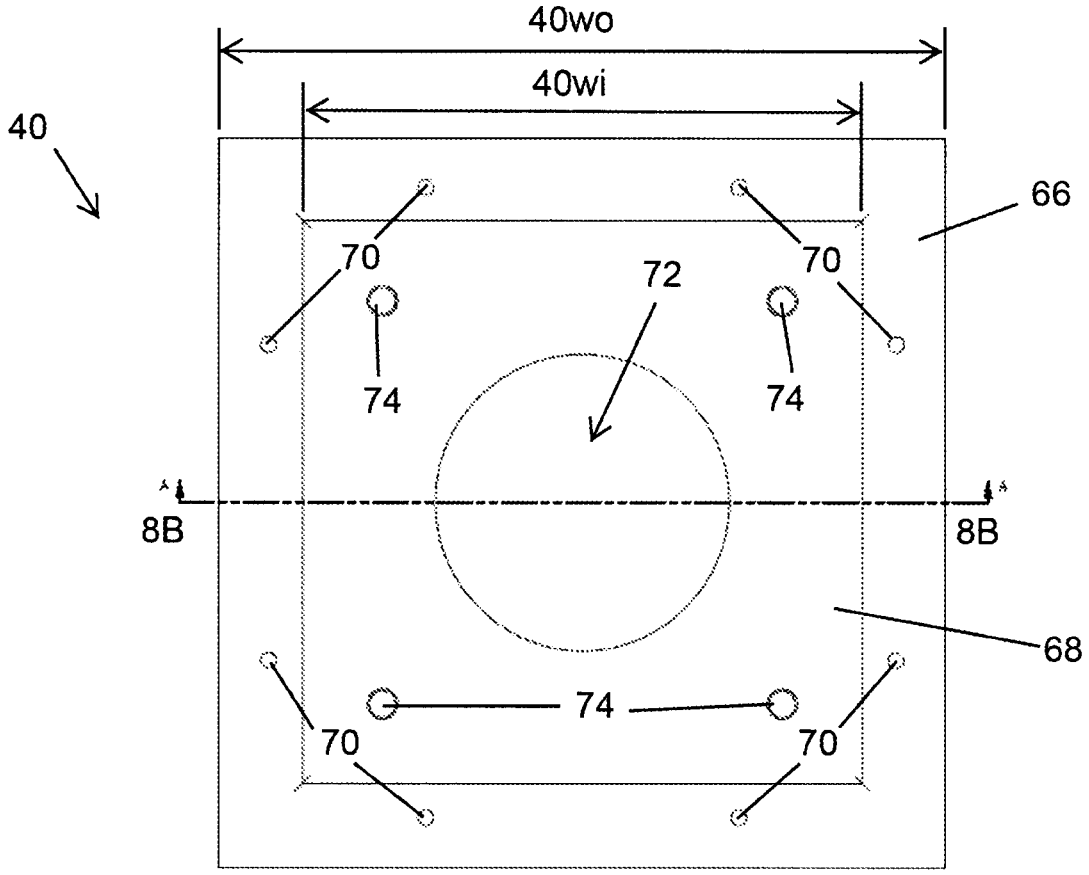
FIG. 8A is a top view of a drain body that may be installed in the bathroom pod of FIG. 1.
Figure 8B:
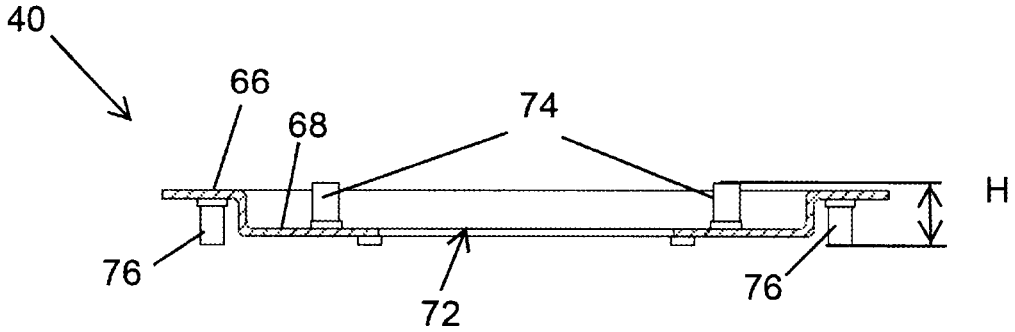
FIG. 8B is a cross-sectional view of the drain body of FIG. 8A, viewed along section 8B-8B.

FIGS. 8A and 8B illustrate the drain body 40 in greater detail. The drain body 40 includes a raised flange 66 and a recessed portion 68 recessed relative to the raised flange 66. The raised flange 66 includes a plurality of apertures 70. The recessed portion 68 includes an opening 72 positioned substantially in a center of the recessed portion 68.

The drain body 40 also includes a plurality of upwardly extending studs 74 are disposed on an upper surface of the recessed portion 68. In the illustrated embodiment, the upwardly extending studs 74 extend to a position raised above the raised flange 66. The upwardly extending studs 74 are spaced apart and include a central opening with threads that are configured to engage a fastening member (e.g., a threaded screw—not shown). A plurality of downwardly depending studs 76 are disposed on a lower surface of the raised flange 66 outside of the recessed portion 68. The downwardly depending studs 76 extend to a position below the recessed portion 68. Each of the downwardly depending studs 76 includes a threaded central opening configured to receive a fastening member. In the illustrated embodiment, the drain body 40 has a square shape and comprises stainless steel, although other suitable materials may be used.

The recessed portion 68 is substantially shallow relative to the raised flange 66. In some embodiments, the recessed portion 68 may be recessed less than two inches relative to the raised flange 66. In some embodiments, the recessed portion 68 may be recessed less than one inch relative to the raised flange 66. In some embodiments, the recessed portion 68 may be recessed less than half an inch relative to the raised flange 66. In some embodiments, the recessed portion 68 may be recessed approximately 0.3125 inches relative to the raised flange 66.

A total height H of the drain body 40 is measured from a free end of the upwardly extending studs 74 to a free end of the downwardly depending studs 76. In some embodiments, the height H is less than 2.5 inches. In some embodiments, the height H is less than two inches. In some embodiments, the height H is less than 1.5 inches. In some embodiments, the height H is less than one inch. In some embodiments, the height H is 0.4375 inches. Even though the drain body has a minimal height, the drain is capable of draining about 12 gallons per minute. In some embodiments, the drain is capable of draining at least 10 gallons per minute.

The drain body 40 defines an outer width 40*wo* extending across an entire width of the drain body 40 and an inner width 40*wi* extending across the recessed portion 68. The drain body outer width 40*wo* is substantially equal to the outer frame width 38*wo*.

Figure 9A:
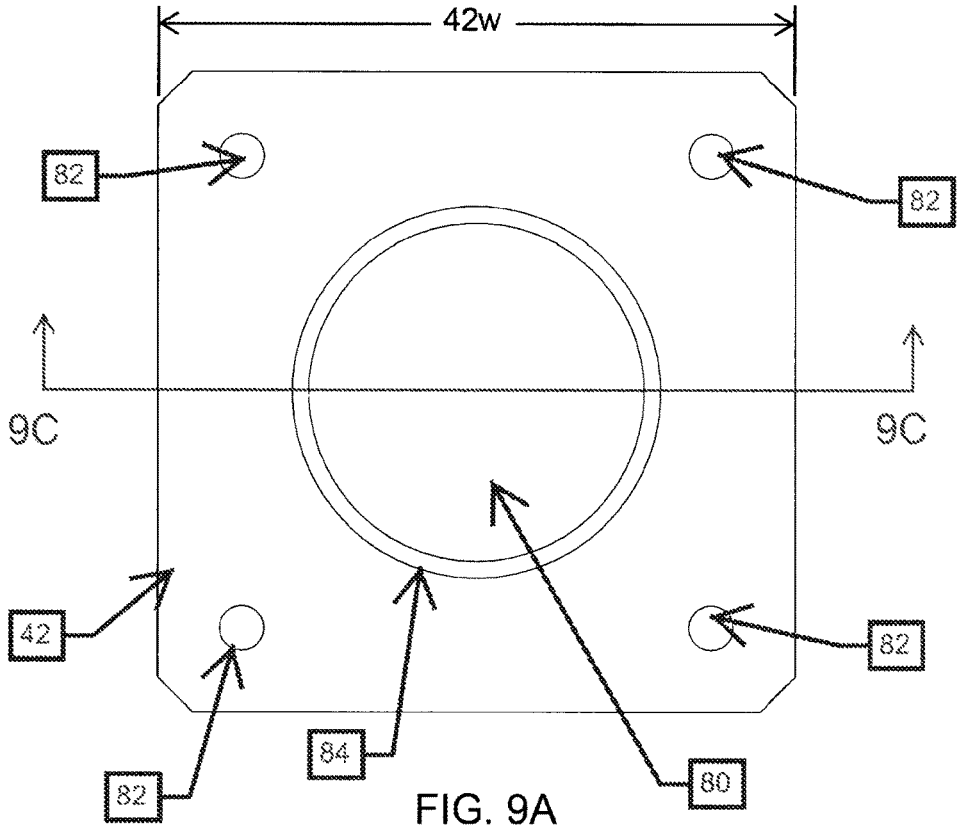
FIG. 9A is a top view of a gasket that may be coupled between the drain body of FIG. 8A.
Figure 9B:
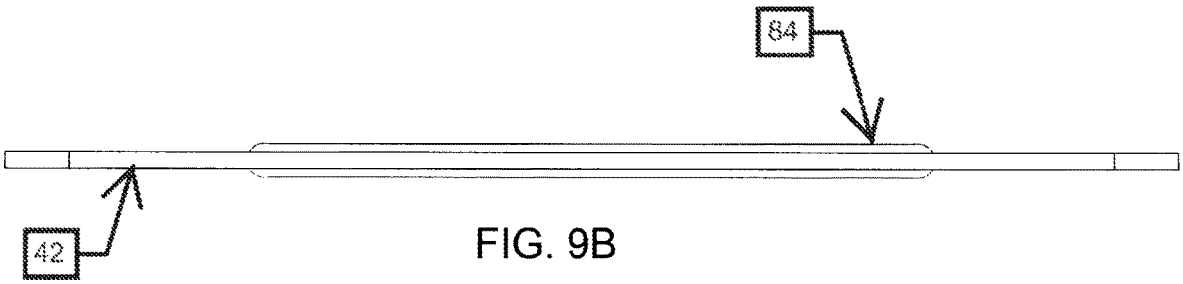
FIG. 9B is a side view of the gasket of FIG. 9A.
Figure 9C:
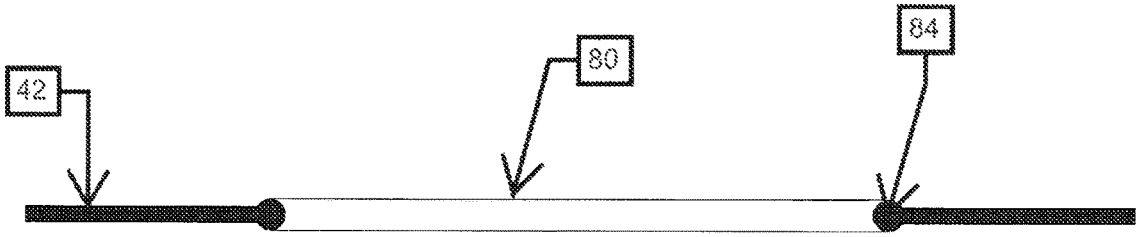
FIG. 9C is a cross-sectional view of the gasket of FIG. 9A, viewed along section 9C-9C.

FIGS. 9A-9C show the gasket 42 in greater detail. The illustrated gasket 42 includes a central opening 80, a plurality of apertures 82 disposed radially outside of the central opening 80, and a protruding ring 84 substantially encircling the central opening 80. Each of the plurality of apertures 82 is configured to receive a respective one of the upwardly extending studs 74 when the gasket 42 is installed on the drain body 40.

The gasket 42 is substantially square and has a gasket width 42*w*. The gasket width 42*w* is substantially equal to the drain body inner width 40*wi*. The corners of the gasket 42 have been removed to provide locations at which a user can grasp the gasket 42 and remove the gasket 42 from the drain body recessed portion 68.

The central opening 80 of the gasket 42 is substantially the same size and shape as the central opening 72 of the drain body 40. The protruding ring 84 is configured to form a seal at the central opening 72 of the drain body 40.

Figure 10B:
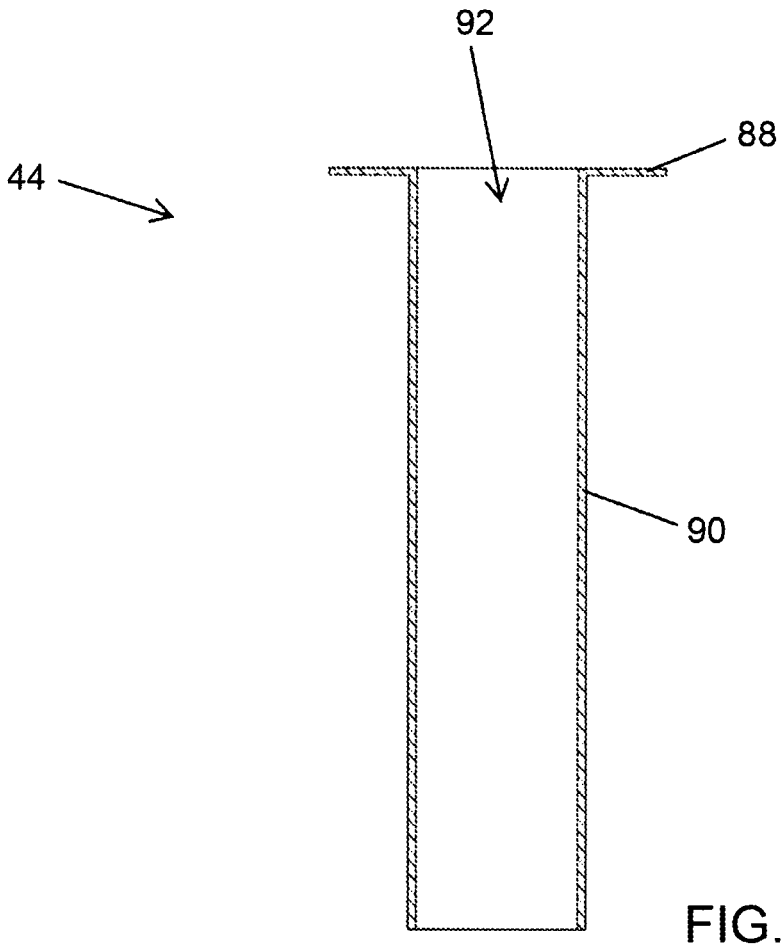
FIG. 10B is a cross-sectional view of the outlet of FIG. 10A, viewed along section 10B-10B.
Figure 10A:
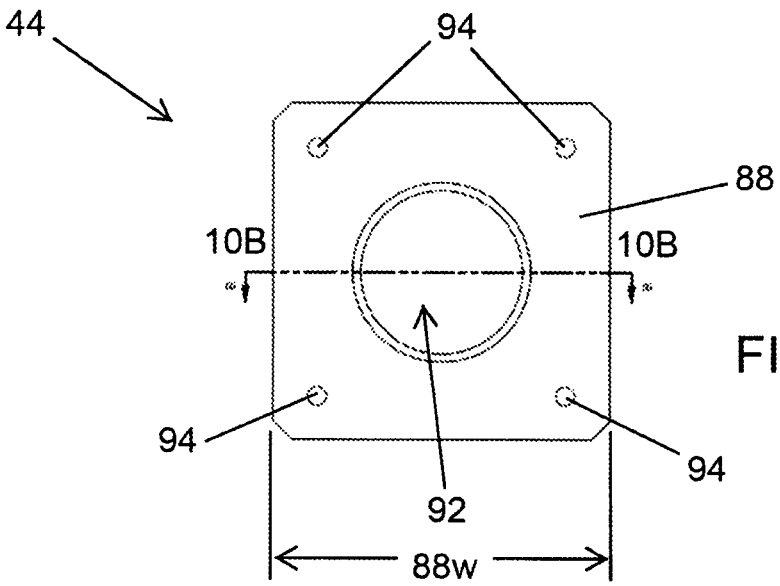
FIG. 10A is a top view of an outlet that may be coupled to the drain body of FIG. 8A and the gasket of FIG. 9A.

FIGS. 10A and 10B illustrate the outlet 44 in greater detail. The illustrated outlet 44 includes a flange 88 and an elongated conduit 90 extending from the flange 88. The outlet 44 defines a passageway 92 extending from the flange 88 and through the elongated conduit 90. In the illustrated embodiment, the flange 88 includes apertures 94. Each of the plurality of apertures 94 is configured to receive a respective one of the upwardly extending studs 74 when the outlet 44 is installed on the drain body 40 and the gasket 42.

The flange 88 has a flange width 88*w* that substantially corresponds to the gasket width 42*w*, and to the drain body inner width 40*wi*. The elongated conduit 90 has an outer diameter that substantially corresponds to a diameter of the drain body central opening 72 and the gasket central opening 80.

The outlet 44 comprises stainless steel, although other suitable materials may be used. The outlet 44 provides fluid communication between the drain body 40 and the main building structure's plumbing system. The outlet 44 drops into the drain body 40 from the topside of the pod 10 once the pod 10 is in place.

Figure 11:
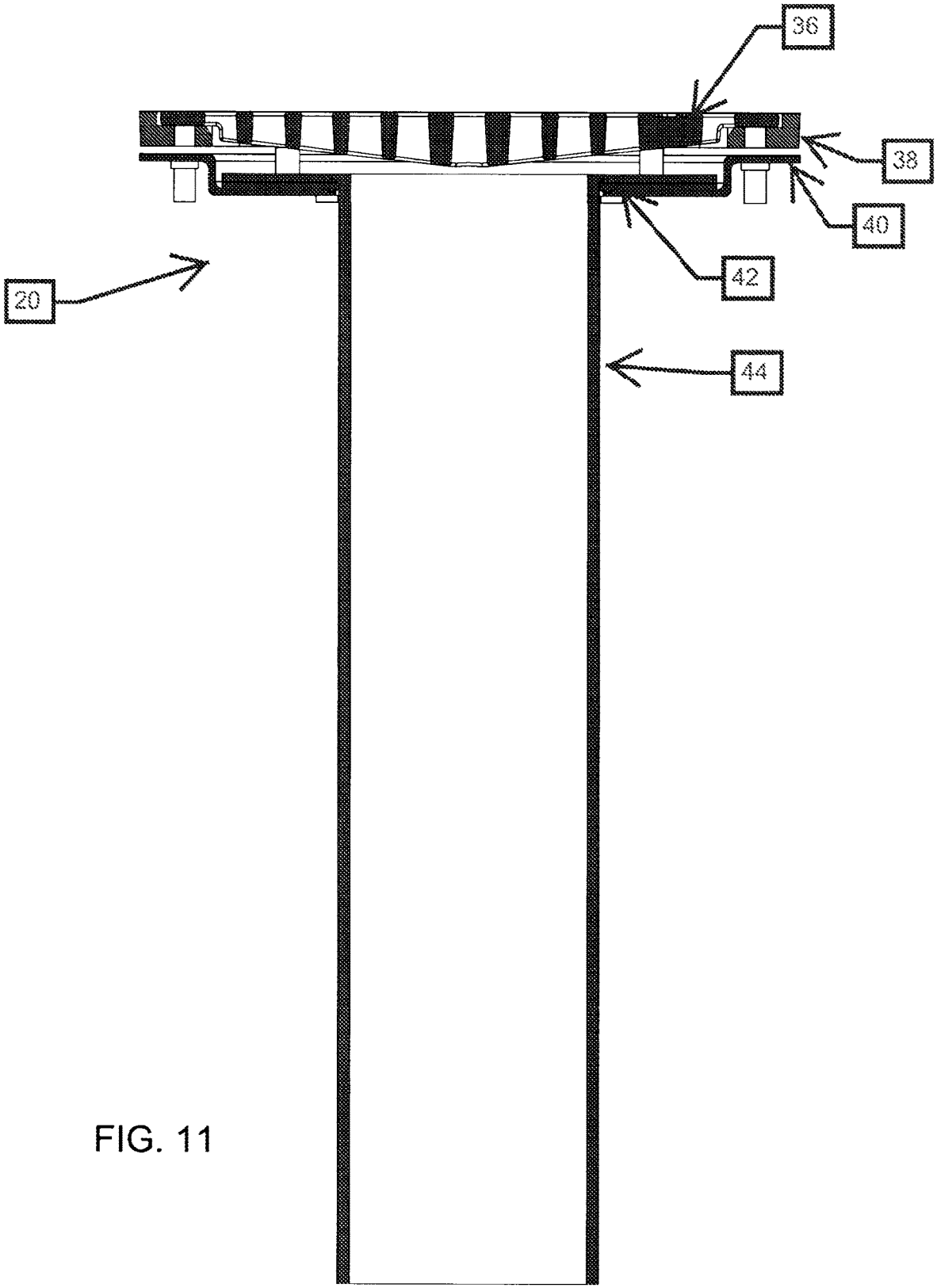
FIG. 11 is a cross-sectional view taken along line 11-11 of FIG. 4.

FIG. 11 illustrates the assembled drain assembly 20. The grate 36 is positioned on the frame 38 such that the upper surface of the grate 36 is flush with the upper surface of the frame 38. The grate width 36*w* is substantially equal to the inner frame width 38*wi* such that the grate 36 is positioned on the recessed surface 62 of the frame 38. The drain body 40 is positioned below the frame 38 and the drain body outer width 40*wo* is substantially equal to the outer frame width 38*wo*. The gasket 42 is positioned between the recessed portion 68 of the drain body 40 and the flange 88 of the outlet 44.

Figure 12:
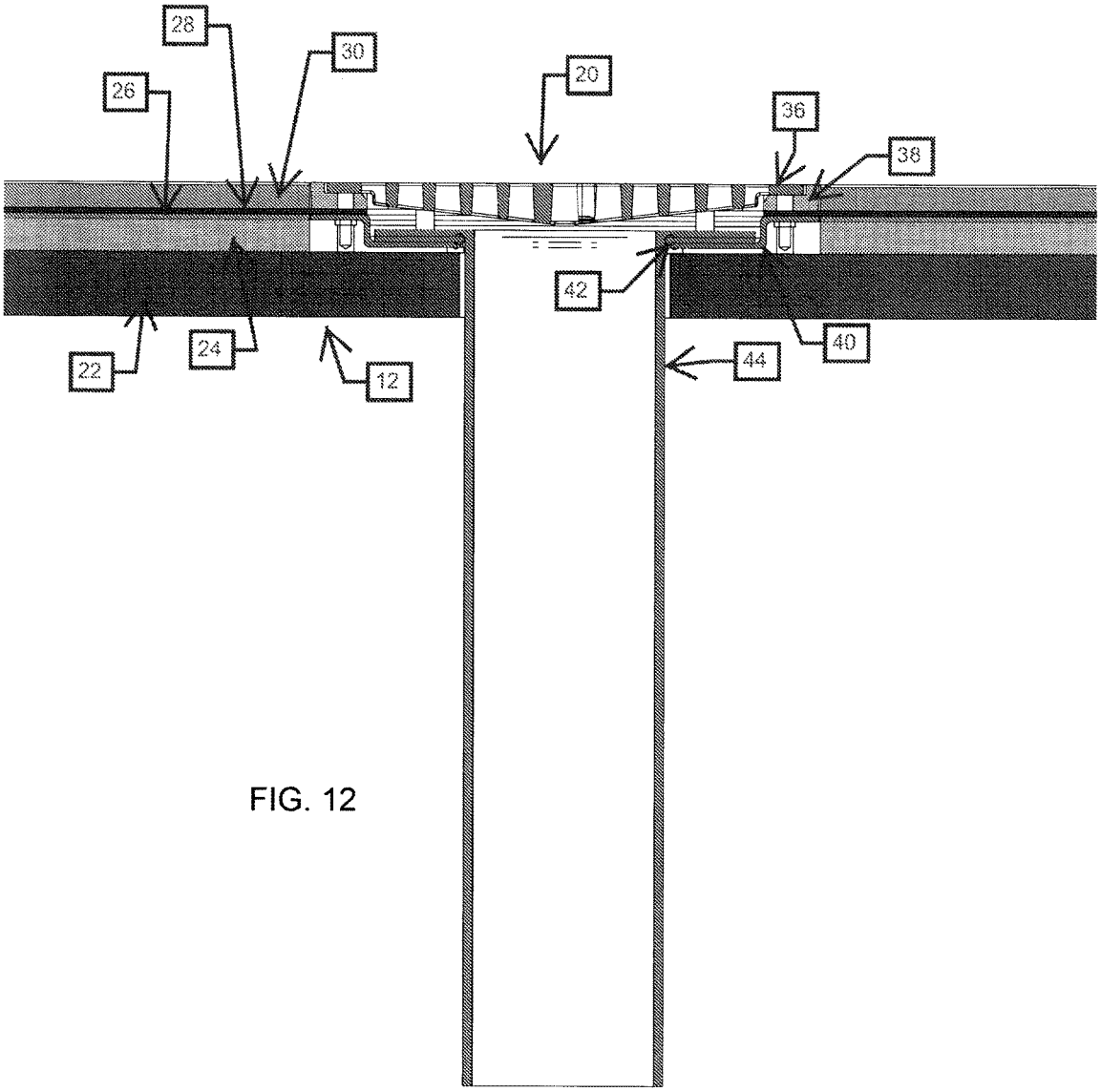
FIG. 12 is a cross-sectional view taken along line 12-12 of FIG. 2.

FIG. 12 illustrates the drain assembly 20 installed in the floor 12. A hole is cut into the base layer 22 at the desired location (e.g., proximate the shower) and provides a drainage hole. The drain body 40 is positioned on the base layer 22 substantially surrounding the hole in the base layer 22. The drain body 40 is connected to the base layer 22 by fasteners (e.g., threaded nuts—not shown) extending through the downwardly depending studs 76 and into the base layer 22. Alternatively or in addition, welding, adhesives (e.g., glue, silicone), or threads may be used to couple the drain body 40 to the base layer 22. In other embodiments, the hole is cut in the base layer 22 after the drain body 40 has been installed on the base layer 22.

The first layer 24 is then applied to the base layer 22 around a perimeter of the drain body 40. The second layer 26 is then applied to the first layer 24 around the drain body 40. The first layer 24 and the second layer combined 26 define a height substantially equal to the drain body height H.

In some embodiment, the first layer 24 is applied to the base layer 22 and the second layer 26 is applied to the first layer 24 before the drain body 40 has been connected to the base layer 22. Then, a first hole is drilled through the base layer 22, the first layer 24 and the second layer 26. Then a second, bigger hole is cut in the first layer 24 and the second layer 26 to accommodate the drain body 40 prior to installation of the drain body 40.

The third layer 28 is positioned on top of the raised flange 66 of the drain body 40 and the frame 38 is positioned on top of the third layer 28 such that the third layer 28 is compressed or sandwiched between the drain body 40 and the frame 38. The third layer 28 forms a seal between the drain body 40 and the frame 38 around a perimeter of the drain body 40 and the frame 38. The third layer 28 limits or prevents liquid from seeping around the outside of the drain body 40 and into the base layer 22 of the floor 12.

A leak test may be performed after the third layer 28 is installed. The room is filled with water to verify that the third layer 28 was successfully installed. A plug (not shown) may be positioned in the drain body 40 in order to limit or prevent water from leaving the pod 10. After the seal is verified, the water is drained from the pod 10, and the plug is removed from the drain body 40.

The fourth layer 30 is installed on top of the third layer 28 leaving a hole substantially corresponding to the size and shape of the frame 38. In some embodiments, the frame 38 can be remain installed before the fourth layer 30 is applied. In other embodiments, the frame 38 can be removed prior to installation of the fourth layer 30.

The gasket 42 is positioned on the recessed portion 68 of the drain body 40 such that the upwardly extending studs 74 extend through a respective one of the gasket apertures 82. The elongated conduit 90 of the outlet 44 is inserted through the frame opening 56, the drain body central opening 72, the gasket central opening 80, as well as through the openings formed in the floor 12. The diameter of the elongated conduit 90 substantially corresponds to the diameter of the hole in the base layer 22. Fasteners (e.g., threaded nuts—not shown) secure the elongated conduit 90 to the studs upwardly extending studs 74 of the drain body 40 in order to couple the outlet 44 to the drain body 40. Alternatively or in addition, welding, adhesives (e.g., glue, silicone), or threads may be used to couple the outlet 44 to the drain body 40.

The gasket 42 forms a seal between the drain body 40 and the outlet 44 around a perimeter of the outlet 44. The gasket 44 limits or prevents liquid from flowing between the outer surface of the outlet 44 and the drain body 40, so that all liquid flows into the outlet passageway 92. The outlet 44 is coupled to a plumbing pipe in the plumbing system while being inserted through the central opening 72 so that once the outlet 44 installed (e.g., coupled to the drain body 40), a fluid pathway exists between the drain body 40 and the plumbing system.

The grate 36 is then installed on top of the frame 38. The lip 48 of the grate 36 is positioned on the recessed surface 62 of the frame 38. The lip 48 of the grate 36 has a height that corresponds to a height of the raised lip 60 of the frame 38, such that the installed drain is flush or substantially flush with the top of the raised lip 60 of the frame 38. The top of the raised lip 60 and the top of the grate 36 are flush or substantially flush with the upper surface of the floor 12. Fasteners (e.g., threaded screws—not shown) are inserted through the fastening apertures 50 to retain the grate 36 on the frame 38.

During shipping, the outlet 44 is separated from the remainder of the pod 10, because the outlet 44 extends below the bottom of the base layer 22. The pod 10 is substantially a rectangular prism while the outlet 44 is removed, such that the pods 10 can be stacked and shipped easily. The raised flange 66 and the recessed portion 68 of the drain body 40 position both the upwardly extending studs 74 and the downwardly depending studs 76 within the rectangular prism of the pod 10 and within the height of the floor 12. The upwardly extending studs 74 and the downwardly depending studs 76 are unlikely to experience any dents, fractures, or other damage from occurring to the drain body 40 as the pod 10 is being moved and positioned into the main building structure.

The completed pod 10 (with the outlet 44, and optionally the gasket 42, removed) is positioned on a floor in the main building structure in a designated area. The pod 10 is moved into place and is coupled to the floor of the main building structure. The structure may already be configured with drainage piping, so the pod 10 is placed or aligned in order to easily couple the drain with the piping. A hole of the pod 10 may be aligned with a hole cut into the floor of the main building structure. The hole in the main building structure provides communication to the plumbing system (e.g., piping) of the structure.

Once the pod 10 is installed and coupled to the floor of the main building structure, a user may fluidly connect the pod 10 to the plumbing system. Specifically, the user may connect the drain to the plumbing system. As the pod 10 is positioned on the floor of the main building structure, the drain body 40 does not contact the floor structure.

Figure 13:
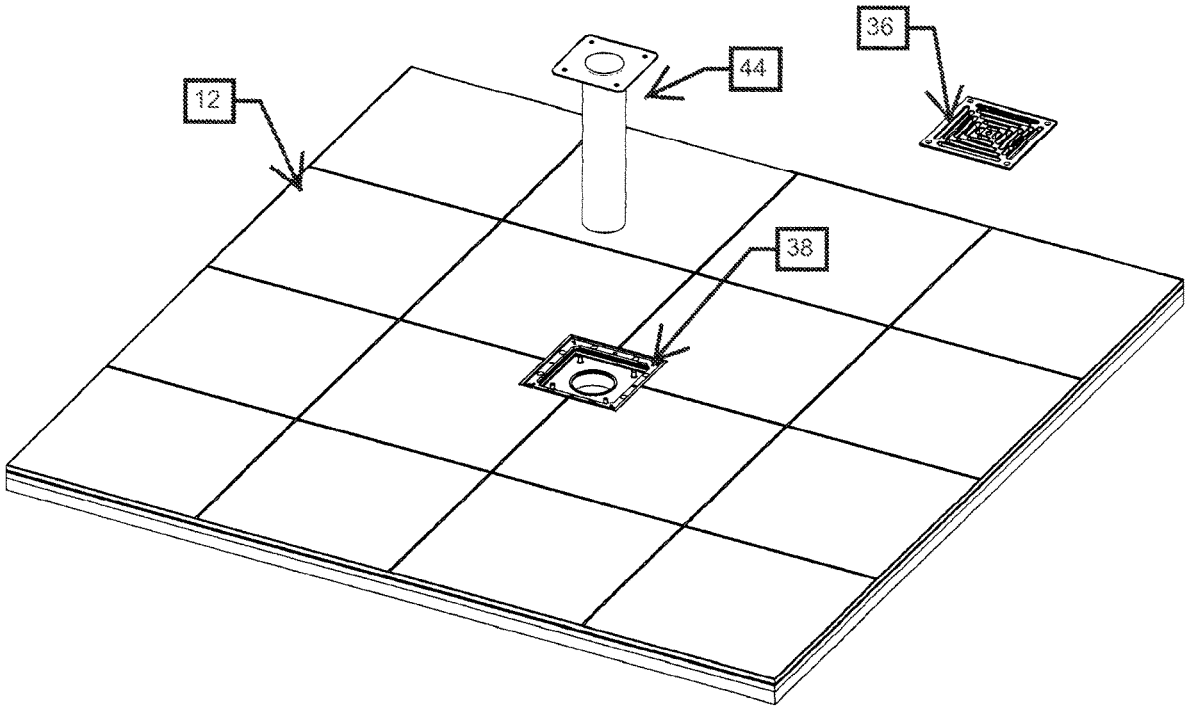
FIG. 13 is a perspective view of a portion of the drain removed from the floor.

FIG. 13 illustrates the installation process of the drain 20 in the floor 12 with the walls 14 removed for clarity. The floor 12 is positioned on a surface in the designated area of the main building structure. The grate 36 is removed from the frame 38, leaving the frame 38, the drain body 40 and optionally the gasket 42 installed in the floor 12. The outlet 44 is inserted into the frame opening 56, the drain body central opening 72, the gasket central opening 80 and the hole in the floor 12. Fasteners are inserted through the outlet apertures 94 and the gasket apertures 82 to secure the elongated conduit 90 to the upwardly extending studs 74 of the drain body 40 in order to couple the outlet 44 to the drain body 40. Alternatively or in addition, welding, adhesives (e.g., glue, silicone), or threads may be used to couple the outlet 44 to the drain body 40.

After the outlet 44 has been connected to the drain body 40, the grate 36 is positioned on the frame 38 and fasteners are inserted through the grate fastening apertures 50 to secure the grate 36 to the frame 38.

In some embodiments, the gasket 42 is omitted from the completed pod 10 during shipping. In these embodiments, the gasket 42 is positioned on the drain body 40 prior to installation of the outlet 44.

In some embodiments, the drain 20 has a different overall shape. For example, the grate 36, the frame 38, the drain body 40, the gasket 42 and the flange 88 of the outlet 44 can be circular, rectangular, ovular, pentagonal, hexagonal, octagonal, or other suitable shape. The illustrated square embodiment is shown for illustration purposes only and is not intended to limit the overall shape of the drain 20. Similarly, the circular shape of the drain body central opening 72, the gasket central opening 80 and the outlet passageway 92 is shown by way of example only. It is conceived that the drain body central opening 72, the gasket central opening 80 and the outlet passageway 92 can have other shapes and configurations without departing from the scope of the present disclosure. Furthermore, the elongated conduit 90 of the outlet 44 can be tapered or have a changing cross sectional shape at different axial locations along the length of the elongated conduit 90.

Figure 14A:
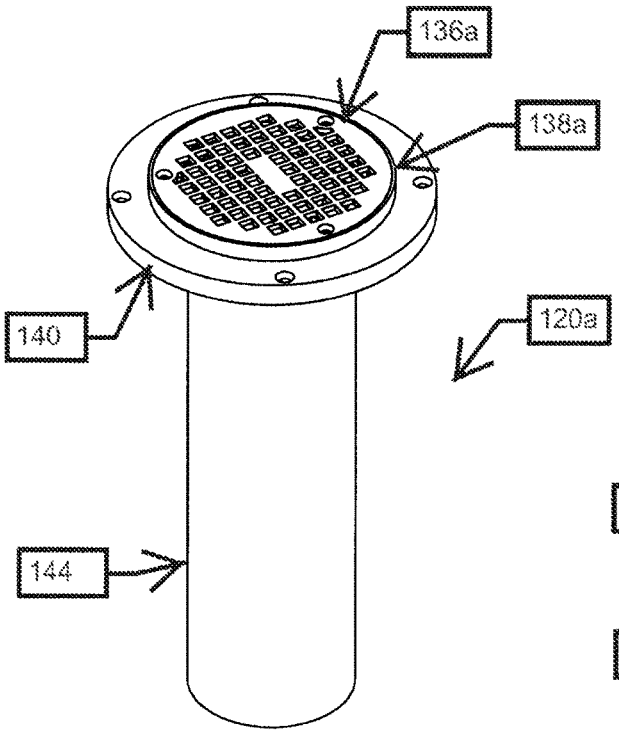
FIGS. 14A-14D are perspective views of various drain embodiments.

FIGS. 14A through 15D illustrate various grate and frame configurations according to some embodiments. FIGS. 14A and 15A illustrate a first embodiment of a drain 120*a* including a grate 136*a*, a frame 138*a*, a drain body 140, a first outlet 144, a second outlet 144', a third outlet 144" and a fourth outlet 144'". The illustrated grate 136*a* and the illustrated frame 138*a* are circular and have a smaller diameter than the drain body 140. The grate 136*a* has a slightly smaller diameter than the frame 138*a*. The frame 138*a* includes a raised lip 160*a* around the perimeter and is recessed to receive the grate 136*a*. A plurality of fasteners retain the grate 136*a* in the frame 138*a*. The top of the grate 136*a* and the top of the raised lip 160*a* form a planar upper surface of the drain 120*a*. The frame 138*a* defines a circular opening 156*a* to permit fluid flow therethrough.

The drain body 140 is circular and includes a planar upper surface upon which the frame 138*a* can be fixed by fasteners. The frame includes a circular opening 172*a* that is generally aligned with the circular opening in the frame 138*a*. The circular opening includes a recessed portion 168*a*.

While the first outlet 144, the second outlet 144', the third outlet 144" and the fourth outlet 144'" are all illustrated, only one of the first outlet 144, the second outlet 144', the third outlet 144" and the fourth outlet 144'" is utilized in each installation. The first outlet 144 includes a flange 188 and an elongate conduit 190. The flange 188 rests on the recessed portion 168*a* of the drain body 140 when installed. The flange 188 includes apertures configured to receive fasteners to connect the first outlet 144 to the drain body 140. One or more gaskets can be positioned between the flange 188 and the recessed portion 168*a*.

The second outlet 144' includes a flange 188' and an elongate conduit 190'. The flange 188' rests on the recessed portion 168*a* of the drain body when installed. The flange 188' includes apertures configured to receive fasteners to connect the second outlet 144' to the drain body 140. One or more gaskets can be positioned between the flange 188' and the recessed portion 168*a*. The outer diameter of the flange 188 is substantially identical to the outer diameter of the flange 188'. The elongate conduit 190 has a smaller diameter than the elongate conduit 190' to accommodate different plumbing configurations.

The third outlet 144" includes a flange 188" and an elongate conduit 190". The flange 188" rests on the recessed portion 168*a* of the drain body when installed. The flange 188" includes protrusions configured to receive a tool to rotate the third outlet 144" to connect the third outlet 144" to the drain body 140. One or more gaskets can be positioned between the flange 188" and the recessed portion 168*a*. The outer diameter of the flange 188" is substantially identical to the outer diameter of the flanges 188 and 188'. The elongate conduit 190" has a diameter substantially equal to the than the elongate conduit 190.

The fourth outlet 144''' includes a flange 188''' and an elongate conduit 190'''. The flange 188''' rests on the recessed portion 168*a* of the drain body when installed. The flange 188''' includes protrusions configured to receive a tool to rotate the third outlet 144''' to connect the fourth outlet 144''' to the drain body 140. One or more gaskets can be positioned between the flange 188''' and the recessed portion 168*a*. The outer diameter of the flange 188''' is substantially identical to the outer diameter of the flange 188'. The elongate conduit 190''' has a diameter substantially equal to the elongate conduit 190'.

Figure 14B:
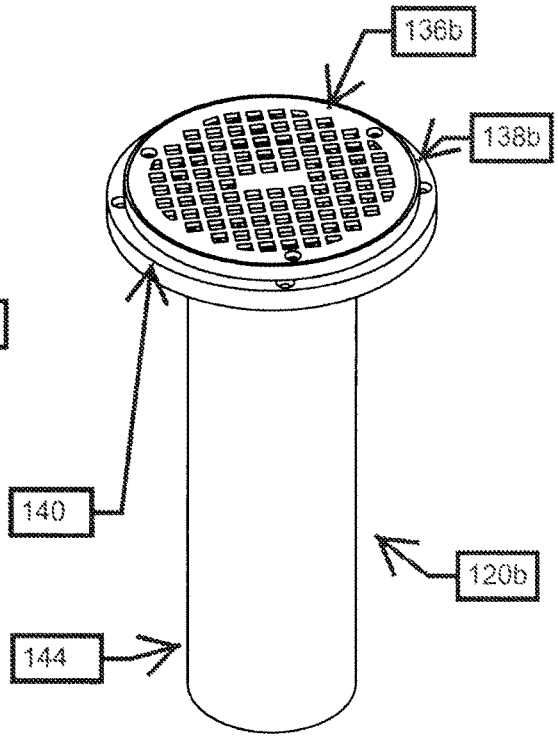
Figures 15A, 15B:
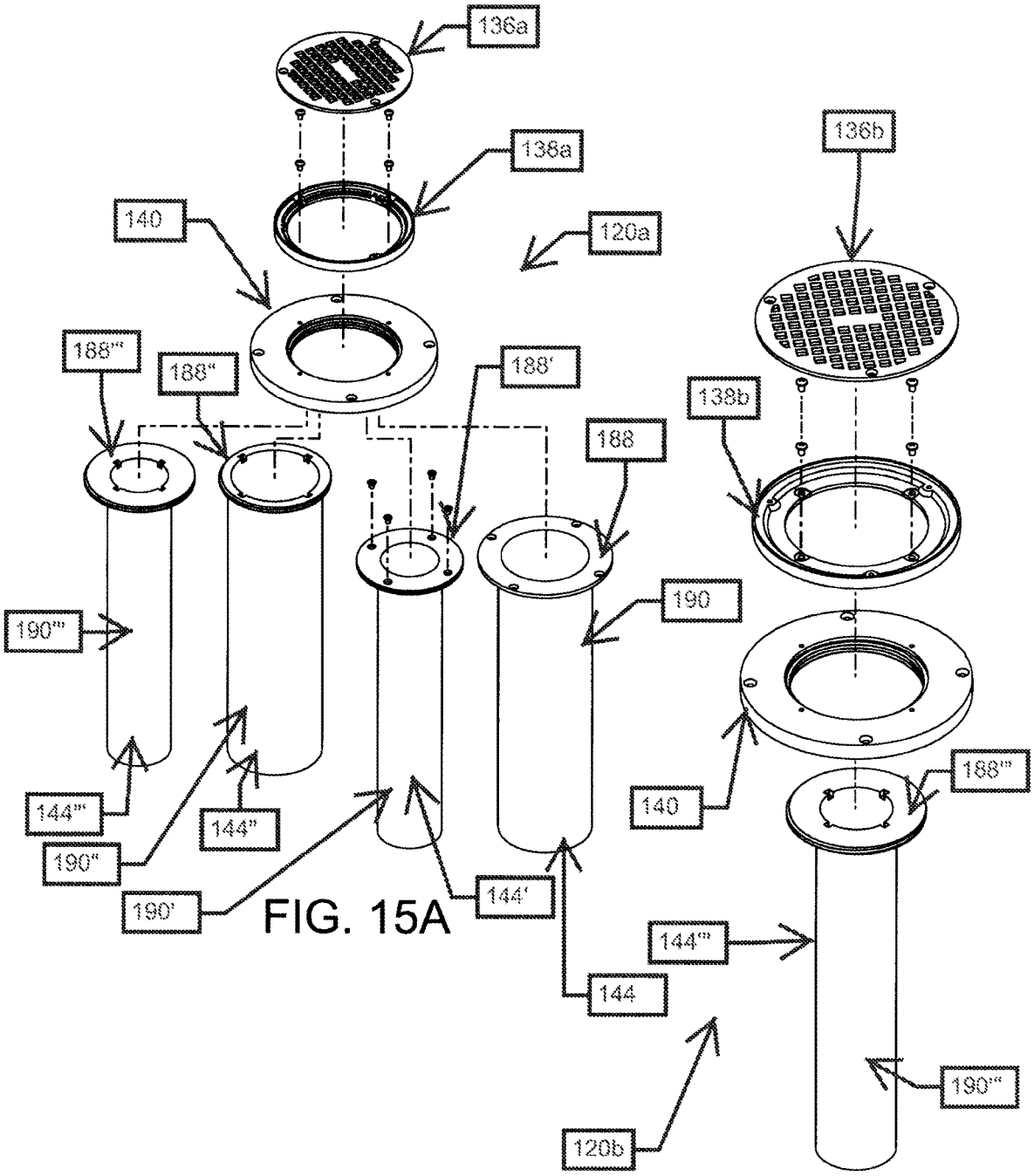
FIGS. 15A-15D are exploded views of the embodiments of FIGS. 14A-14D.

FIGS. 14B and 15B illustrate a second embodiment of a drain 120*b* including a grate 136*b*, a frame 138*b*, the drain body 140 and the fourth outlet 144'''. The illustrated grate 136*b* and the illustrated frame 138*b* are circular and have a slightly smaller diameter than the drain body 140. The grate 136*b* has a slightly smaller diameter than the frame 138*b*. The frame 138*b* includes a raised lip 160*b* around the perimeter and is recessed to receive the grate 136*b*. A plurality of fasteners retain the grate 136*b* in the frame 138*b*. The top of the grate 136*b* and the top of the raised lip 160*b* form a planar upper surface of the drain 120*b*. The frame 138*b* defines a circular opening 156*b* to permit fluid flow therethrough. The grate 136*b* has a larger diameter than the grate 136*a* and the frame 138*b* has a larger diameter than the grate 138*a*. In some embodiments, the diameter of the grate 136*a* can be around five inches and the diameter of the grate 136*b* can be around six inches.

The same drain body 140 is used and any one of the first outlet 144, the second outlet 144', the third outlet 144" and the fourth outlet 144''' can be used with the grate 136*b* and the frame 138*b*.

Figure 14C:
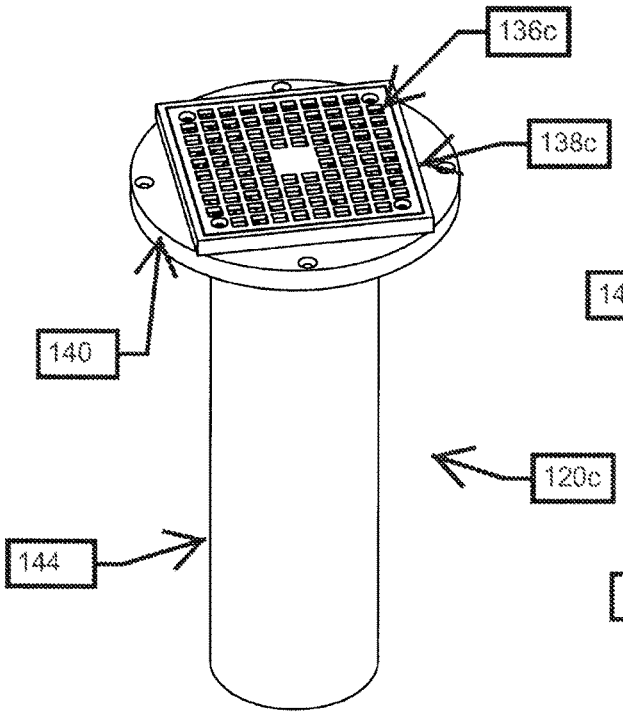
Figures 15C, 15D:
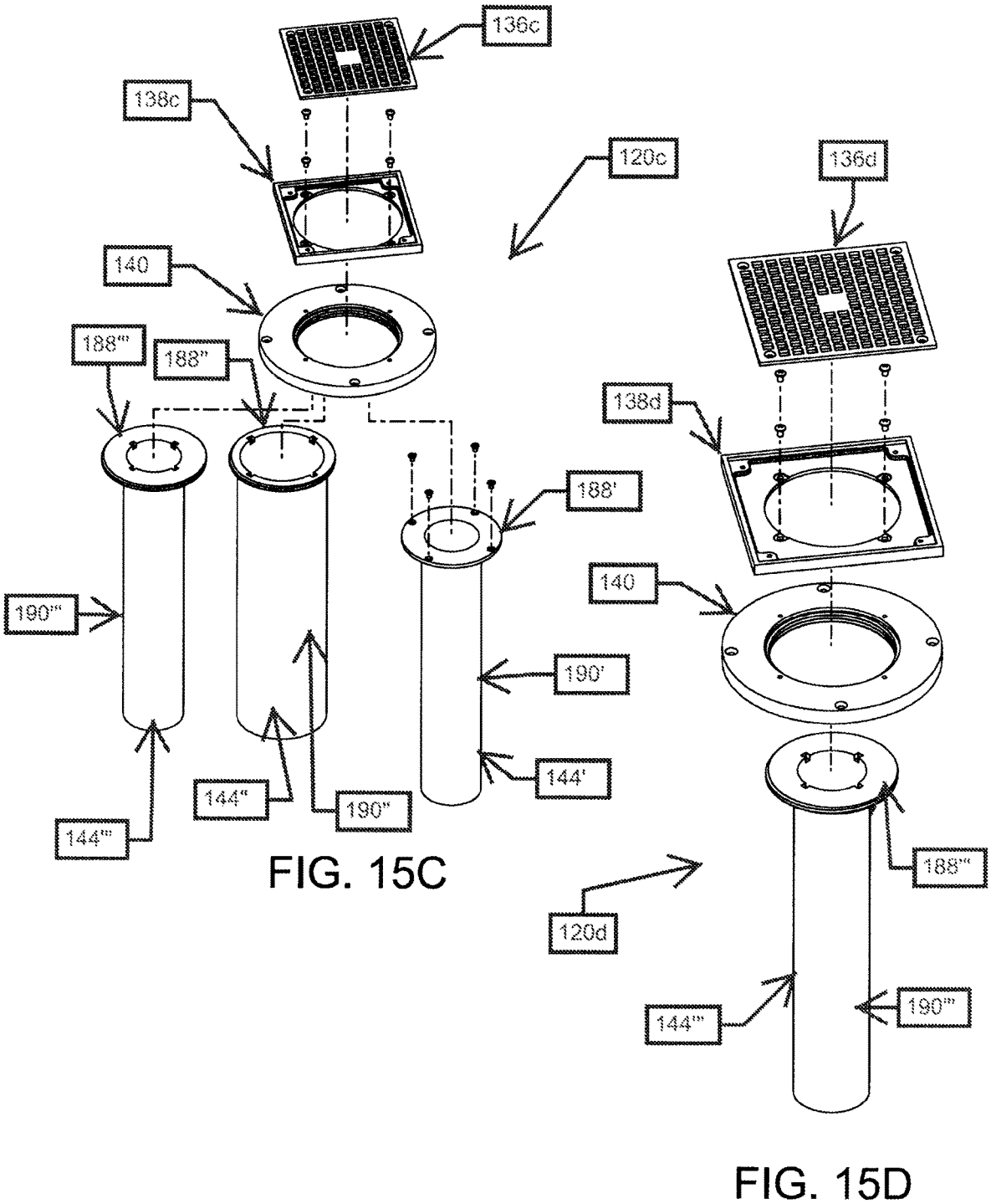
Figure 16A:
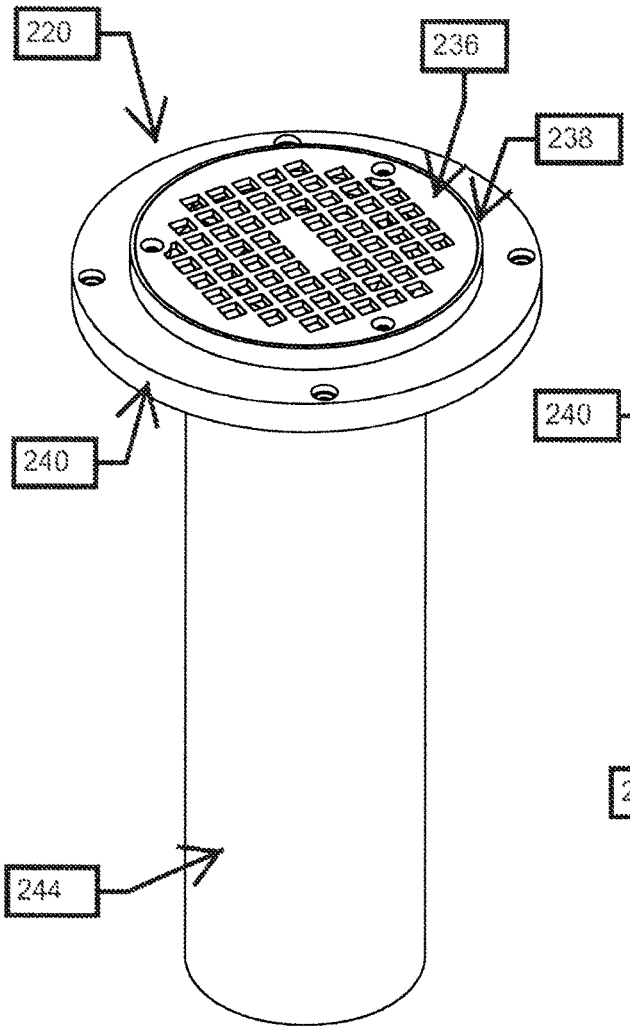
FIGS. 16A-E are various views of one possible drain embodiment.
Figure 16B:
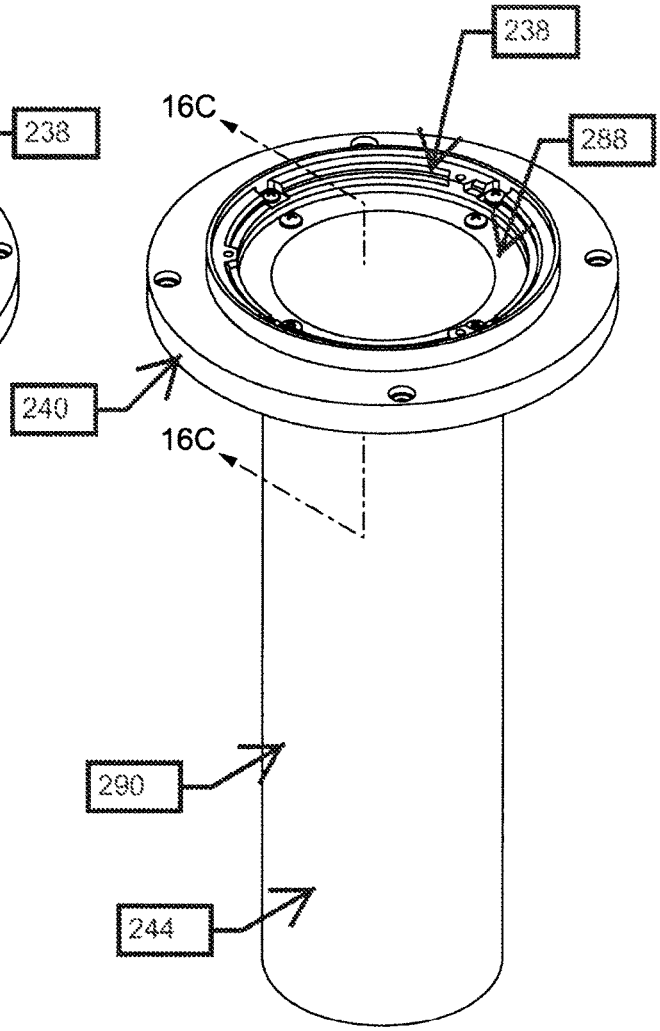
Figure 16C:
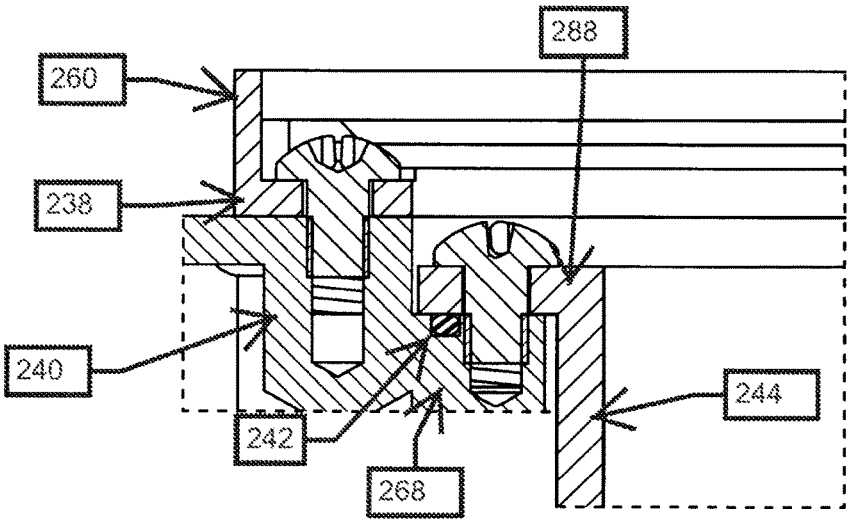
Figure 16D:
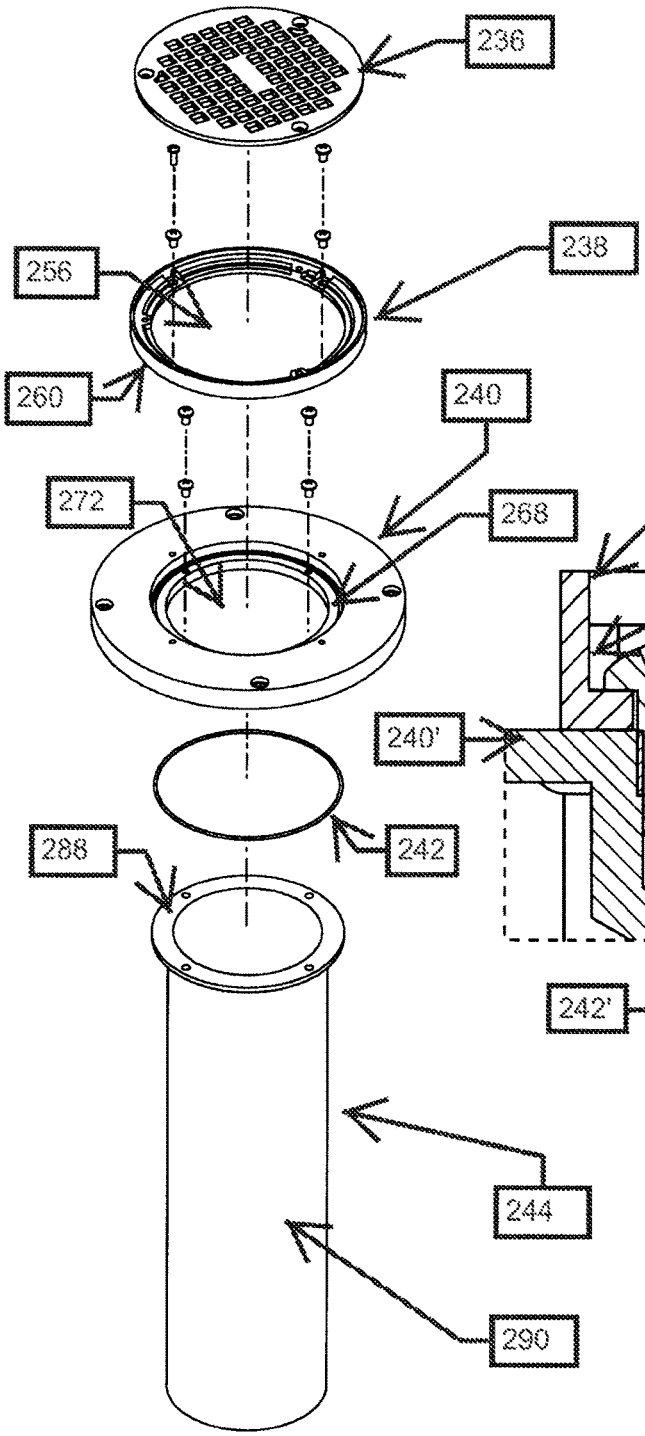

FIGS. 14C and 15C illustrate a third embodiment of a drain 120*c* including a grate 136*c*, a frame 138*c*, the drain body 140, the second outlet 144', the third outlet 144" and the fourth outlet 144''''. The illustrated grate 136*c* and the illustrated frame 138*c* are square and only a portion of the corners extend from a perimeter of the drain body 140. The grate 136*c* has a slightly smaller width than the frame 138*c*. The frame 138*c* includes a raised lip 160*c* around the perimeter and is recessed to receive the grate 136*c*. A plurality of fasteners retain the grate 136*c* in the frame 138*c*. The top of the grate 136*c* and the top of the raised lip 160*c* form a planar upper surface of the drain 120*c*. The frame 138*c* defines a circular opening 156*c* to permit fluid flow therethrough.

The same drain body 140 is used and any one of the first outlet 144, the second outlet 144', the third outlet 144" and the fourth outlet 144''' can be used with the grate 136*c* and the frame 138*c*.

Figure 14D:
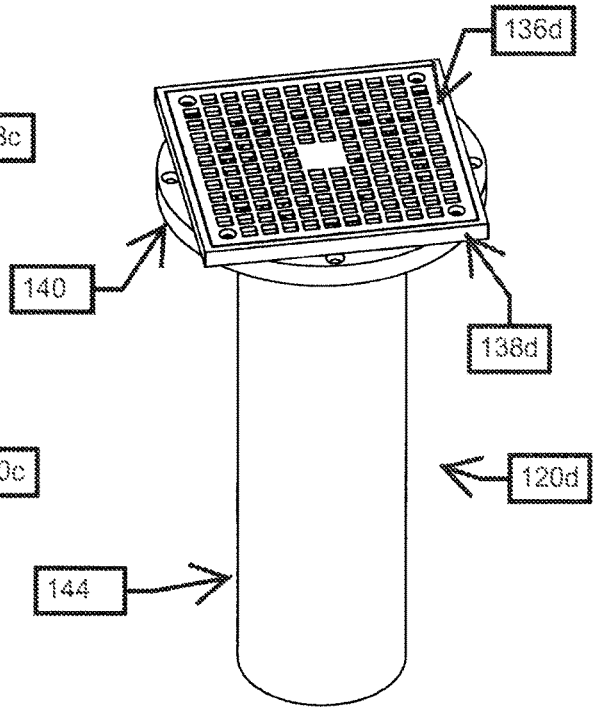

FIGS. 14D and 15D illustrate a fourth embodiment of a drain 120*d* including a grate 136*d*, a frame 138*d*, the drain body 140 and the fourth outlet 144'''. The illustrated grate 136*d* and the illustrated frame 138*d* are square and a portion of the corners extend from a perimeter of the drain body 140. The grate 136*d* has a slightly smaller width than the frame 138*d*. The frame 138*d* includes a raised lip 160*d* around the perimeter and is recessed to receive the grate 136*d*. A plurality of fasteners retain the grate 136*d* in the frame 138*d*. The top of the grate 136*d* and the top of the raised lip 160*d* form a planar upper surface of the drain 120*d*. The frame 138*d* defines a circular opening 156*d* to permit fluid flow therethrough.

The grate 136*d* has a larger width than the grate 136*c* and the frame 138*d* has a larger width than the grate 138*c*. In some embodiments, the width of the grate 136*c* can be around five inches and the width of the grate 136*d* can be around six inches.

The grates 136*a*, 136*b*, 136*c*, 136*d* and the frames 138*a*, 138*b*, 138*c*, 138*d* can be utilized with any of the embodiments disclosed herein. Additionally, any one of the first outlet 144, the second outlet 144', the third outlet 144" and the fourth outlet 144''' can be utilized with any of the embodiments disclosed herein.

FIGS. 16A-D illustrate another embodiment of a drain 220 including a grate 236, a frame 238, a drain body 240, a seal 242 and an outlet 244. The illustrated grate 236 and the illustrated frame 238 are circular and have a smaller diameter than the drain body 240. The grate 236 has a slightly smaller diameter than the frame 238. The frame 238 includes a raised lip 260 around the perimeter and is recessed to receive the grate 236. A plurality of fasteners retain the grate 236 in the frame 238. The top of the grate 236 and the top of the raised lip 260 form a planar upper surface of the drain 220. The frame 238 defines a circular opening 256 to permit fluid flow therethrough.

The drain body 240 is circular and includes a planar upper surface upon which the frame 238 can be fixed by fasteners. The frame includes a circular opening 272 that is generally aligned with the circular opening 256 in the frame 238. The circular opening includes a recessed portion 268.

While the outlet 244 corresponds to the first outlet 144, the second outlet 144', the third outlet 144" and the fourth outlet 144''' can be utilized in other embodiments. The outlet 244 includes a flange 288 and an elongate conduit 290. The flange 288 rests on the recessed portion 268 of the drain body 240 when installed. The flange 288 includes apertures configured to receive fasteners to connect the outlet 244 to the drain body 240. The seal 242 is positioned in a cutout of the recessed portion 268 and a lower surface of the flange 288 compresses the seal 242 against the recessed portion 268.

Figure 16E:
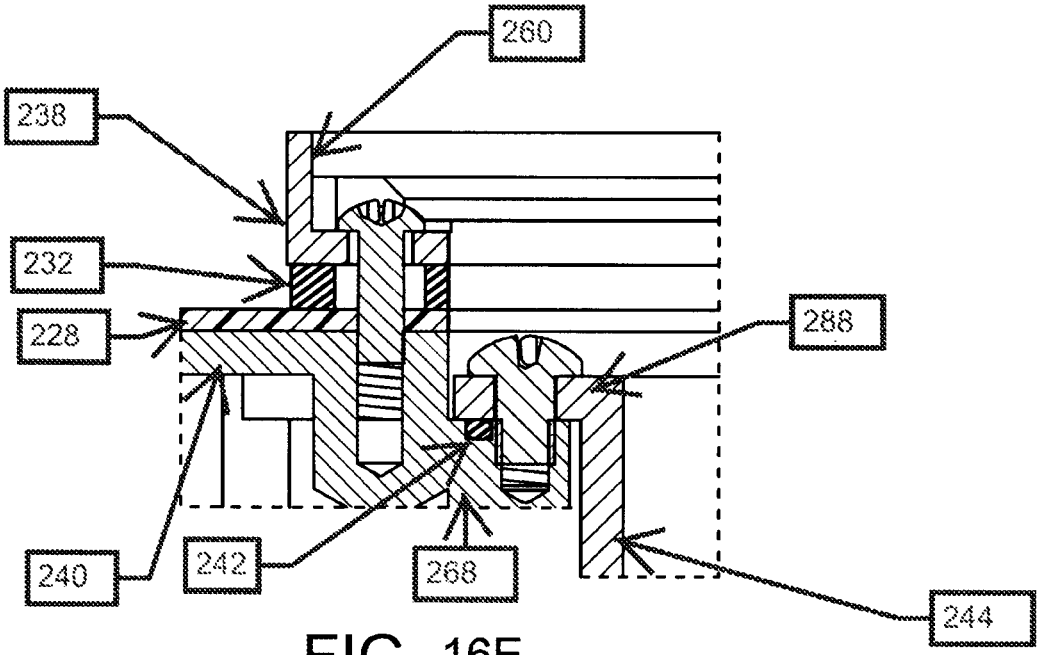
Figure 18A:
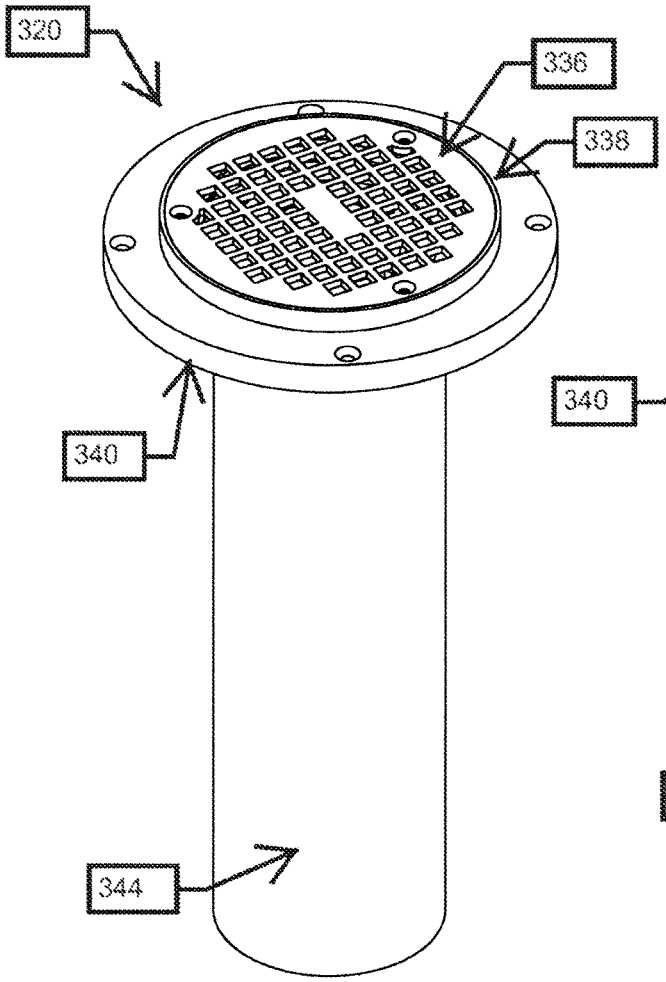
FIGS. 18A-D are various views of one possible drain embodiment.
Figure 18B:
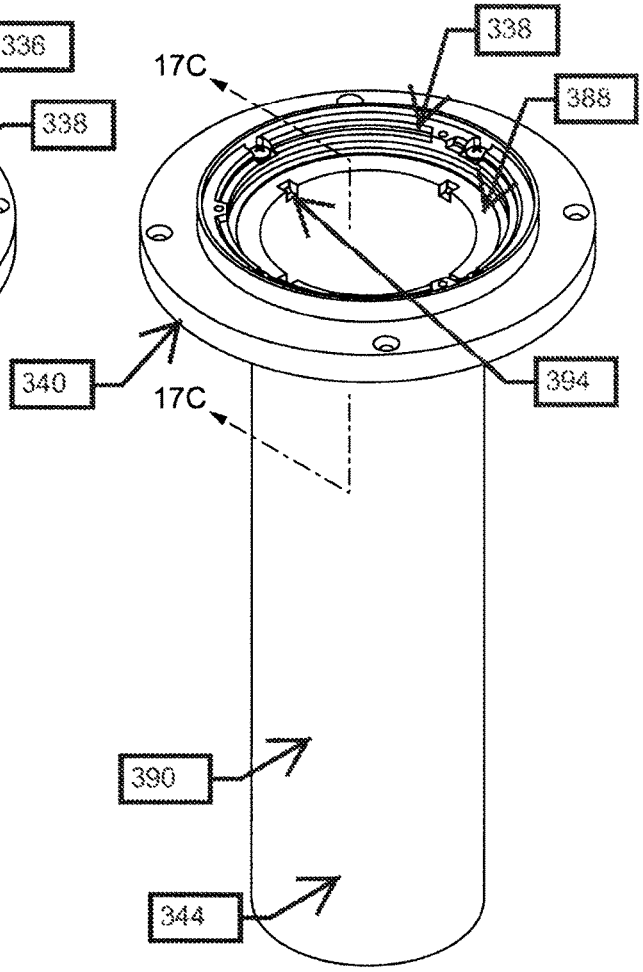
Figure 18C:
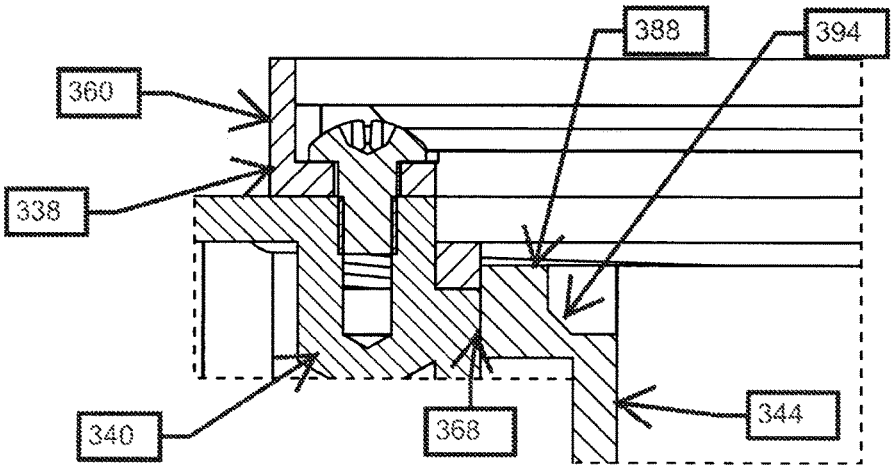
Figure 18D:
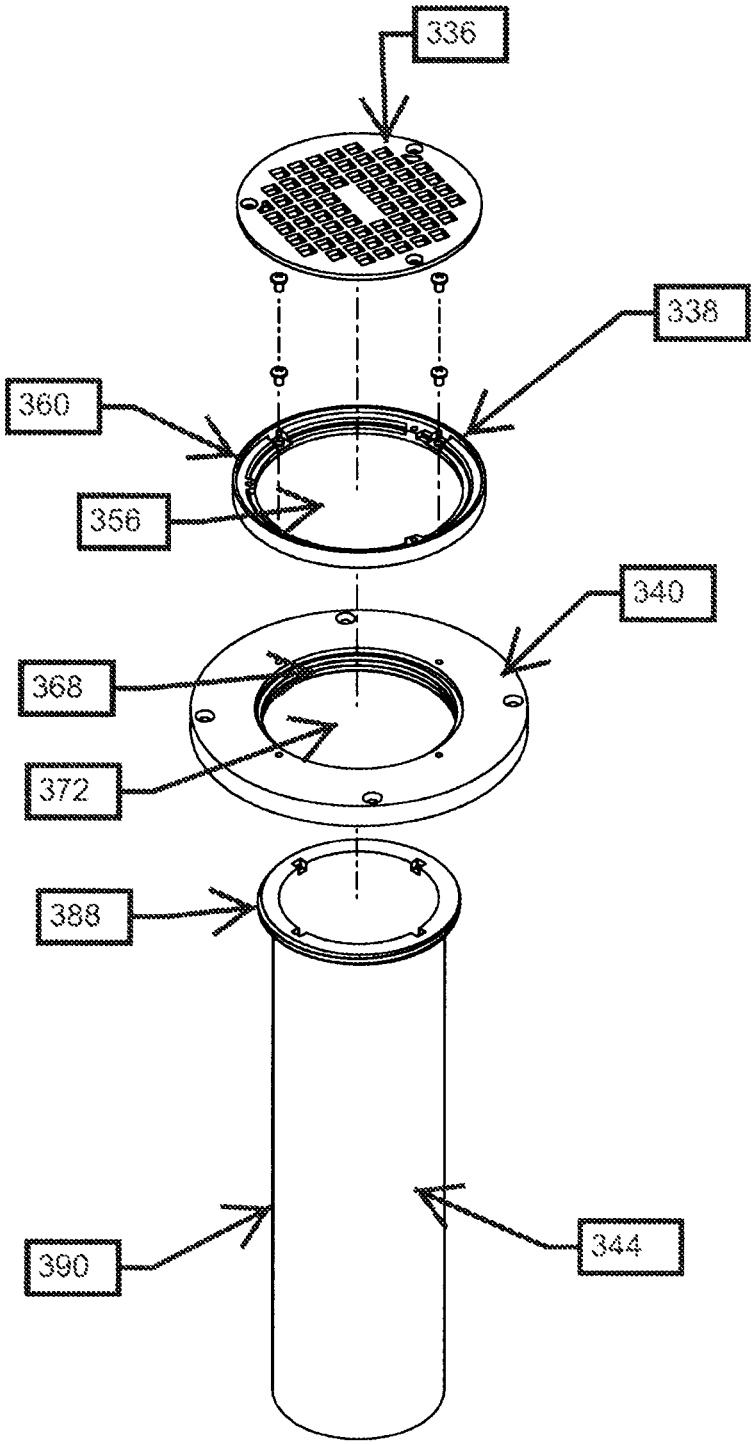
Figure 19A:
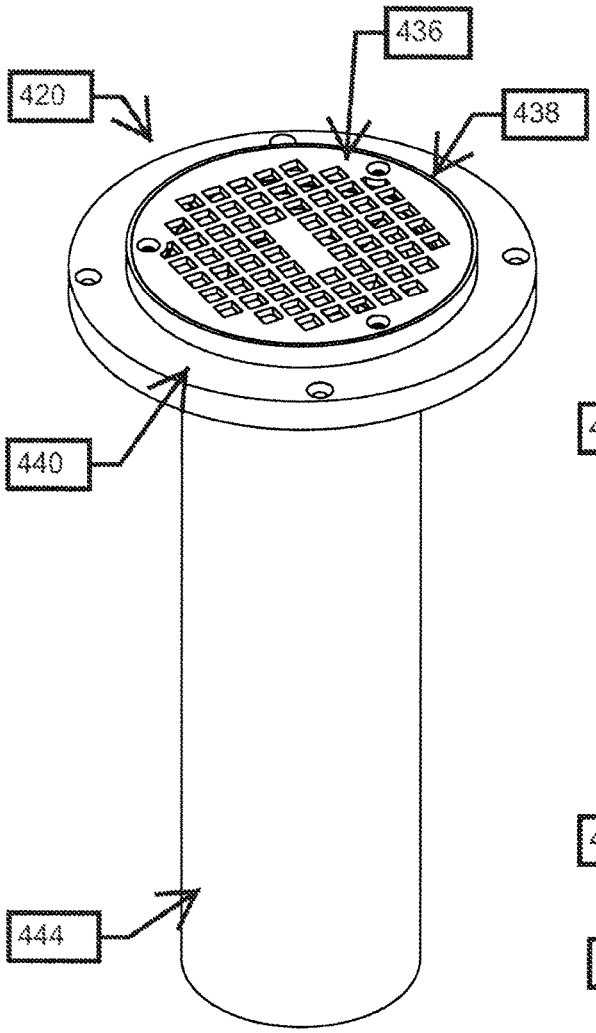
FIGS. 19A-D are various views of one possible drain embodiment.
Figure 19B:
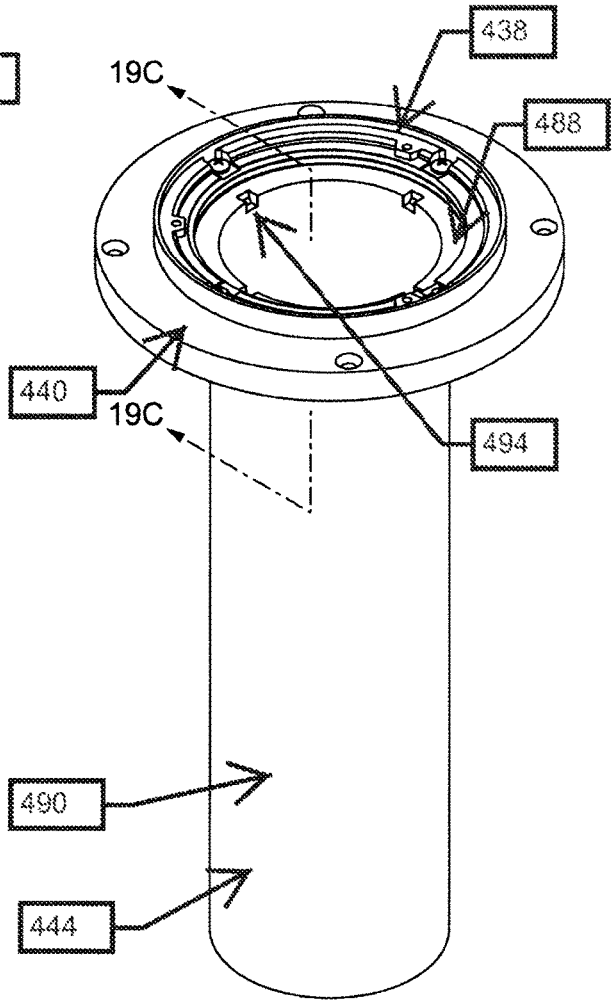
Figure 19C:
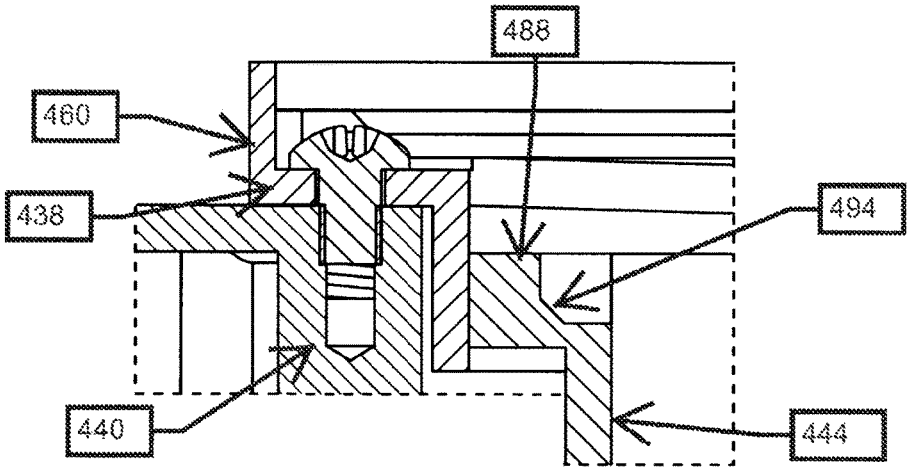
Figure 19D:
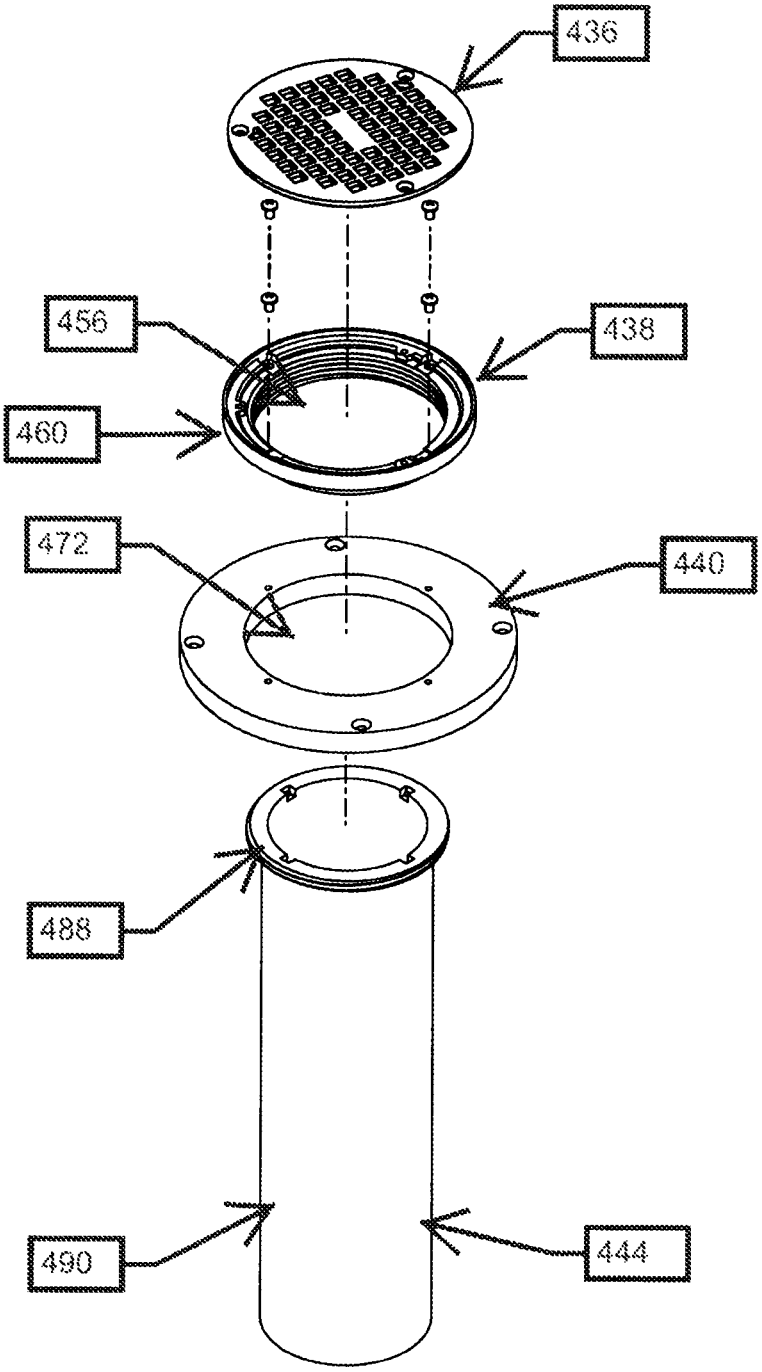
Figure 20A:
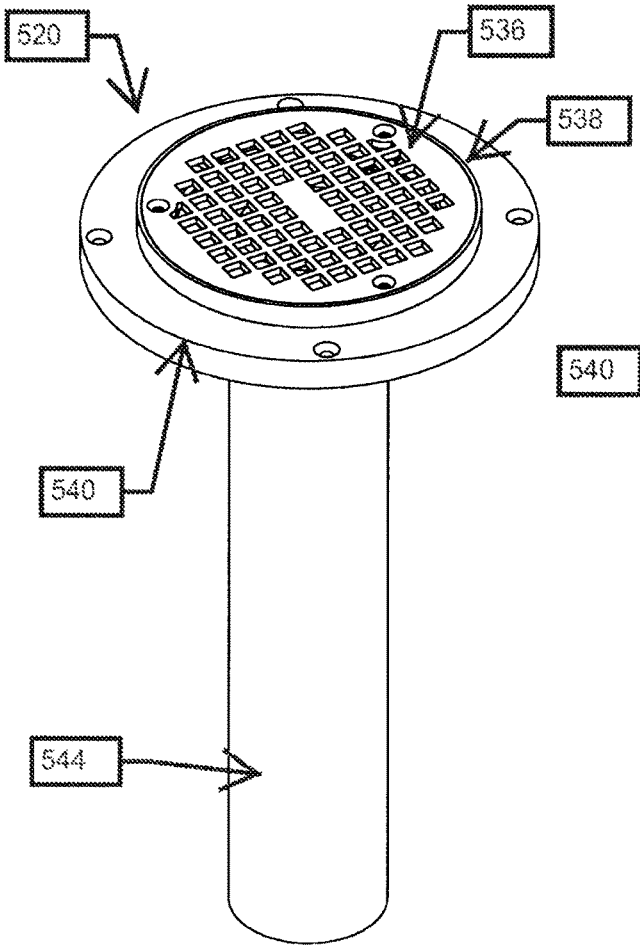
FIGS. 20A-D are various views of one possible drain embodiment.
Figure 20B:
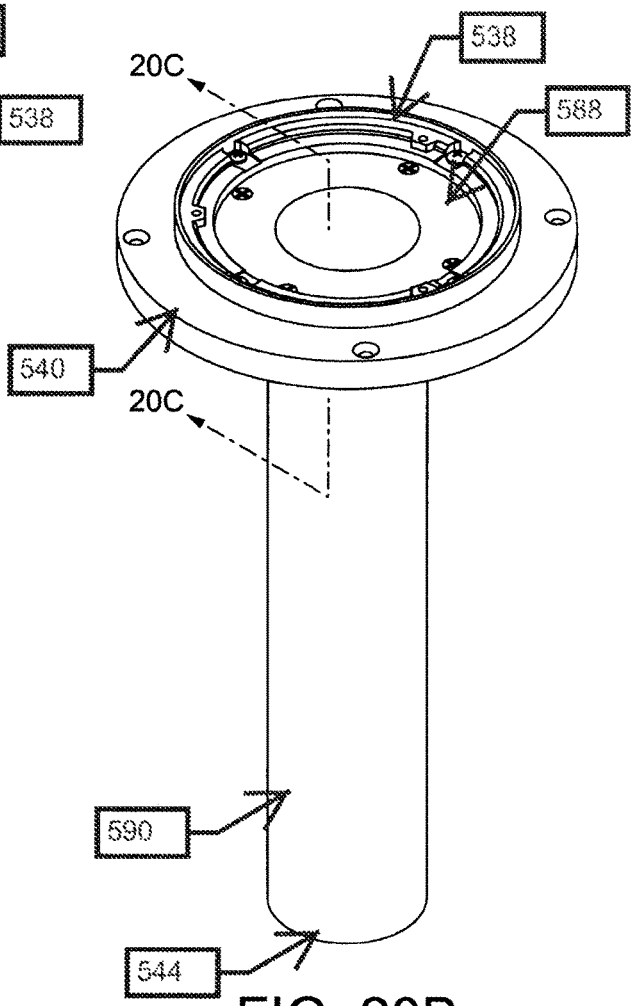
Figure 20C:
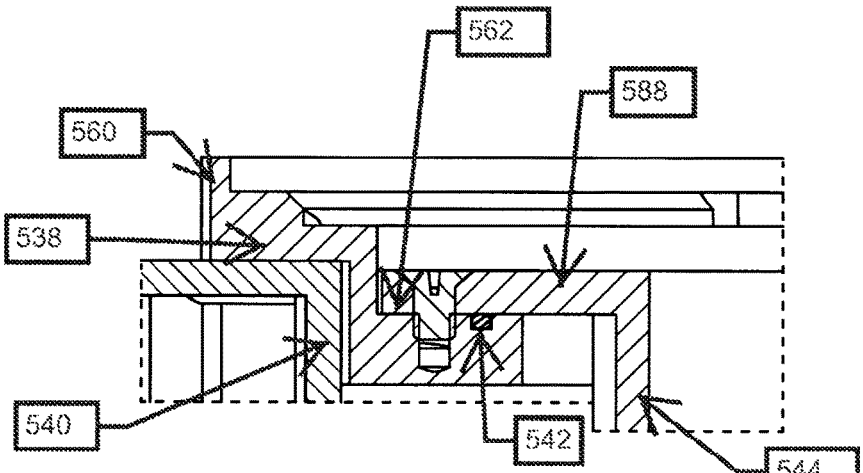
Figure 20D:
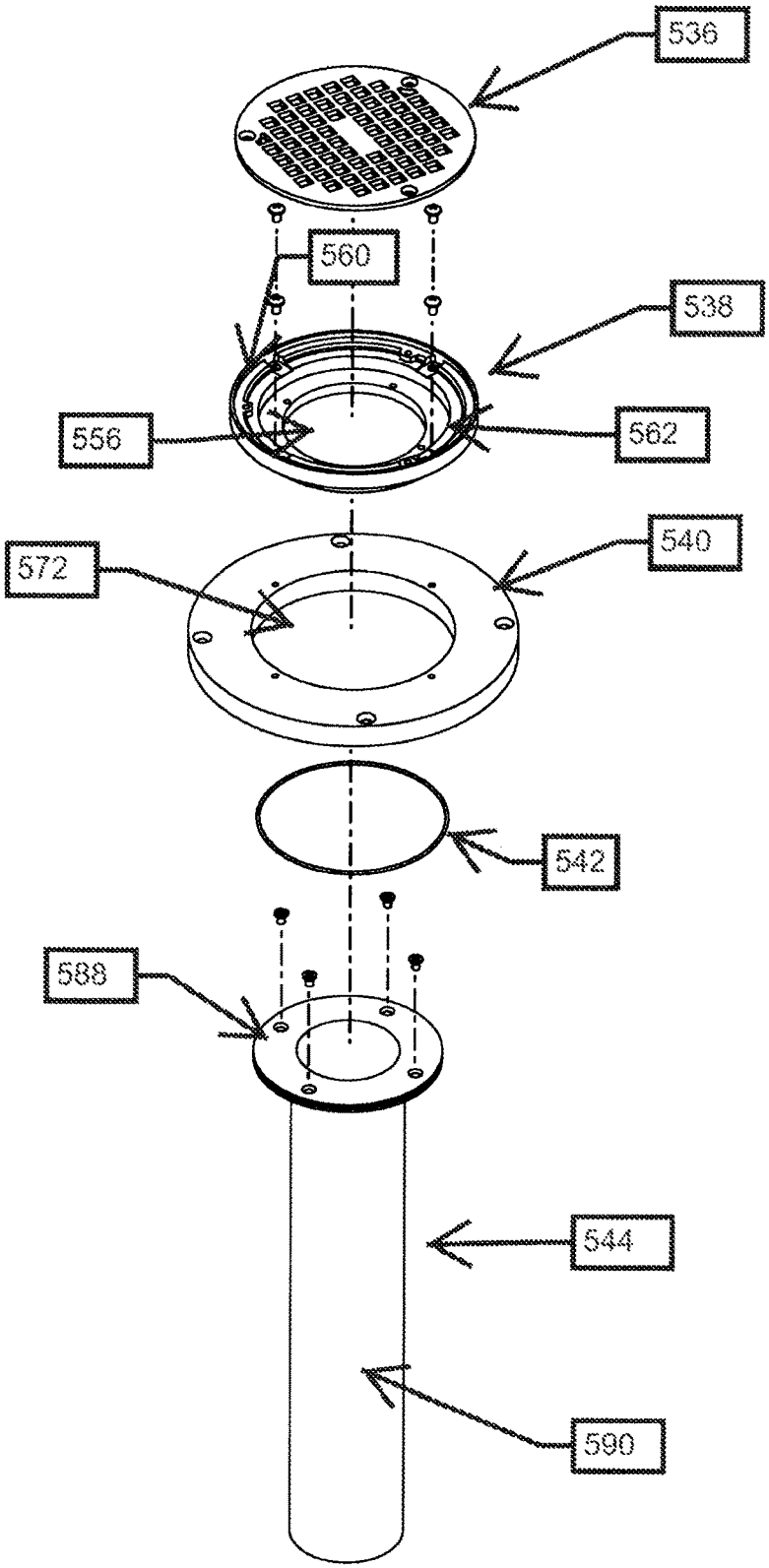

FIG. 16E illustrates the drain 220 including a shim 232 and a membrane 228 positioned between the bottom of the frame 238 and the top of the drain body 240. Other sizes or quantities of shims 232 can be added as needed. In some embodiments, the membrane 228 is utilized without the shim 232.

Figure 17:
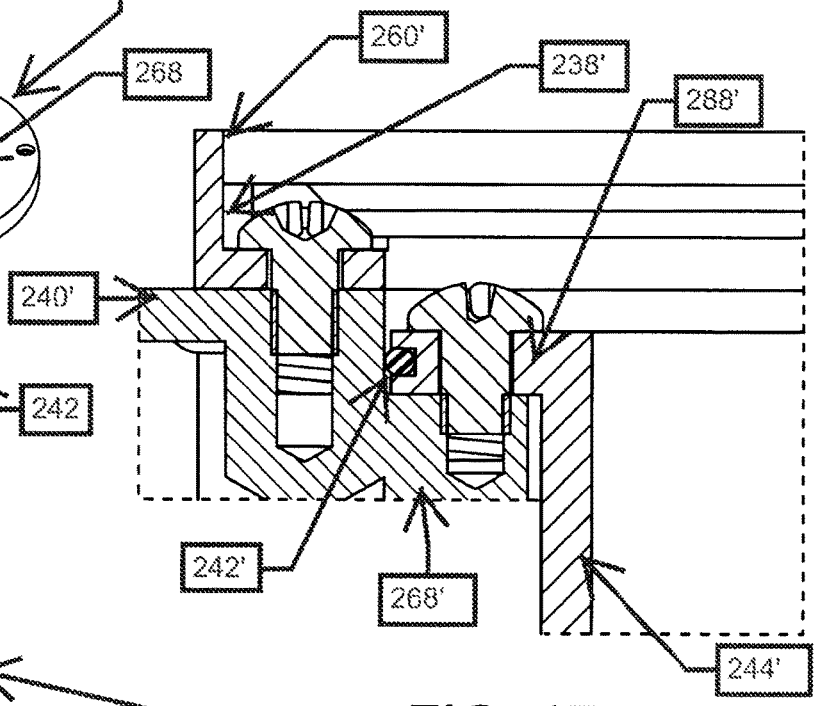
FIG. 17 is a cross-sectional view taken along line 16C of FIG. 16B showing an alternate embodiment.

FIG. 17 illustrates an alternate embodiment of a frame 238' having a flange 260', a drain body 240' having a recessed portion 268', a seal 242', an outlet 244' having a flange 288'. The seal 242' is inserted into a cutout on an outer perimeter of the flange 288' and is pressed against an inner surface of the drain body 240'. Other seal locations are possible and are considered to be within the scope of the present disclosure. The embodiment of FIG. 17 can include one or more shims like the shim 232 and a membrane like the membrane 228 in FIG. 16E.

FIGS. 18A through 18D illustrate another embodiment of a drain 320 including a grate 336, a frame 338, a drain body 340 and an outlet 344. The illustrated grate 336 and the illustrated frame 338 are circular and have a smaller diameter than the drain body 340. The grate 336 has a slightly smaller diameter than the frame 338. The frame 338 includes a raised lip 360 around the perimeter and is recessed to receive the grate 336. The top of the grate 336 and the top of the raised lip 360 form a planar upper surface of the drain 320. The frame 338 defines a circular opening 356 to permit fluid flow therethrough.

The drain body 340 is circular and includes a planar upper surface upon which the frame 338 can rest. The frame includes a circular opening 372 that is generally aligned with the circular opening 356 in the frame 338. The circular opening includes a threaded inner surface 368. The embodiment of FIGS. 18A-D can include one or more shims like the shim 232 and a membrane like the membrane 228 in FIG. 16E.

While the outlet 344 corresponds to the third outlet 144", the first outlet 144, the second outlet 144' and the fourth outlet 144'" can be utilized in other embodiments. The outlet 344 includes a flange 388 and an elongate conduit 390. An outer surface of the flange 388 is threaded and threadedly engages the threaded inner surface 368 of the drain body 340 when installed. The flange 388 defines a plurality of recesses 394 that are configured to receive a tool to rotate the outlet 344 such that the threaded outer surface of the flange 388 engages the threaded inner surface 368 of the drain body 340.

FIGS. 19A through 19D illustrate another embodiment of a drain 420 including a grate 436, a frame 438, a drain body 440 and an outlet 444. The illustrated grate 436 and the illustrated frame 438 are circular and have a smaller diameter than the drain body 440. The grate 436 has a slightly smaller diameter than the frame 438. The frame 438 includes a raised lip 460 around the perimeter and is recessed to receive the grate 436. The top of the grate 436 and the top of the raised lip 460 form a planar upper surface of the drain 420. The frame 438 defines a circular opening 456 to permit fluid flow therethrough. The inner surface of the frame 438 forming the circular opening 456 is a threaded inner surface.

The drain body 440 is circular and includes a planar upper surface upon which the frame 438 rests. The frame includes a circular opening 472 that is generally aligned with the circular opening 456 in the frame 438.

While the outlet 444 corresponds to the third outlet 144", the first outlet 144, the second outlet 144' and the fourth outlet 144'" can be utilized in other embodiments. The outlet 444 includes a flange 488 and an elongate conduit 490. An outer surface of the flange 488 is threaded and threadedly engages the threaded inner surface of the frame 438 when installed. The flange 488 defines a plurality of recesses 494 that are configured to receive a tool to rotate the outlet 444 such that the threaded outer surface of the flange 488 engages the threaded inner surface of the frame 438.

FIGS. 20A-D illustrate another embodiment of a drain 520 including a grate 536, a frame 538, a drain body 540, a seal 542 and an outlet 544. The illustrated grate 536 and the illustrated frame 538 are circular and have a smaller diameter than the drain body 540. The grate 536 has a slightly smaller outer diameter than the frame 538. The frame 538 includes a raised lip 560 around the perimeter and is recessed to receive the grate 536. A plurality of fasteners retain the grate 536 in the frame 538. The top of the grate 536 and the top of the raised lip 560 form a planar upper surface of the drain 520. The frame 538 defines a circular opening 556 to permit fluid flow therethrough. The frame 538 defines a recessed surface 562 extending inward to define the circular opening 556.

The drain body 540 is circular and includes a planar upper surface upon which the frame 538 can be fixed by fasteners. The frame 538 includes a circular opening 572 that is generally aligned with the circular opening 556 in the frame 538.

While the outlet 544 corresponds to the second outlet 144', the fourth outlet 144'" can be utilized in other embodiments. The outlet 544 includes a flange 588 and an elongate conduit 590. The flange 588 rests on the recessed surface 562 of the frame 538 when installed. The flange 588 includes apertures configured to receive fasteners to connect the outlet 544 to the drain body 540. The seal 542 is positioned in a cutout of the recessed surface 562 and a lower surface of the flange 588 compresses the seal 542 against the recessed surface 562 of the frame 538.

Figure 21:
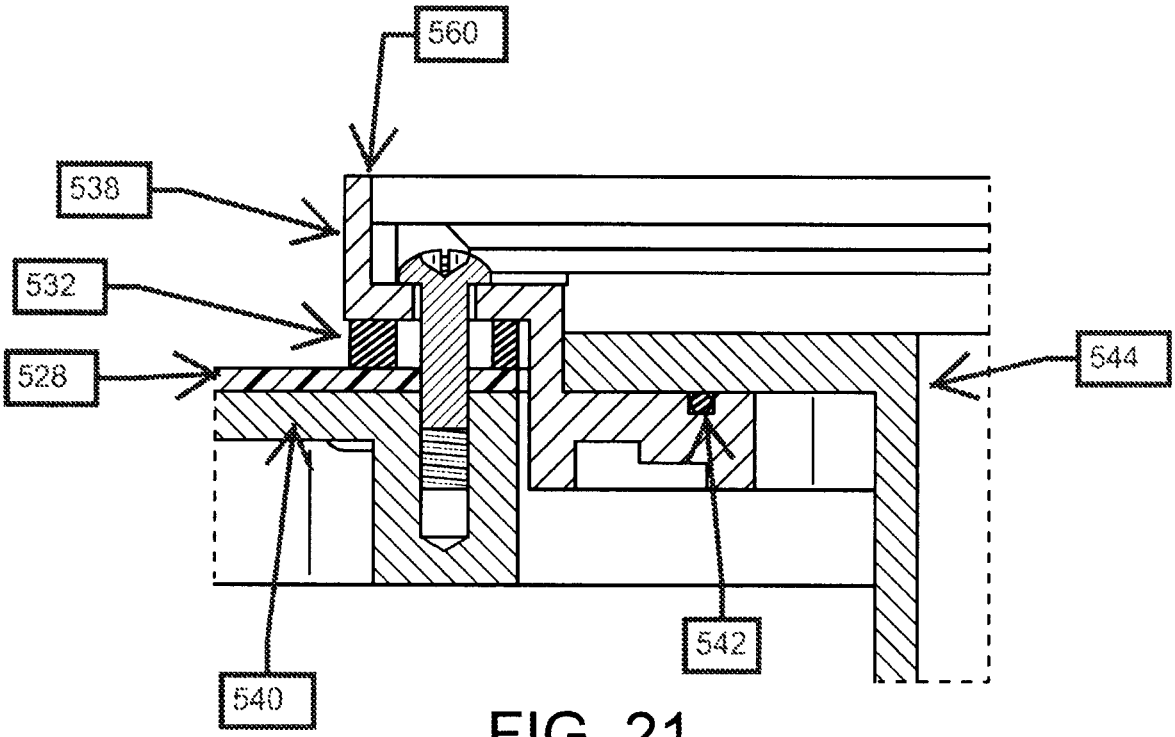
FIG. 21 is a cross-sectional view taken along line 20C of FIG. 20B showing an alternate embodiment.

FIG. 21 illustrates the drain 520 including a shim 532 and a membrane 528 positioned between the bottom of the frame 538 and the top of the drain body 540. Other sizes or quantities of shims 532 can be added as needed. In some embodiments, the membrane 528 is utilized without the shim 532. Because of the shape of the body 528, the shim 532 and the membrane 528 are not visible from the opening in the outlet 544.

Figure 22:
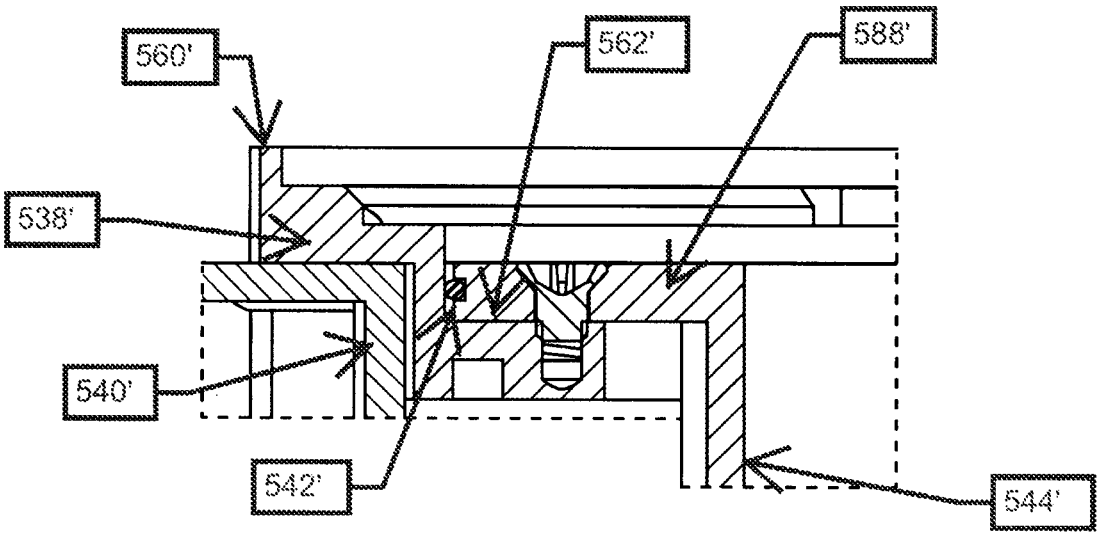
FIG. 22 is a cross-sectional view taken along line 20C of FIG. 20B showing an alternate embodiment.
Figure 23A:
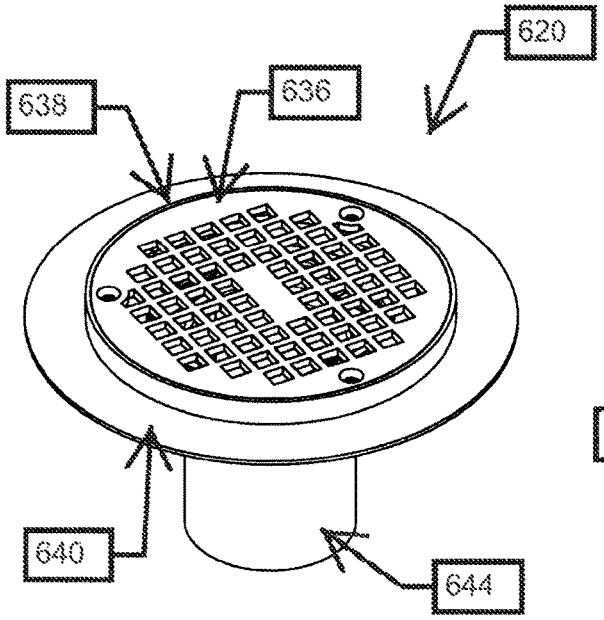
FIGS. 23A-E are various views of one possible drain embodiment.
Figure 23B:
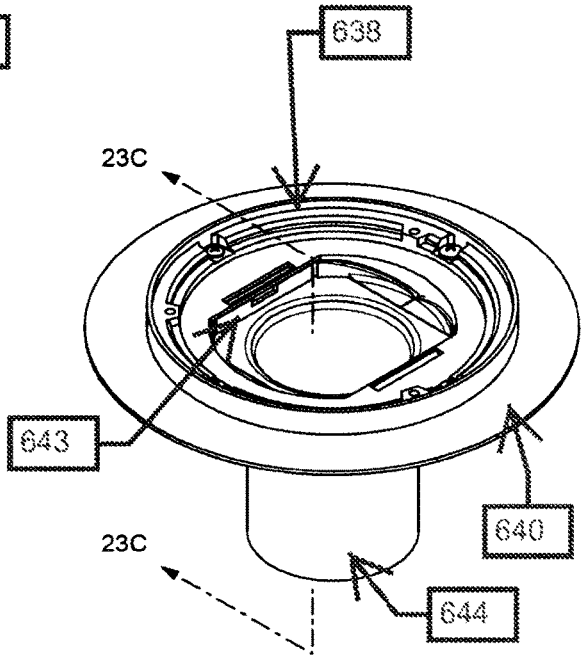
Figure 23C:
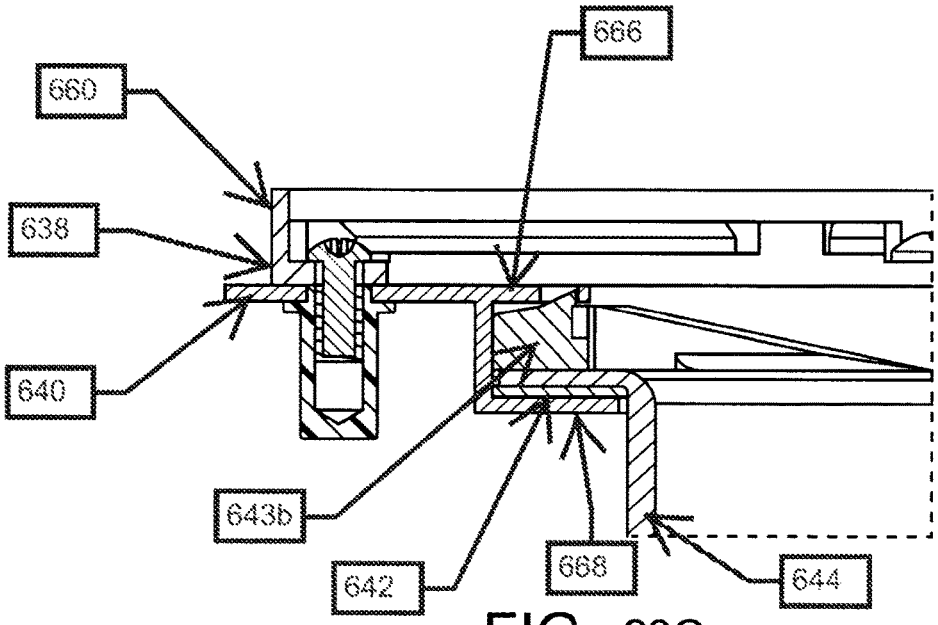
Figure 23D:
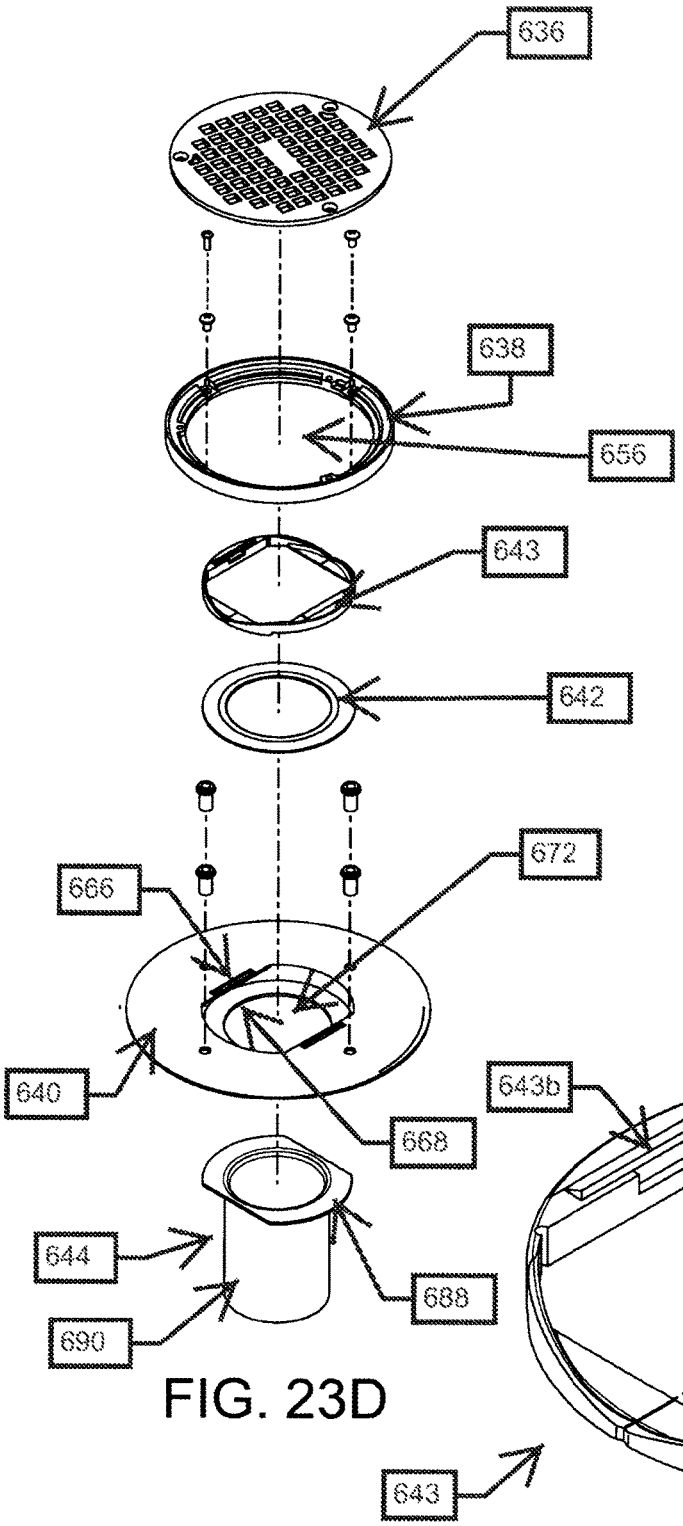
Figure 23E:
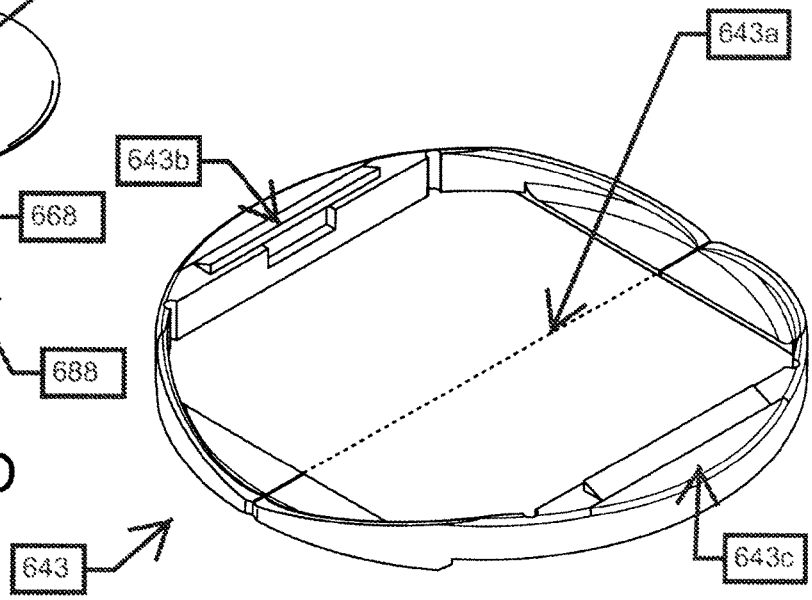
Figure 24A:
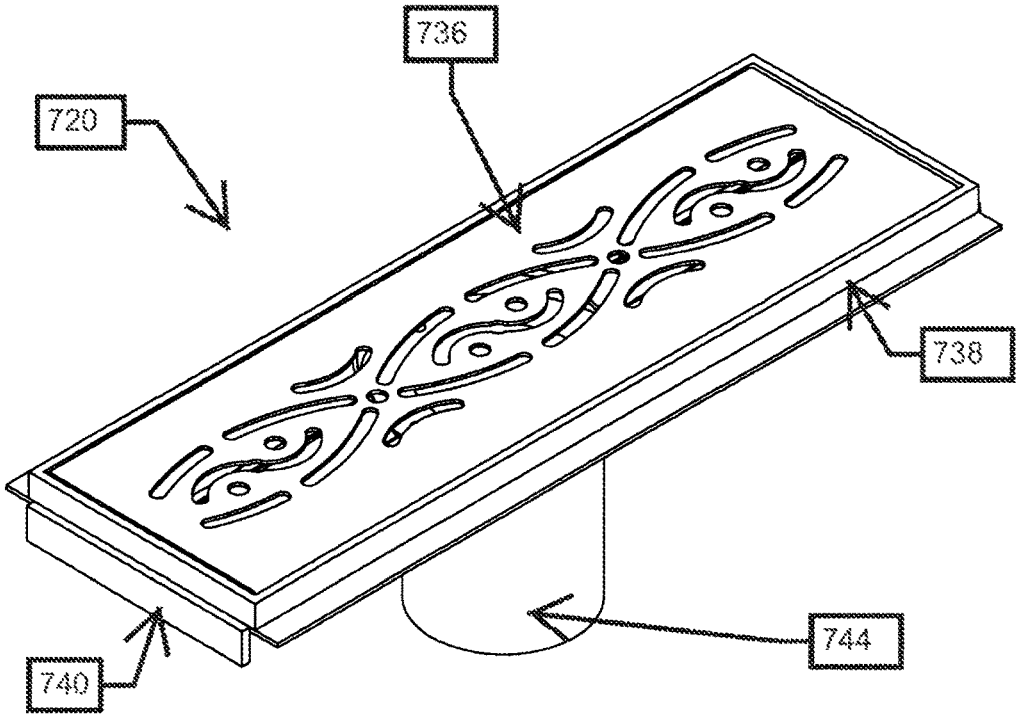
FIGS. 24A-E are various views of one possible drain embodiment.
Figure 24B:
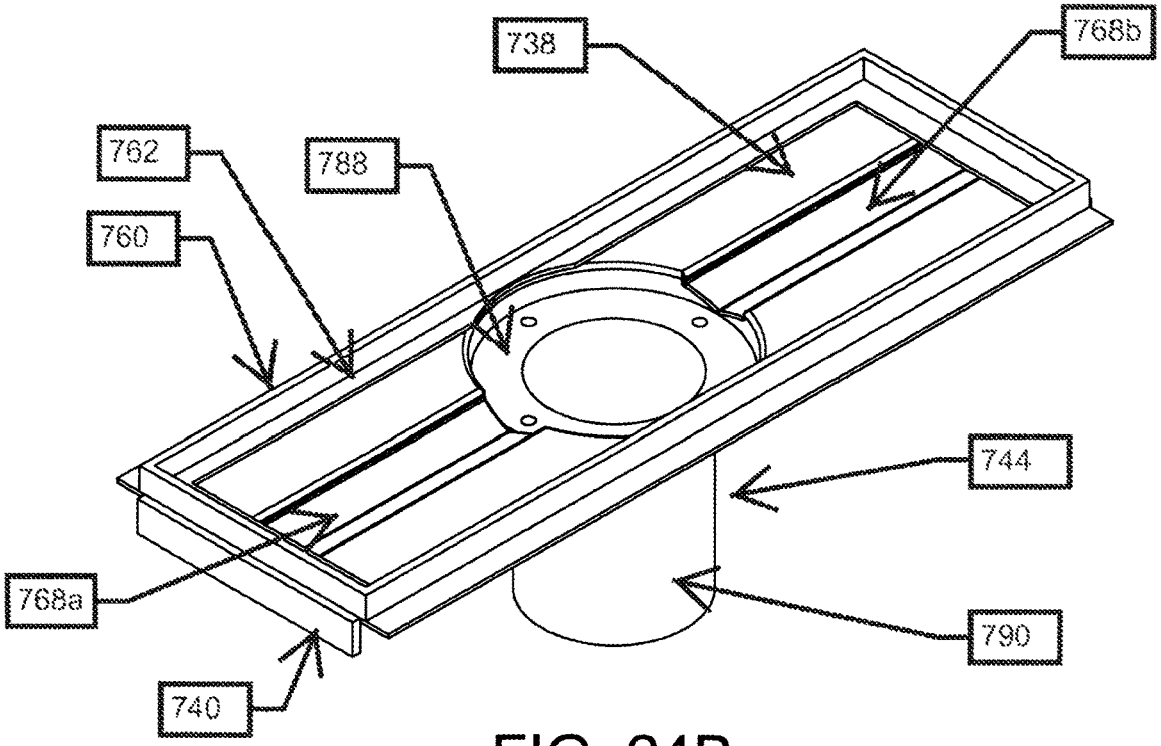
Figure 24C:
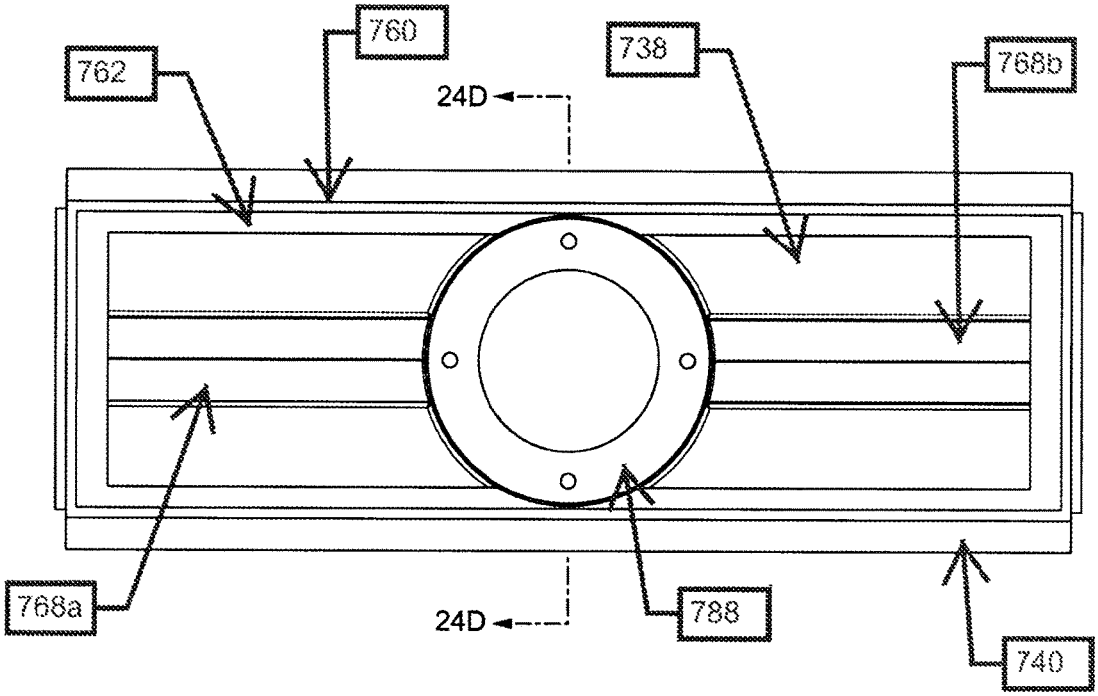
Figure 24D:
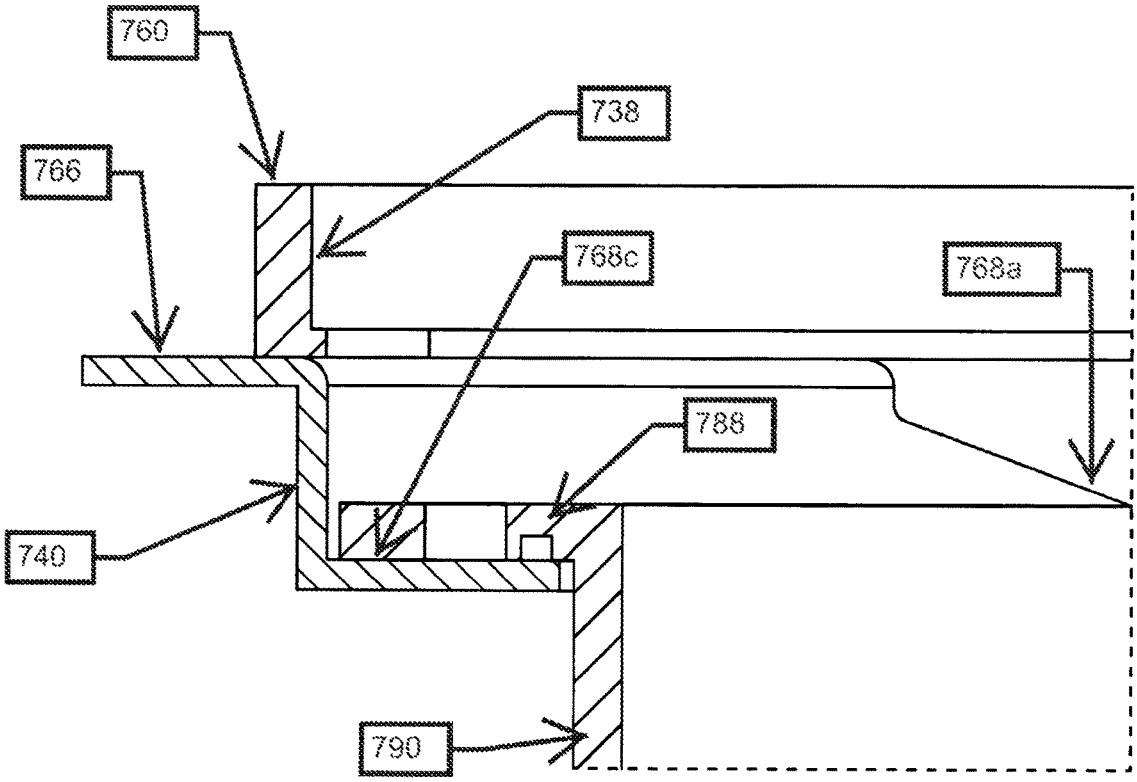
Figure 24E:
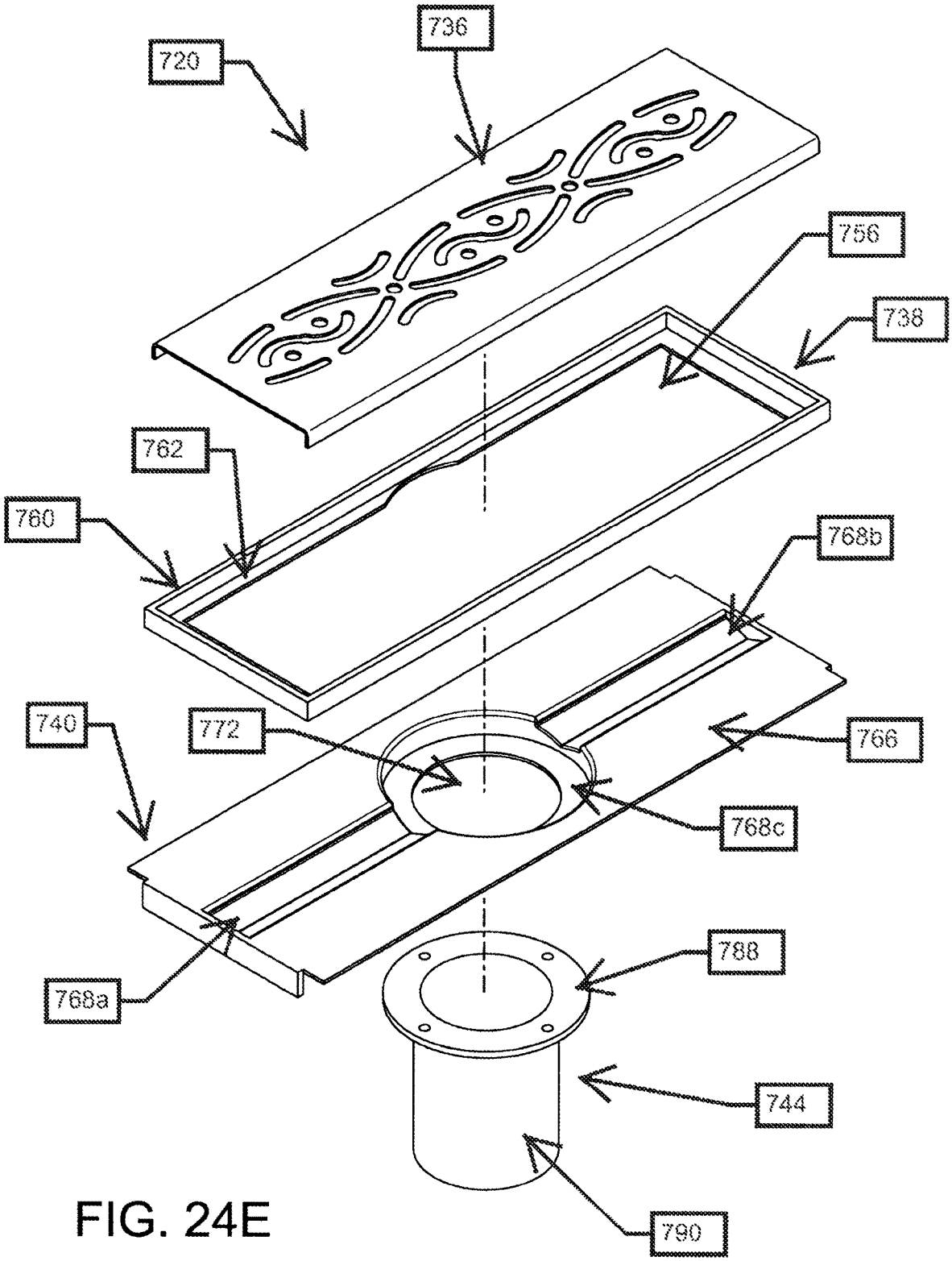
Figure 25A:
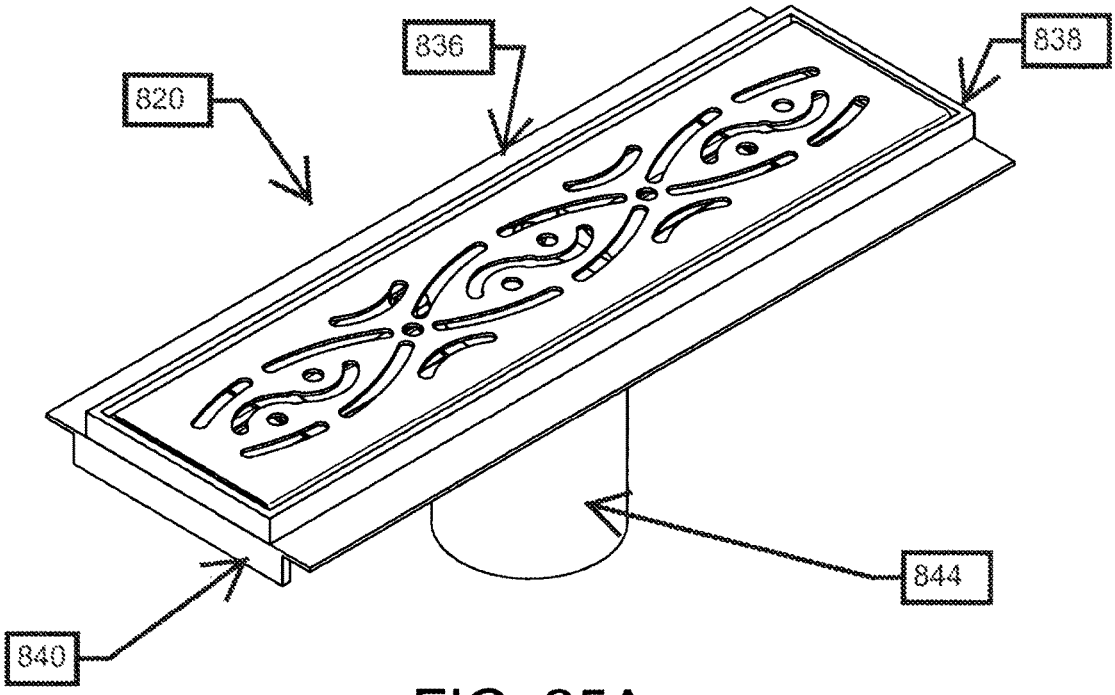
FIGS. 25A-E are various views of one possible drain embodiment.
Figure 25B:
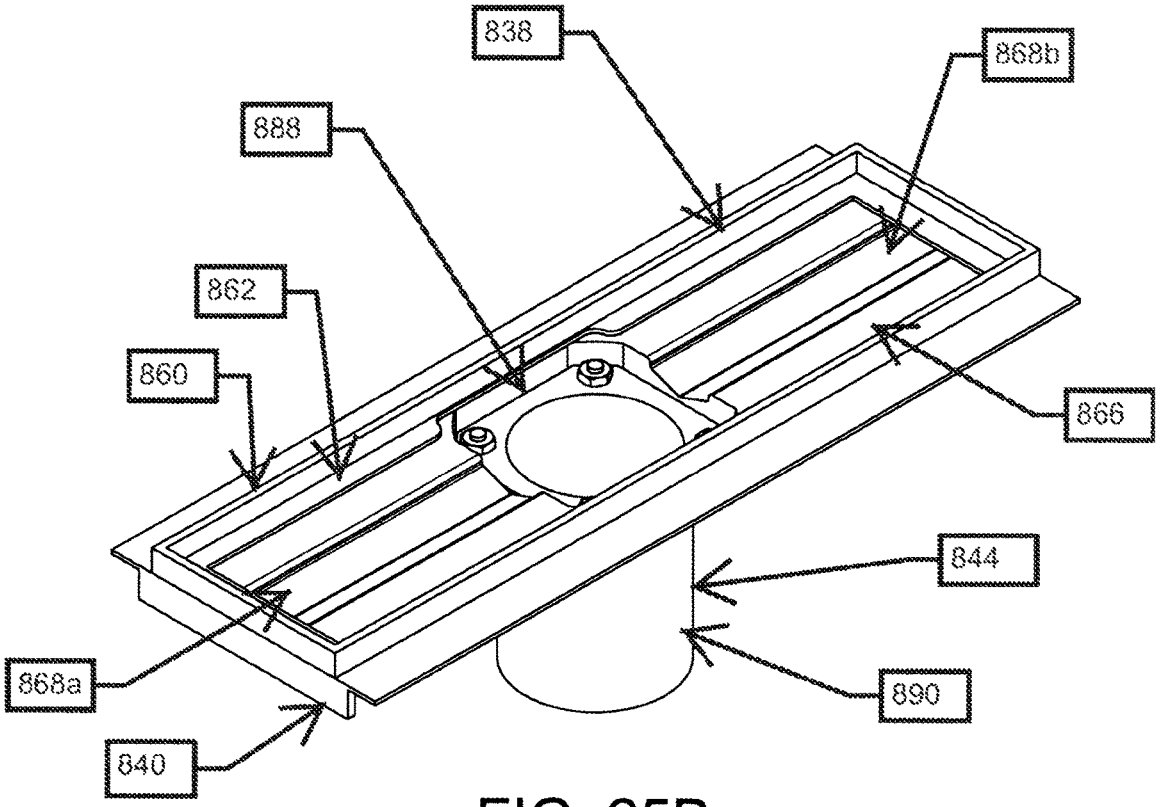
Figure 25C:
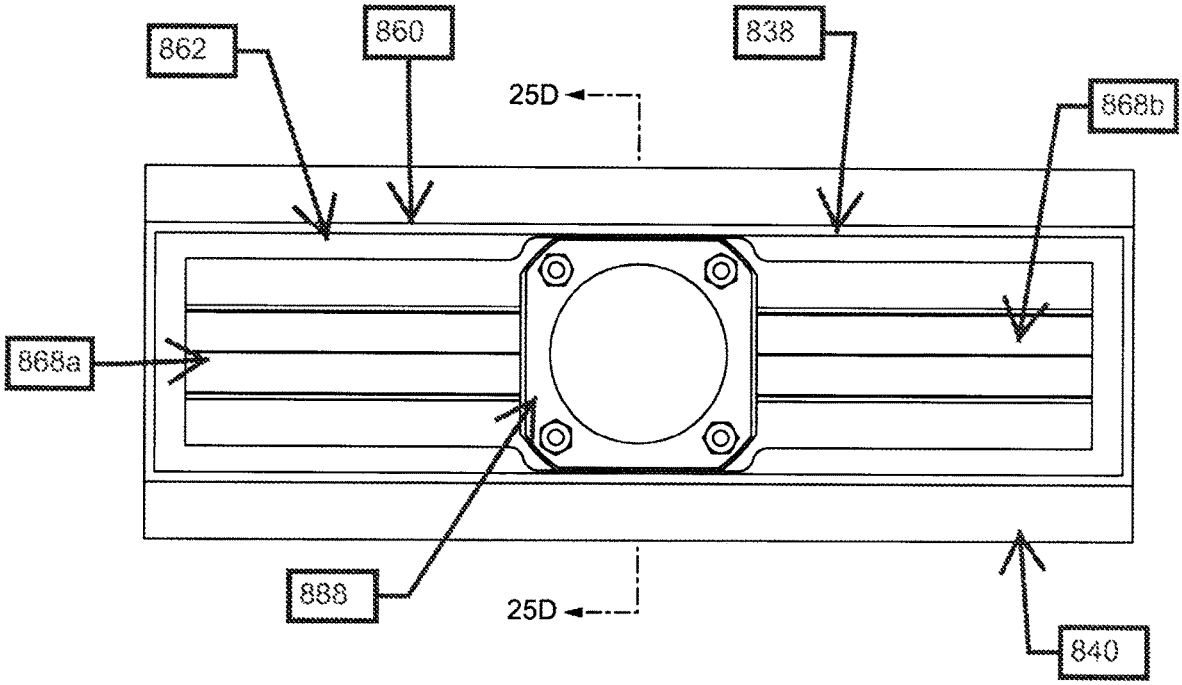
Figure 25D:
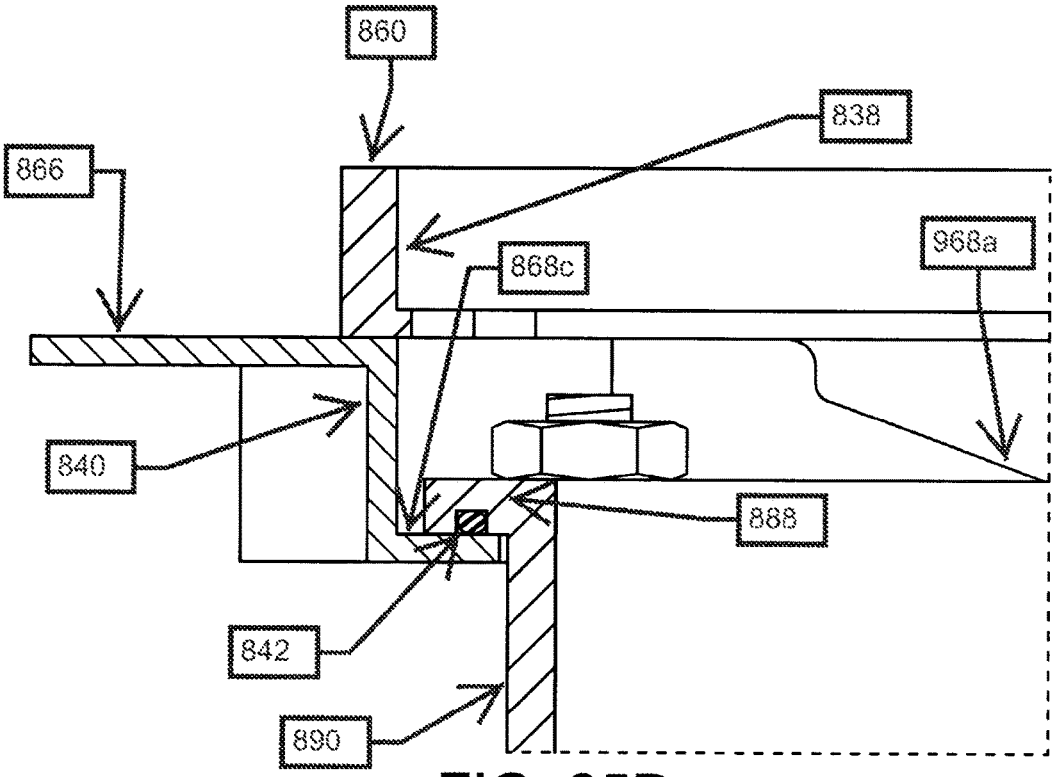
Figure 25E:
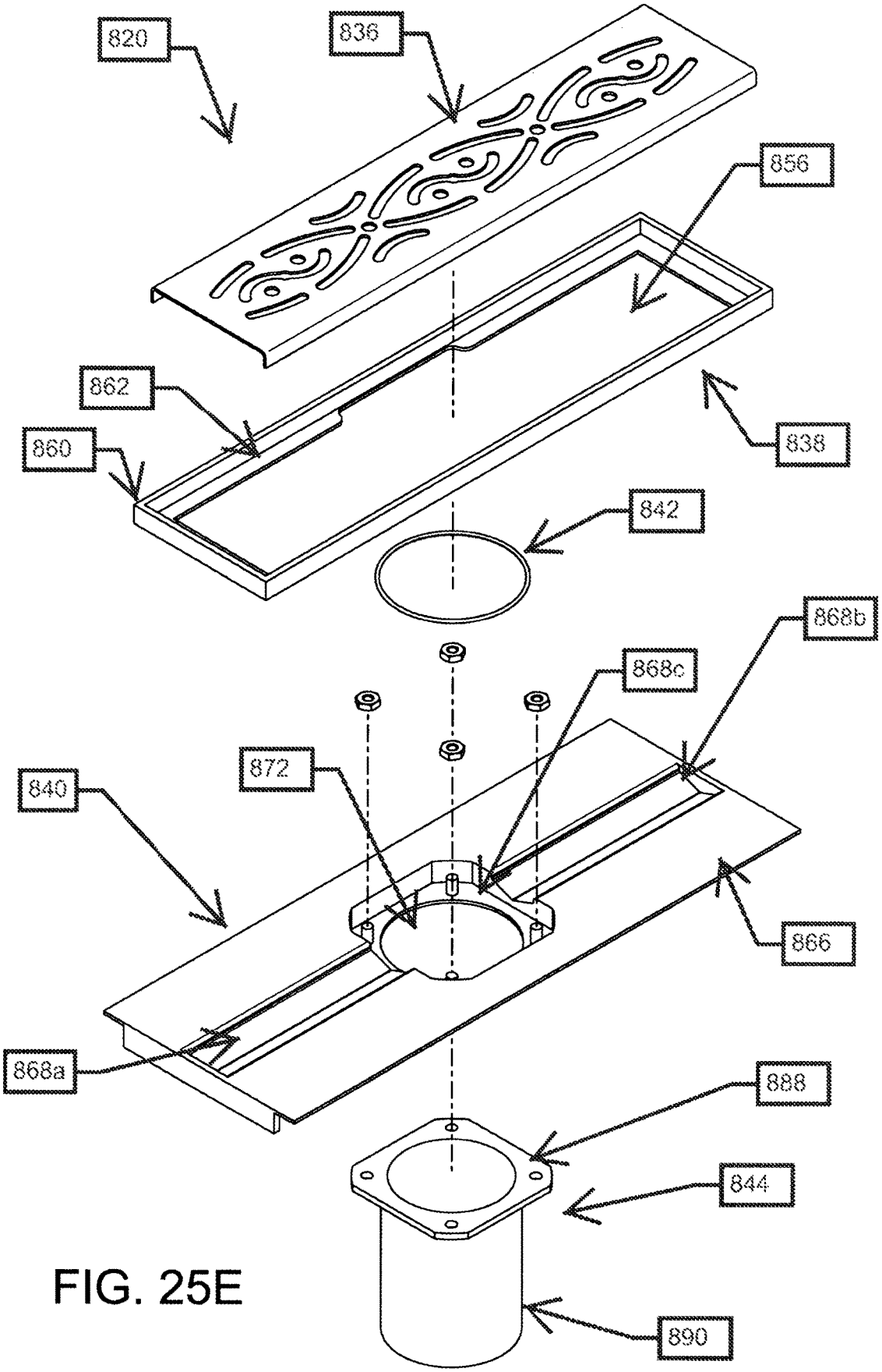
Figure 26A:
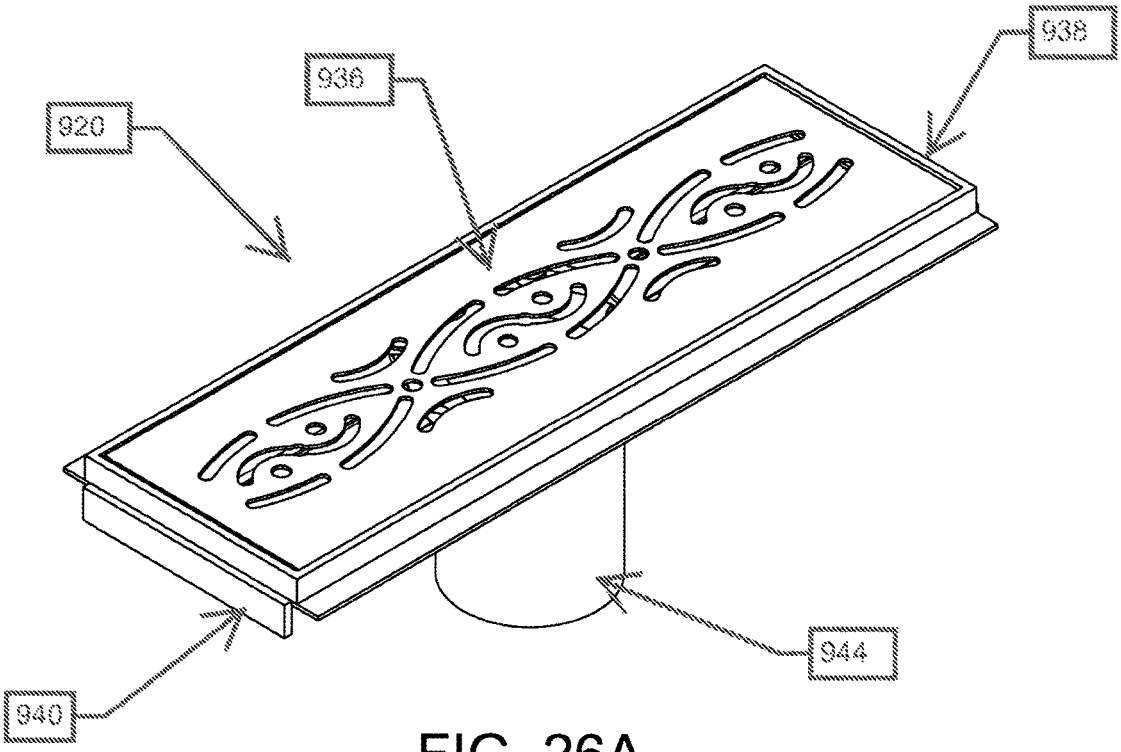
FIGS. 26A-E are various views of one possible drain embodiment.
Figure 26B:
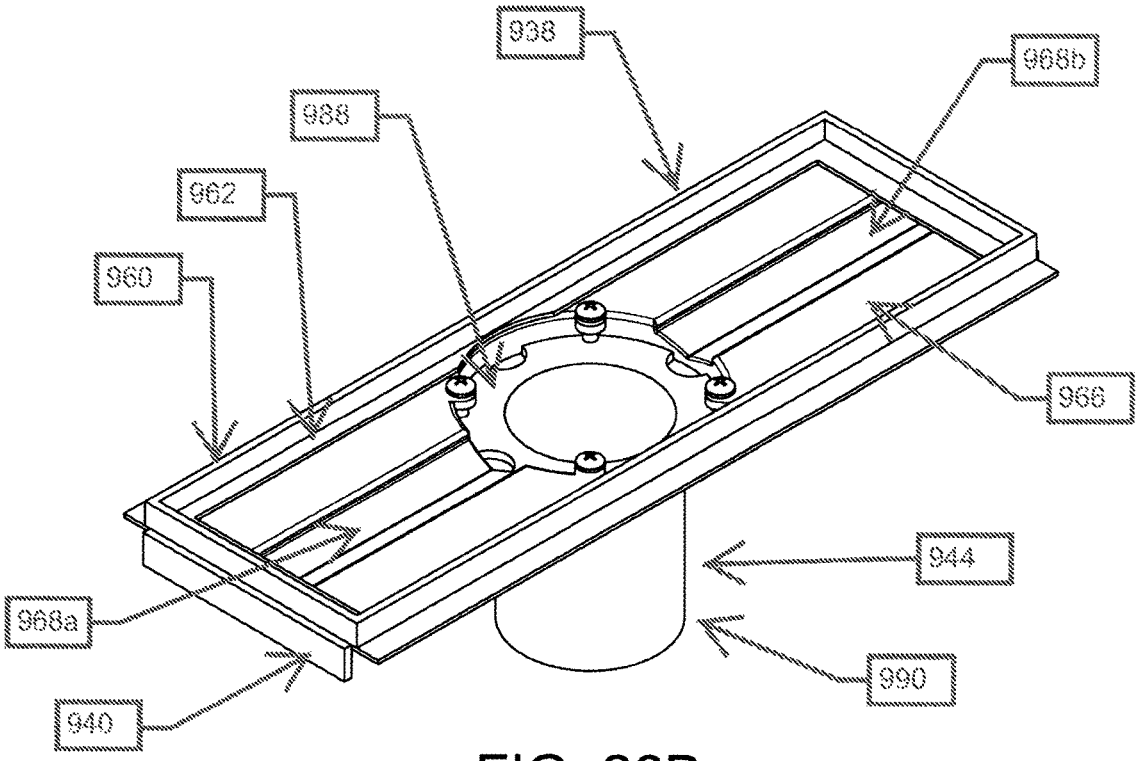
Figure 26C:
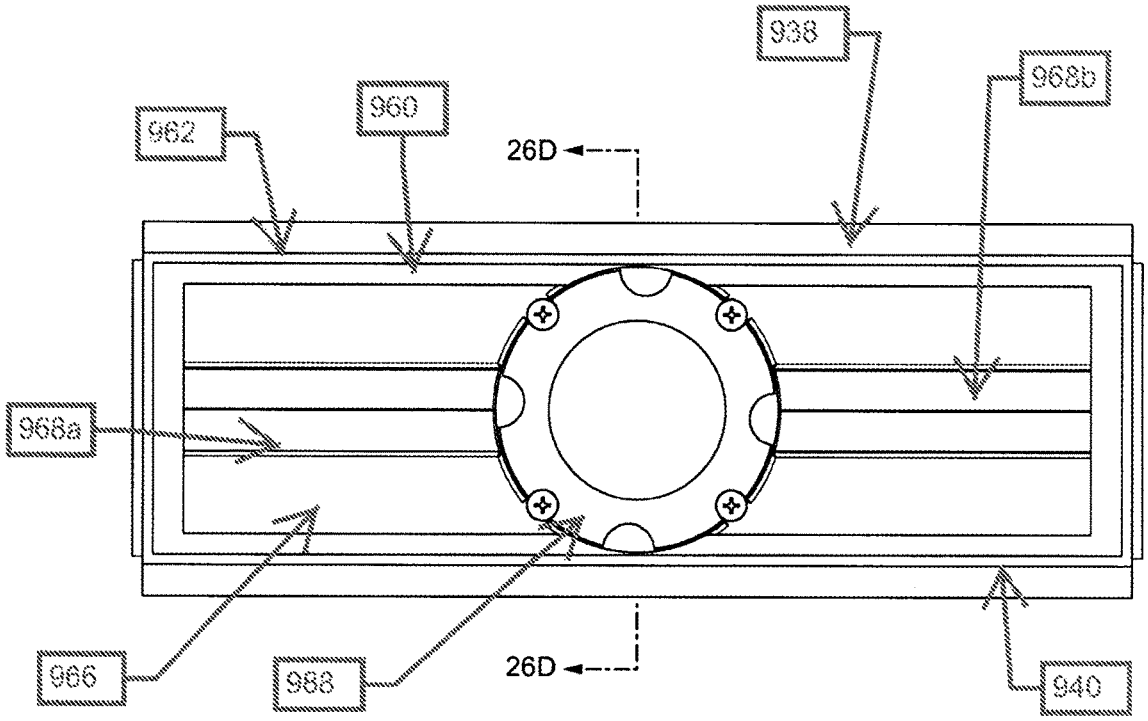
Figure 26D:
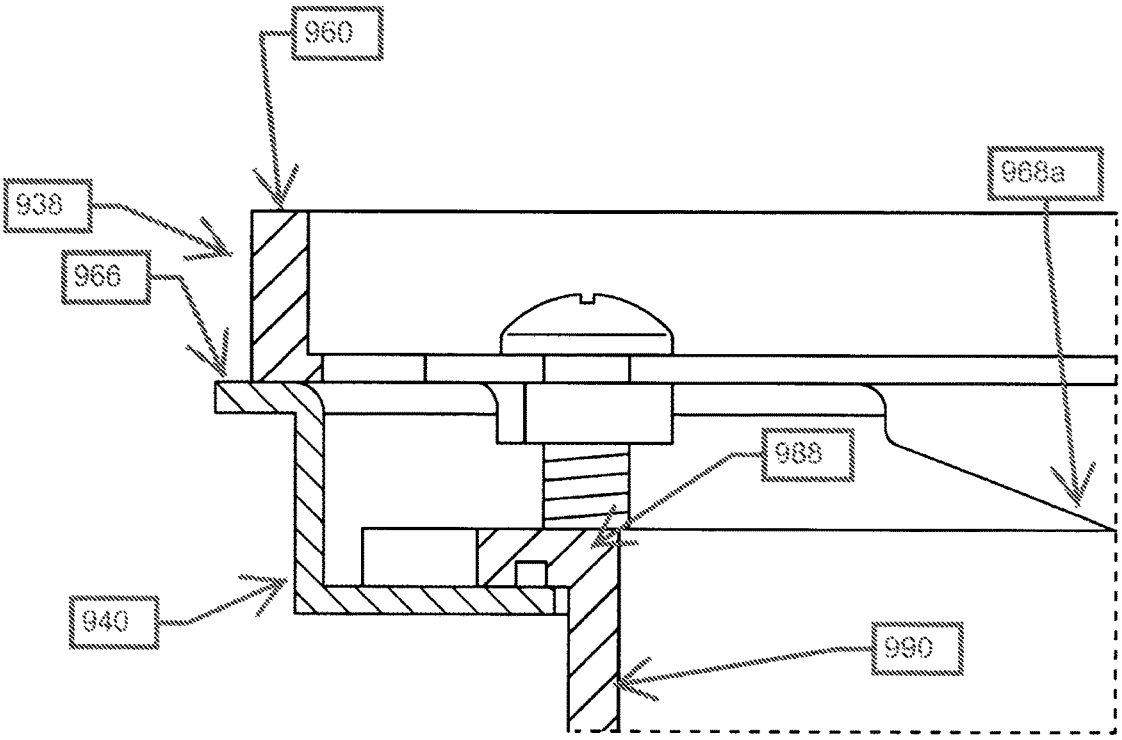
Figure 26E:
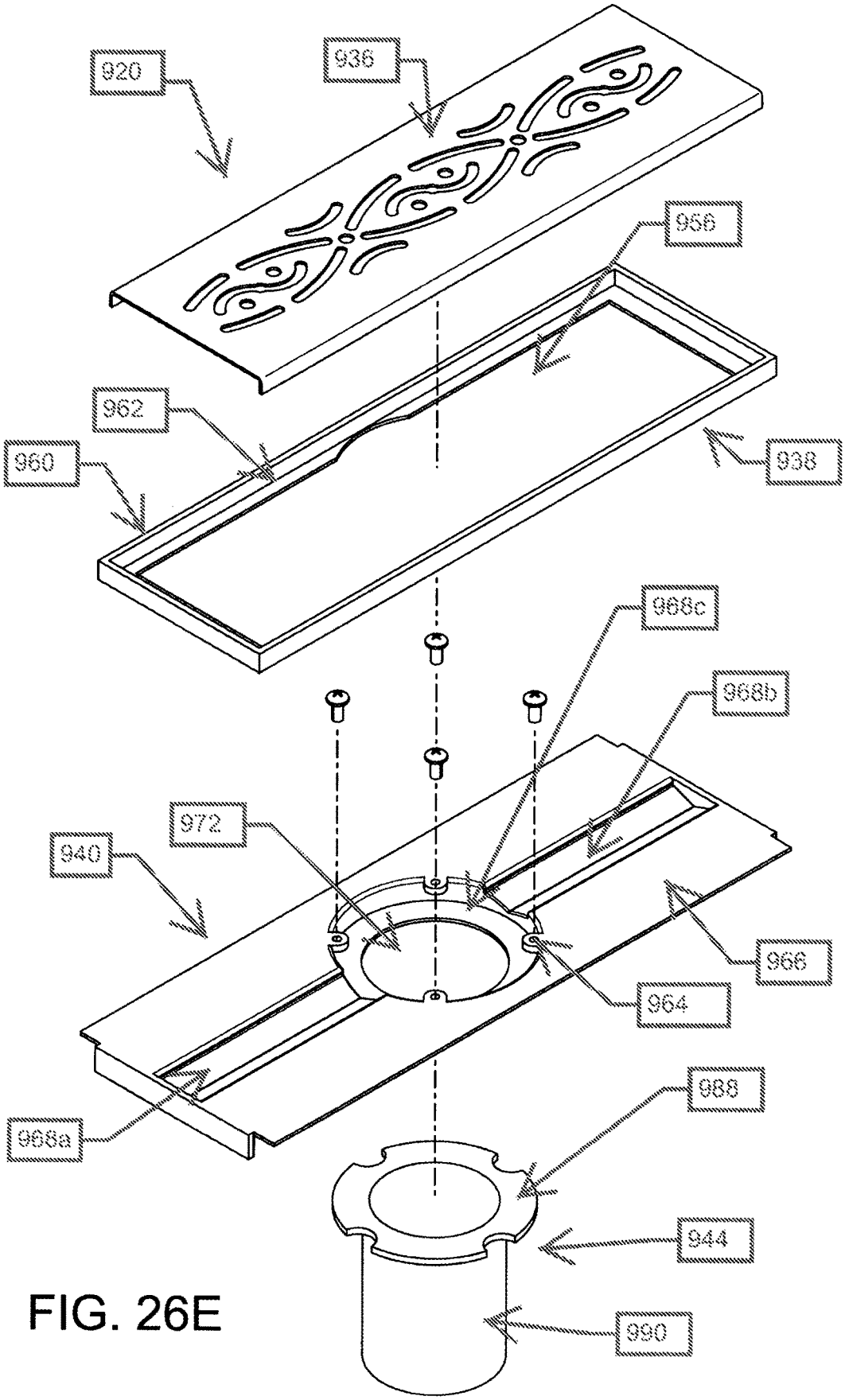

FIG. 22 illustrates an alternate embodiment of a frame 538' having a flange 560' and a recessed surface 562', a drain body 540', a seal 424', an outlet 544' having a flange 588'. The seal 242' is inserted into a cutout on an outer perimeter of the flange 288' and is pressed against an inner surface of the frame 538'. Other seal locations are possible and are considered to be within the scope of the present disclosure.

FIGS. 23A-E illustrate another embodiment of a drain 620 including a grate 636, a frame 638, a drain body 640, a seal 642, a wedge 643 and an outlet 644. The illustrated grate 636 and the illustrated frame 638 are circular and have a smaller diameter than the drain body 640. The grate 636 has a slightly smaller outer diameter than the frame 638. The frame 638 includes a raised lip 660 around the perimeter and is recessed to receive the grate 636. A plurality of fasteners retain the grate 636 in the frame 638. The top of the grate 636 and the top of the raised lip 660 form a planar upper surface of the drain 620. The frame 638 defines a circular opening 656 to permit fluid flow therethrough.

The drain body 640 is circular and includes a planar upper surface upon which the frame 638 can be fixed by fasteners. The drain body 640 defines a first inwardly protruding flange 666, a second inwardly protruding flange 668, and a recessed area between the first inwardly protruding flange 666 and the second inwardly protruding flange 668. The drain 640 includes a circular opening 672 that is generally aligned with the circular opening 656 in the frame 638. The first inwardly protruding flange 666 defines an irregular opening that includes opposite circular portions and opposite square sides. The second inwardly protruding flange 668 defines a circular opening that corresponds to the circular opening 656.

The wedge 643 includes a centerline 643*a* diving a first half and a second half that is a substantial mirror image of the first half. The first half includes a first bulbous portion and the second half includes a second bulbous portion. The wedge 643 can be bent about the centerline 643*a*.

The outlet 644 includes a flange 688 and an elongate conduit 690. The flange 688 is an irregular shape that includes opposite circular portions and opposite square sides.

The drain 620 is assembled by positioning the seal 643 on the second inwardly protruding flange 668 and then inserting the outlet 644 into the circular opening 672 of the drain body 640. The outlet 644 is rotated approximately ninety degrees such that the flange 688 is retained between the first inwardly protruding flange 666 and the second inwardly protruding flange 668. The flange 688 rests on the seal 643 on the recessed surface 562 of the frame 538 when installed. The wedge 643 is bent about the centerline 643*a* and the first and second bulbous portions are placed on top of the flange 688. The wedge 643 is flattened by pressing near the centerline 643*a* to thereby press the first and second bulbous portions 643*b*, 643*c* into the recessed area between the first inwardly protruding flange 666 and the second inwardly protruding flange 668. The wedge 643 presses the flange 688 against the seal 642 to compress the seal against the second inwardly protruding flange 688 of the drain body 640.

FIGS. 24A-E illustrate another embodiment of a drain 720 including a grate 736, a frame 738, a drain body 740 and an outlet 744. The illustrated grate 736 and the illustrated frame 738 are rectangular and have a smaller width and length than the drain body 740. The grate 736 has a slightly smaller width and length than the frame 738. The frame 738 includes a raised lip 760 around the perimeter and a recessed surface 762 to receive the grate 736. In some embodiments, a plurality of fasteners can retain the grate 736 in the frame 738. The top of the grate 736 and the top of the raised lip 760 form a planar upper surface of the drain 720. The frame 738 defines a rectangular opening 756 to permit fluid flow therethrough.

The drain body 740 is rectangular and includes a planar upper surface 766 upon which the frame 738 can rest and, optionally, be fixed by fasteners. The drain body 740 includes first and second recessed portions 768*a*, 768*b* extending along an elongate portion of the drain body 740. The illustrated first and second recessed portions 768*a*, 768*b* are trenches having angled sides and a trough between the angled sides. The drain body 740 includes a third recessed portion 768*c* positioned between the first and second recessed portions 768*a*, 768*b* and extends inward toward an opening 772. The first and second recessed portions 768*a*, 768*b* direct fluid toward the third recessed portion 768*c* and toward the opening 772. The opening 772 is generally centrally positioned along a width of the drain body 740.

The outlet 744 includes a flange 788 and an elongated conduit 790. The flange 788 rests on the third recessed portion 768*c* and is connected thereto with fasteners. One or more seals, membranes and/or shims can be utilized to properly position the drain 720 and to create a seal between the frame 738, the drain body 740 and the outlet 744.

FIGS. 25A-E illustrate another embodiment of a drain 820 including a grate 836, a frame 838, a drain body 840, a seal 842 and an outlet 844. The illustrated grate 836 and the illustrated frame 838 are rectangular and have a smaller width and length than the drain body 840. The grate 836 has a slightly smaller width and length than the frame 838. The frame 838 includes a raised lip 860 around the perimeter and a recessed surface 862 to receive the grate 836. In some embodiments, a plurality of fasteners can retain the grate 836 in the frame 838. The top of the grate 836 and the top of the raised lip 860 form a planar upper surface of the drain 820. The frame 838 defines a rectangular opening 856 to permit fluid flow therethrough.

The drain body 840 is rectangular and includes a planar upper surface 866 upon which the frame 838 can rest and, optionally, be fixed by fasteners. The drain body 840 includes first and second recessed portions 868*a*, 868*b* extending along an elongate portion of the drain body 840. The illustrated first and second recessed portions 868*a*, 868*b* are trenches having angled sides and a trough between the angled sides. The drain body 840 includes a third recessed portion 868*c* positioned between the first and second recessed portions 868*a*, 868*b* and extends inward toward an opening 872. The first and second recessed portions 868*a*, 868*b* direct fluid toward the third recessed portion 868*c* and toward the opening 872. The opening 872 is generally centrally positioned along a width of the drain body 840.

The outlet 844 includes a flange 888 and an elongated conduit 890. The seal 842 is inserted into a recess on an underside of the flange 888 and is pressed against the third recessed portion 868*c*. The flange 888 rests on the third recessed portion 868*c* and is connected thereto with fasteners. One or more seals, membranes and/or shims can be utilized to properly position the drain 820 and to create a seal between the frame 838, the drain body 840 and the outlet 844.

FIGS. 26A-E illustrate another embodiment of a drain 920 including a grate 936, a frame 938, a drain body 940 and an outlet 944. The illustrated grate 936 and the illustrated frame 938 are rectangular and have a smaller width and length than the drain body 940. The grate 936 has a slightly smaller width and length than the frame 938. The frame 938 includes a raised lip 960 around the perimeter and a recessed surface 962 to receive the grate 936. In some embodiments, a plurality of fasteners can retain the grate 936 in the frame 938. The top of the grate 936 and the top of the raised lip 960 form a planar upper surface of the drain 920. The frame 938 defines a rectangular opening 956 to permit fluid flow therethrough.

The drain body 940 is rectangular and includes a planar upper surface 966 upon which the frame 938 can rest and, optionally, be fixed by fasteners. The drain body 940 includes first and second recessed portions 968*a*, 968*b* extending along an elongate portion of the drain body 940. The illustrated first and second recessed portions 968*a*, 968*b* are trenches having angled sides and a trough between the angled sides. The drain body 940 includes a third recessed portion 968*c* positioned between the first and second recessed portions 968*a*, 968*b* and extends inward toward an opening 972. A plurality of flanges 964 extend across a portion of the opening and are configured to receive fasteners. The first and second recessed portions 968*a*, 968*b* direct fluid toward the third recessed portion 968*c* and toward the opening 972. The opening 972 is generally centrally positioned along a width of the drain body 940.

The outlet 944 includes a flange 988 and an elongated conduit 990. The flange 988 includes a plurality of recesses configure to permit a respective flange of the drain body 940 to pass therethrough. The outlet 944 is inserted into the opening 972 while the flanges 964 are aligned with the recesses such that the flange 988 rests on the third recessed portion 968*c*. Then, the outlet 944 is rotated approximate ninety degrees to inhibit removal of the outlet 944. Then fasteners are inserted into the flanges 964 and abut against the flange 988 to retain the outlet 944 on the third recessed portion 968*c*. One or more seals, membranes and/or shims can be utilized to properly position the drain 920 and to create a seal between the frame 938, the drain body 940 and the outlet 944.

FIGS. 27A-E illustrate another embodiment of a drain 1020 including a grate 1036, a frame 1038, a drain body 1040 a seal 1042 and an outlet 1044. The illustrated grate 1036 and the illustrated frame 1038 are rectangular and have a smaller width and length than the drain body 1040. The grate 1036 has a slightly smaller width and length than the frame 1038. The frame 1038 includes a raised lip 1060 around the perimeter and a recessed surface 1062 to receive the grate 1036. In some embodiments, a plurality of fasteners can retain the grate 1036 in the frame 1038. The top of the grate 1036 and the top of the raised lip 1060 form a planar upper surface of the drain 1020. The frame 1038 defines a rectangular opening 1056 to permit fluid flow therethrough.

The drain body 1040 is rectangular and includes a planar upper surface 1066 upon which the frame 1038 can rest and, optionally, be fixed by fasteners. The drain body 1040 includes first and second recessed portions 1068*a*, 1068*b* extending along an elongate portion of the drain body 1040. The illustrated first and second recessed portions 1068*a*, 1068*b* are trenches having angled sides and a trough between the angled sides. The drain body 1040 includes a third recessed portion 1068*c* positioned between the first and second recessed portions 1068*a*, 1068*b* and extends inward toward an opening 1072. A plurality of flanges 1064 extend across a portion of the opening and are configured to receive fasteners. The first and second recessed portions 1068*a*, 1068*b* direct fluid toward the third recessed portion 1068*c* and toward the opening 1072. The opening 1072 is generally centrally positioned along a width of the drain body 1040.

The outlet 1044 includes a flange 1088 and an elongated conduit 1090. The flange 1088 includes a plurality of recesses configure to permit a respective flange of the drain body 1040 to pass therethrough. The seal 1042 is positioned on the third recessed portion 1068*c* and an underside of the flange 1088 presses against the seal 1042 against third recessed portion 1068*c*. The outlet 1044 is inserted into the opening 1072 while the flanges 1064 are aligned with the recesses such that the flange 1088 rests on the third recessed portion 1068*c*. Then, the outlet 1044 is rotated approximate ninety degrees to inhibit removal of the outlet 1044. Then fasteners are inserted into the flanges 1064 and abut against the flange 1088 to retain the outlet 1044 on the third recessed portion 1068*c*. One or more seals, membranes and/or shims can be utilized to properly position the drain 1020 and to create a seal between the frame 1038, the drain body 1040 and the outlet 1044.

Figure 27A:
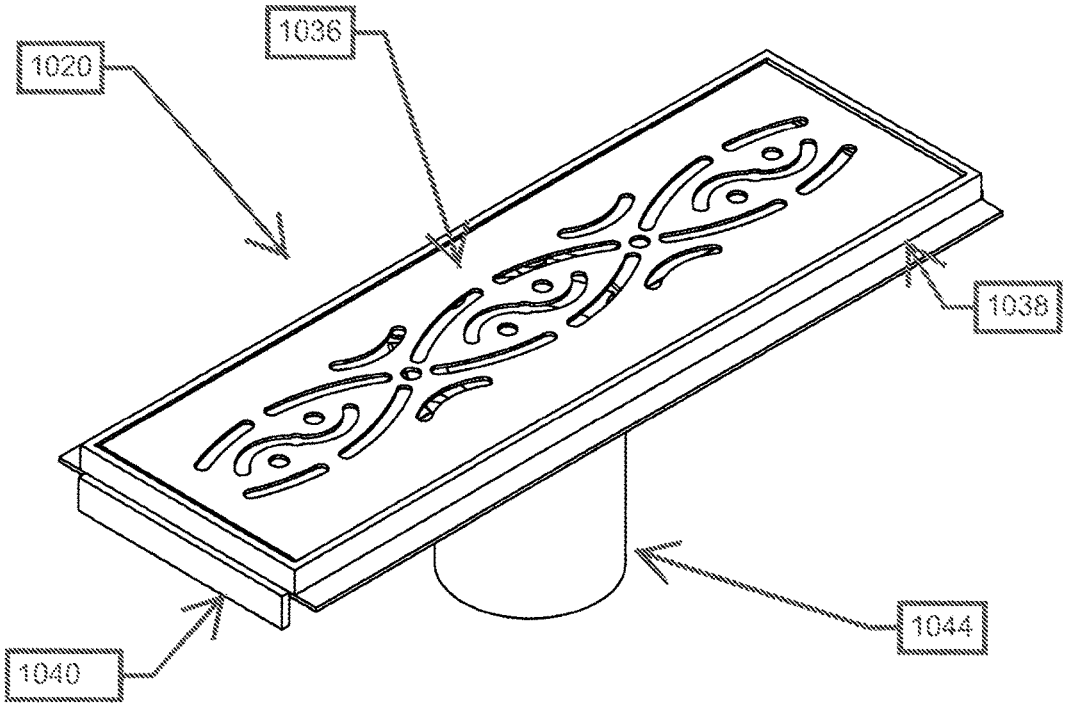
FIGS. 27A-F are various views of one possible drain embodiment.
Figure 27B:
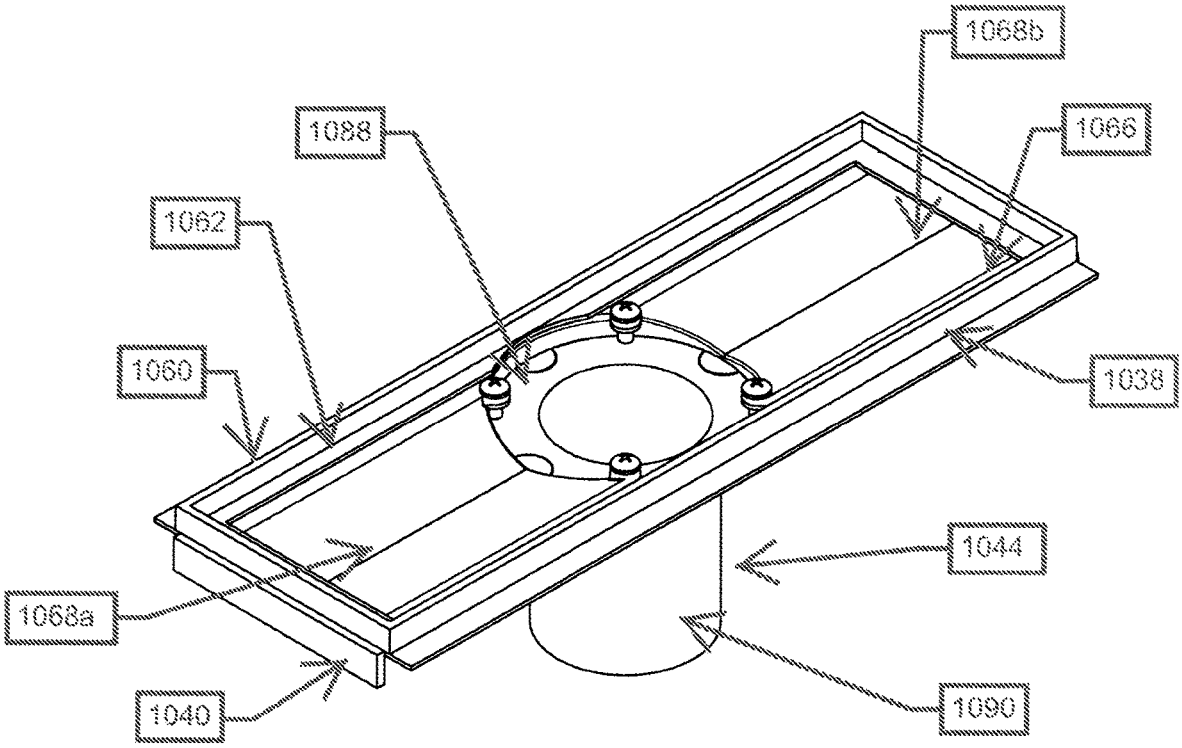
Figure 27C:
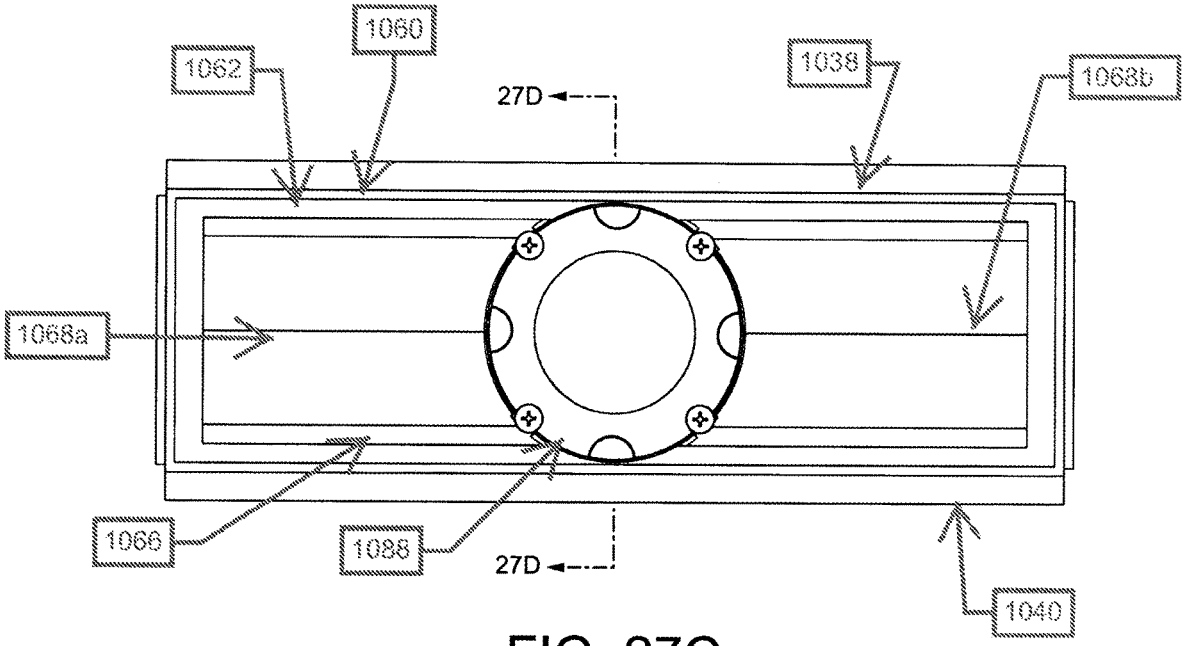
Figure 27D:
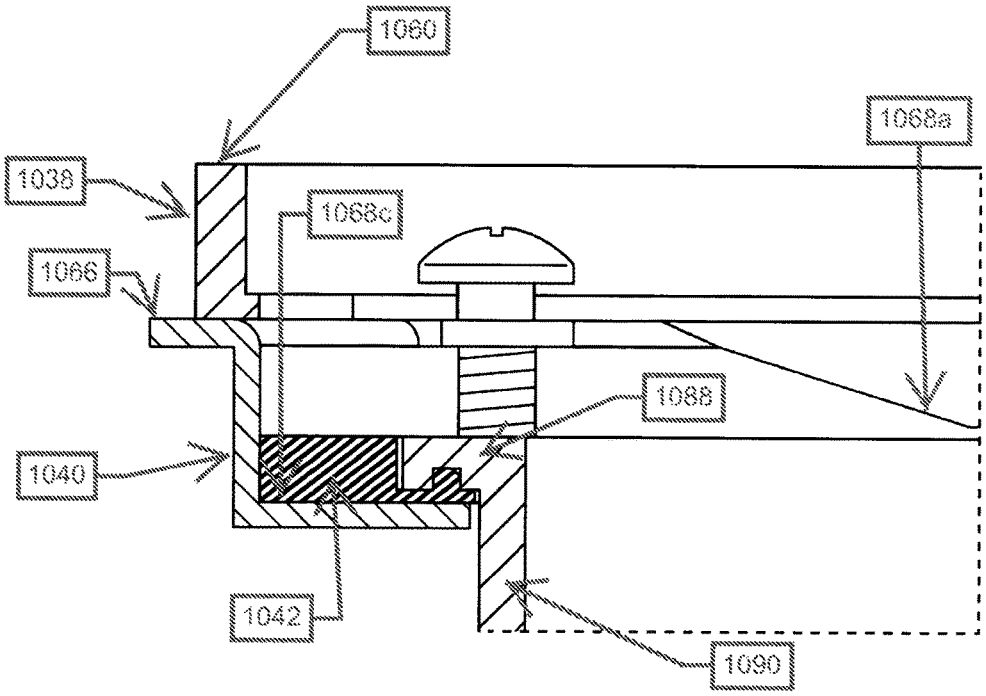
Figure 27E:
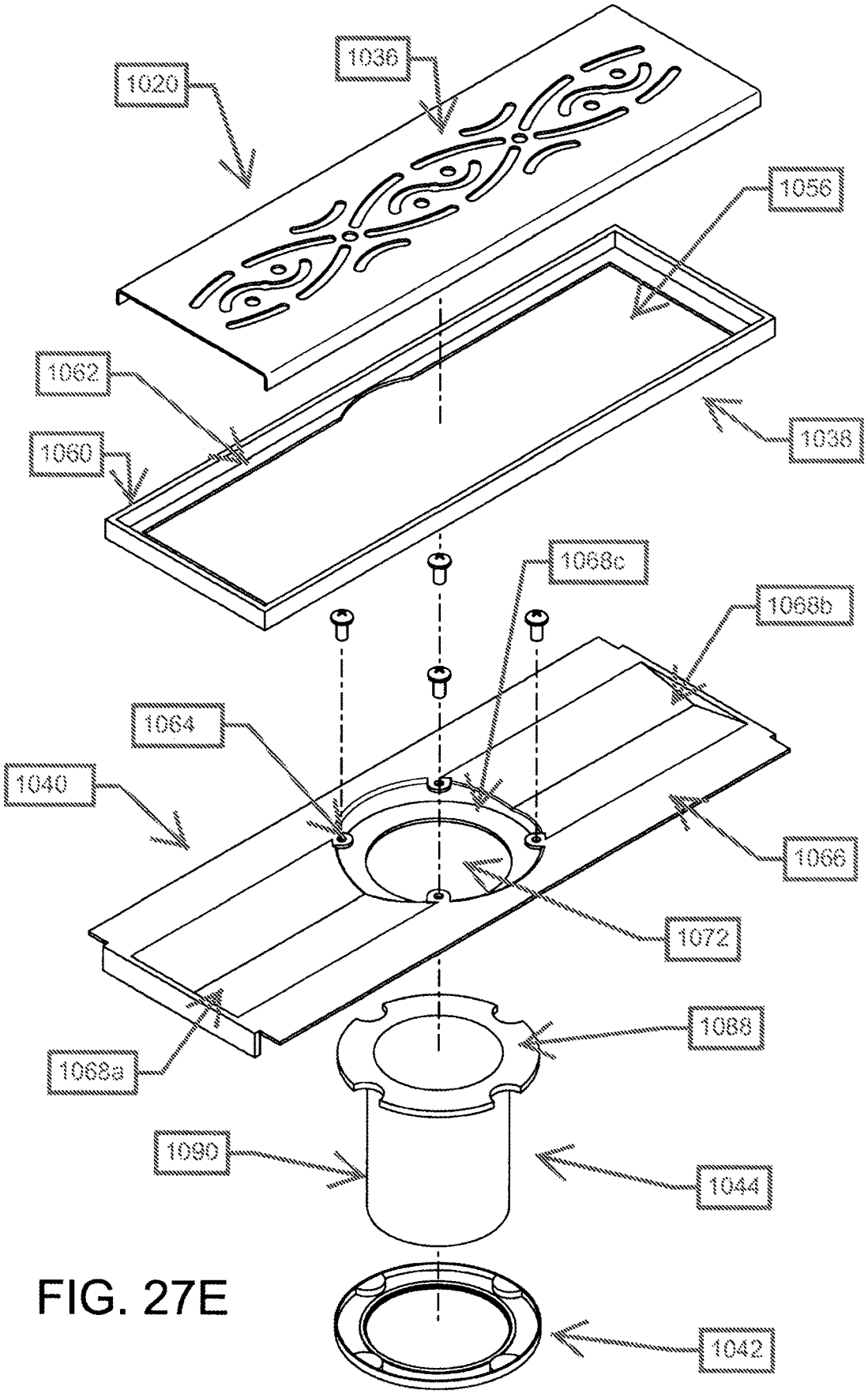
Figure 27F:
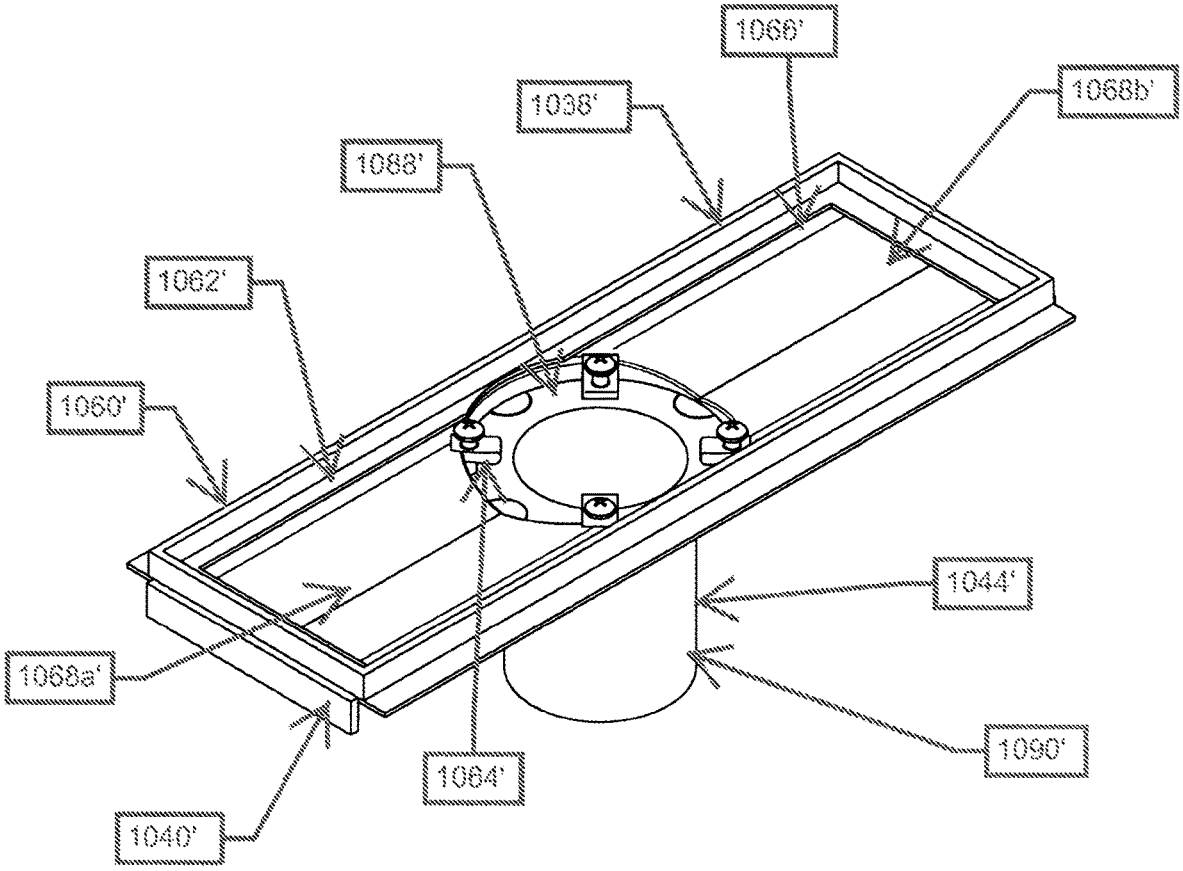
Figure 28A:
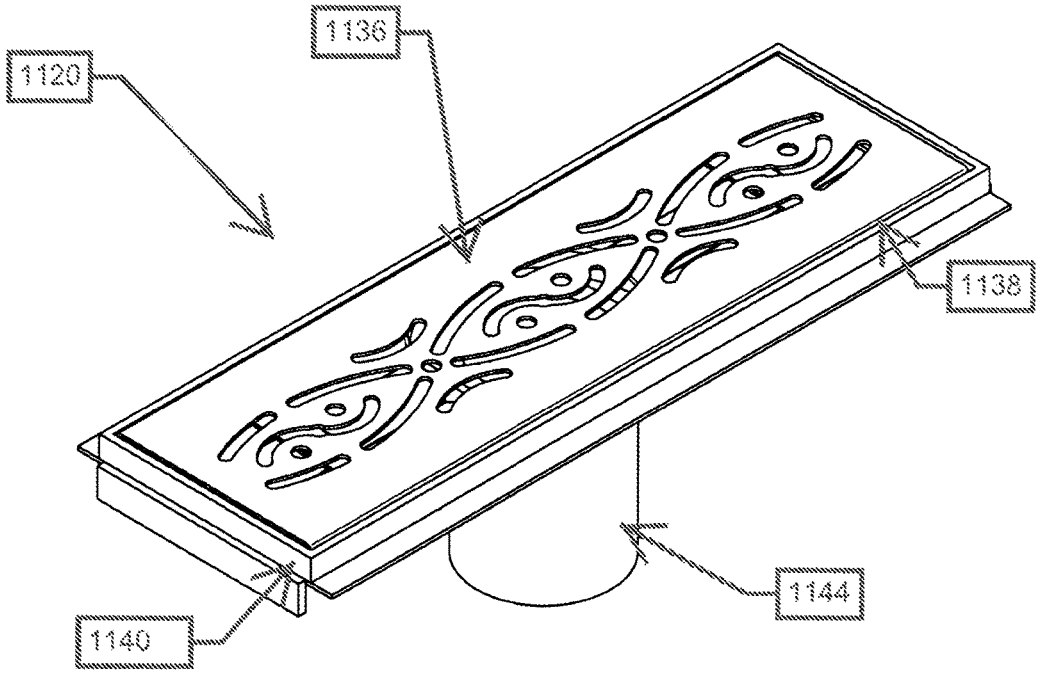
FIGS. 28A-E are various views of one possible drain embodiment.
Figure 28B:
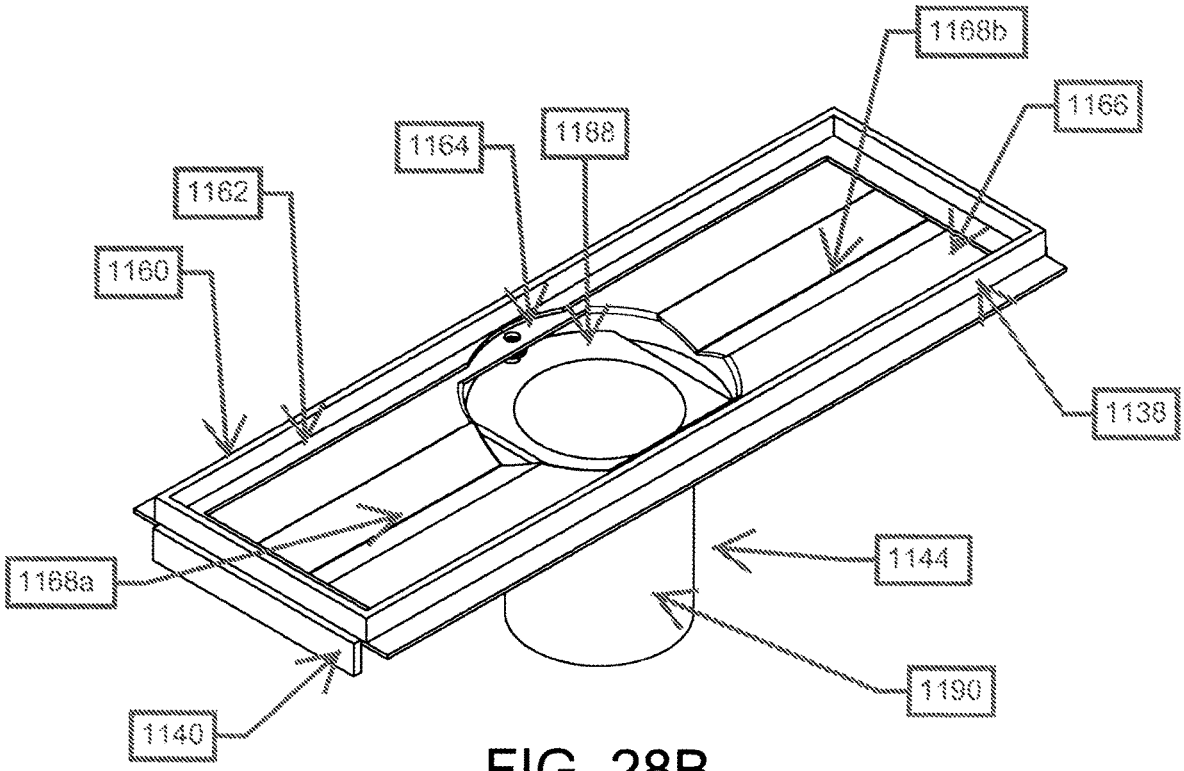
Figure 28C:
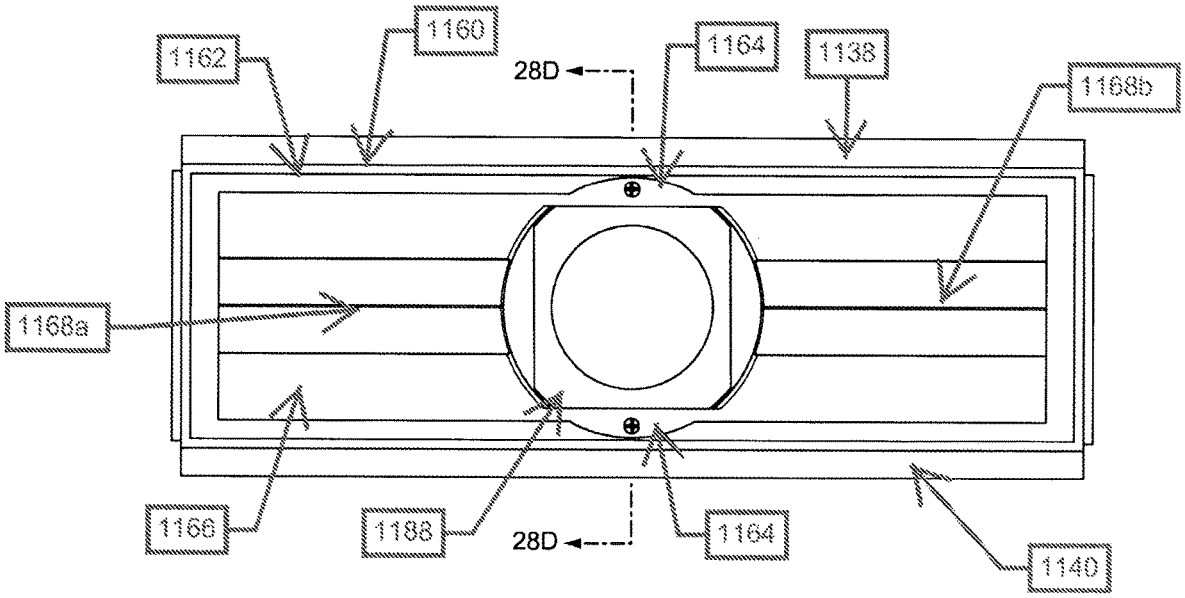
Figure 28D:
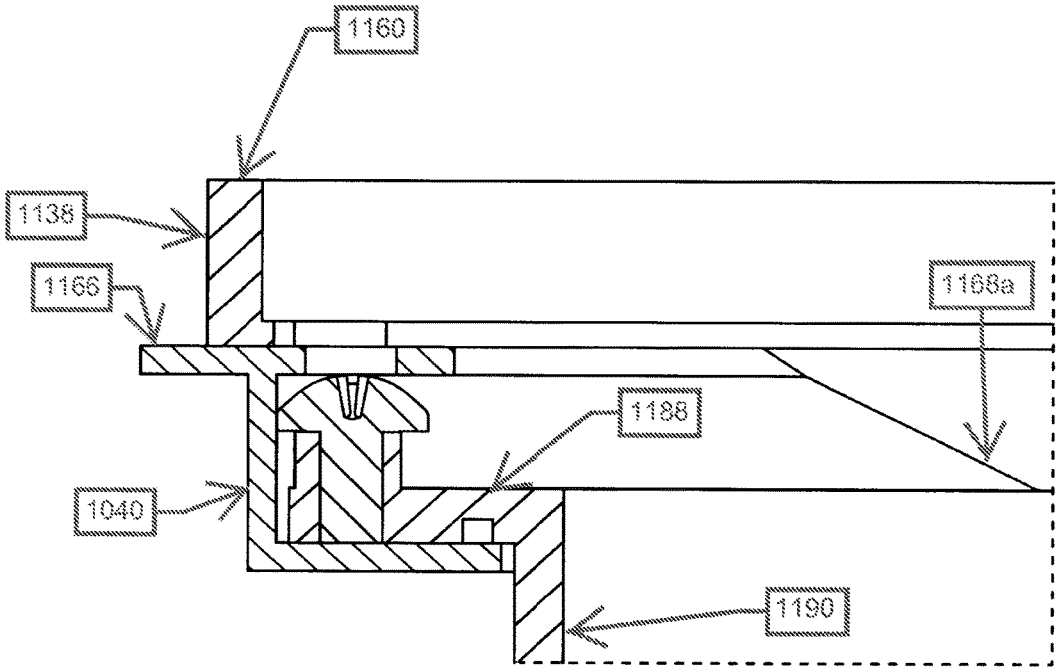
Figure 28E:
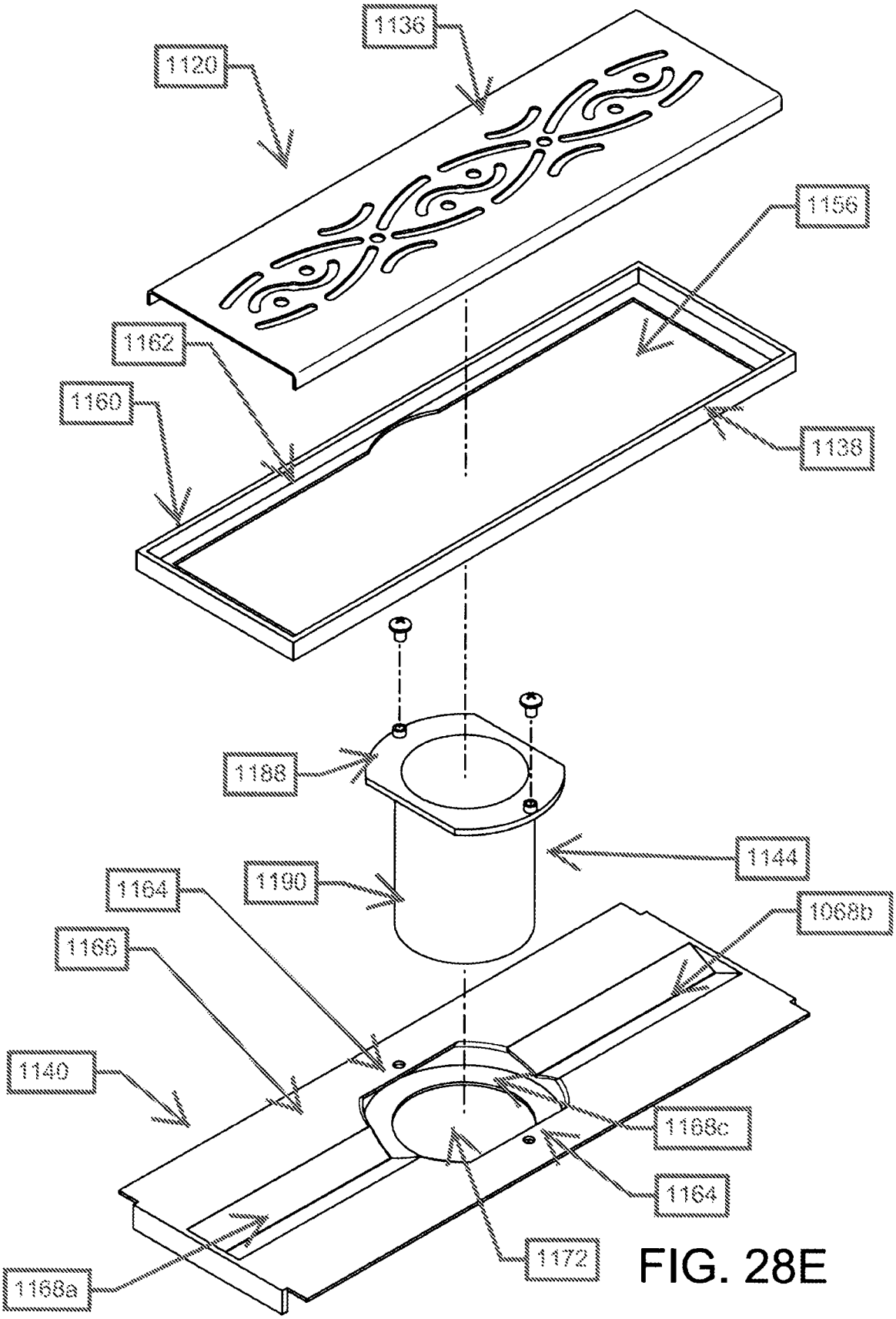
Figure 29A:
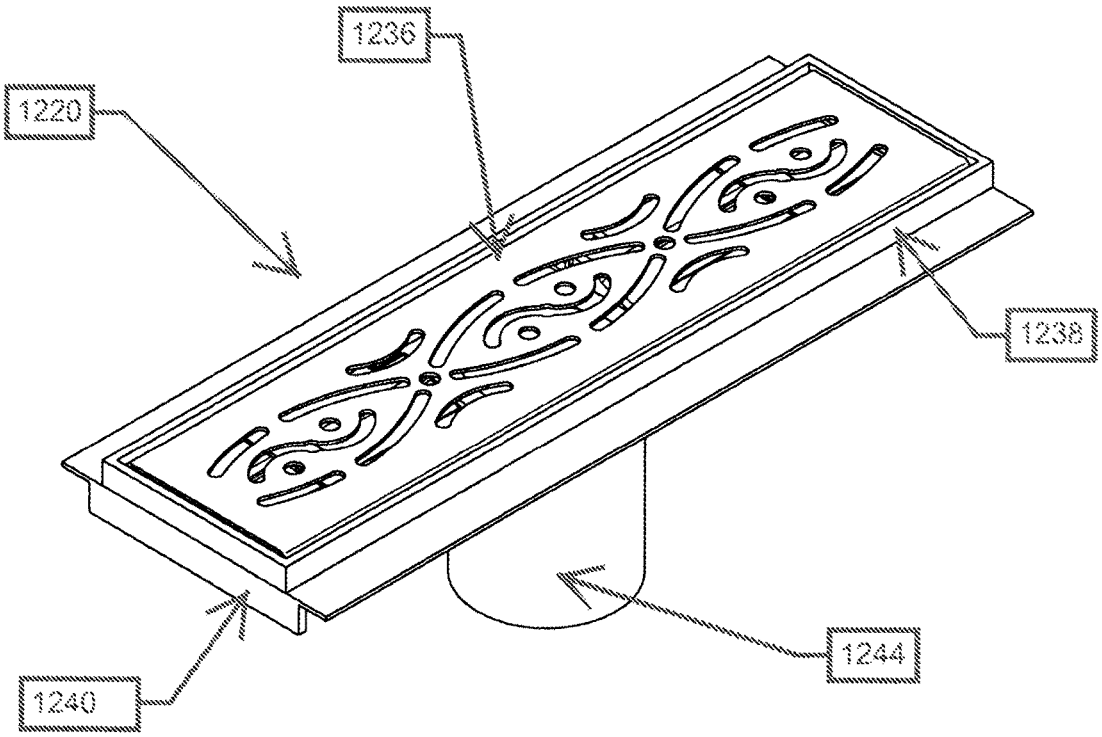
FIGS. 29A-E are various views of one possible drain embodiment.
Figure 29B:
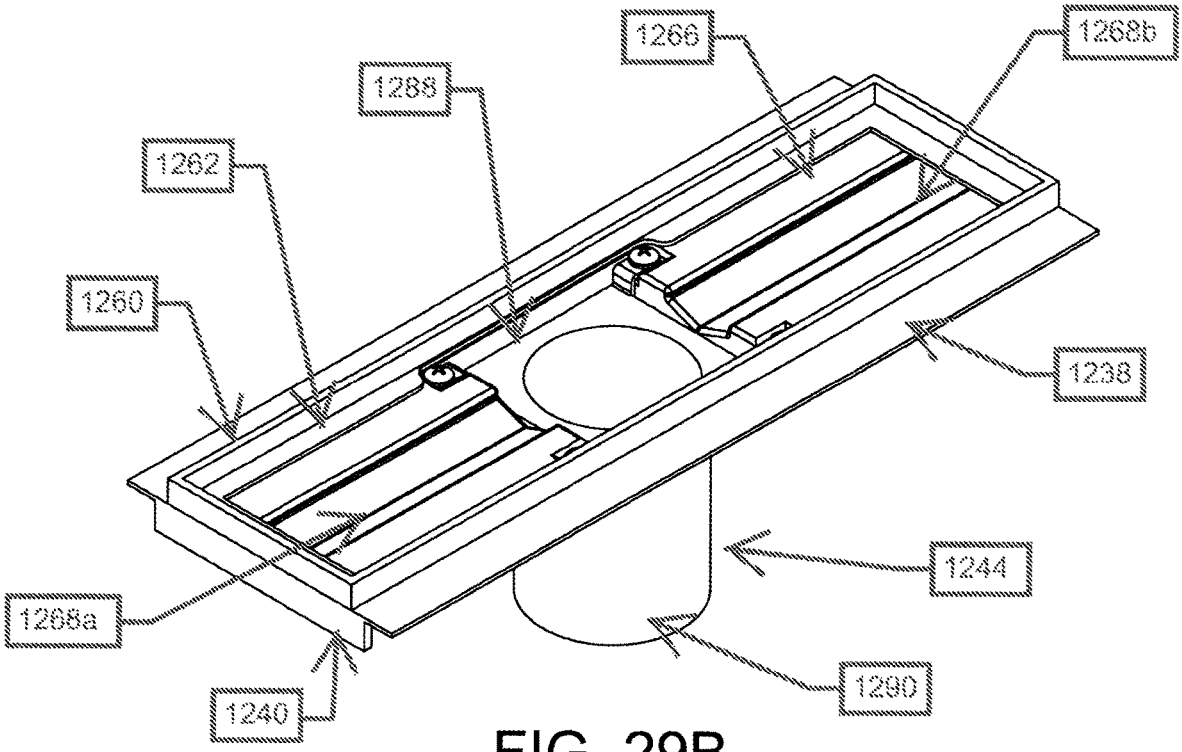
Figure 29C:
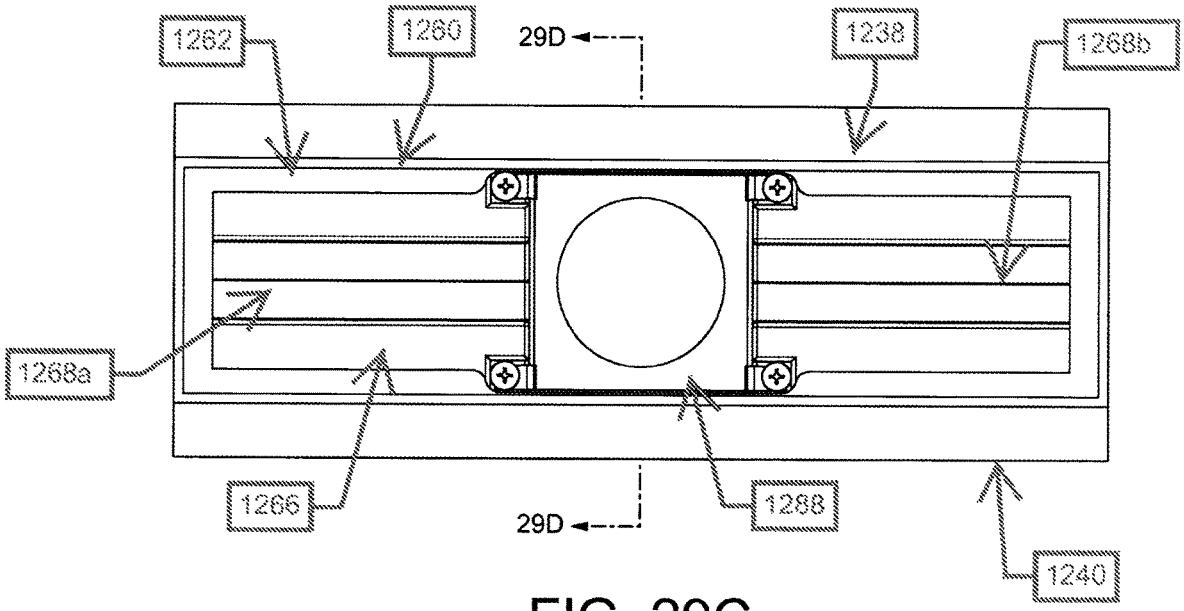
Figure 29D:
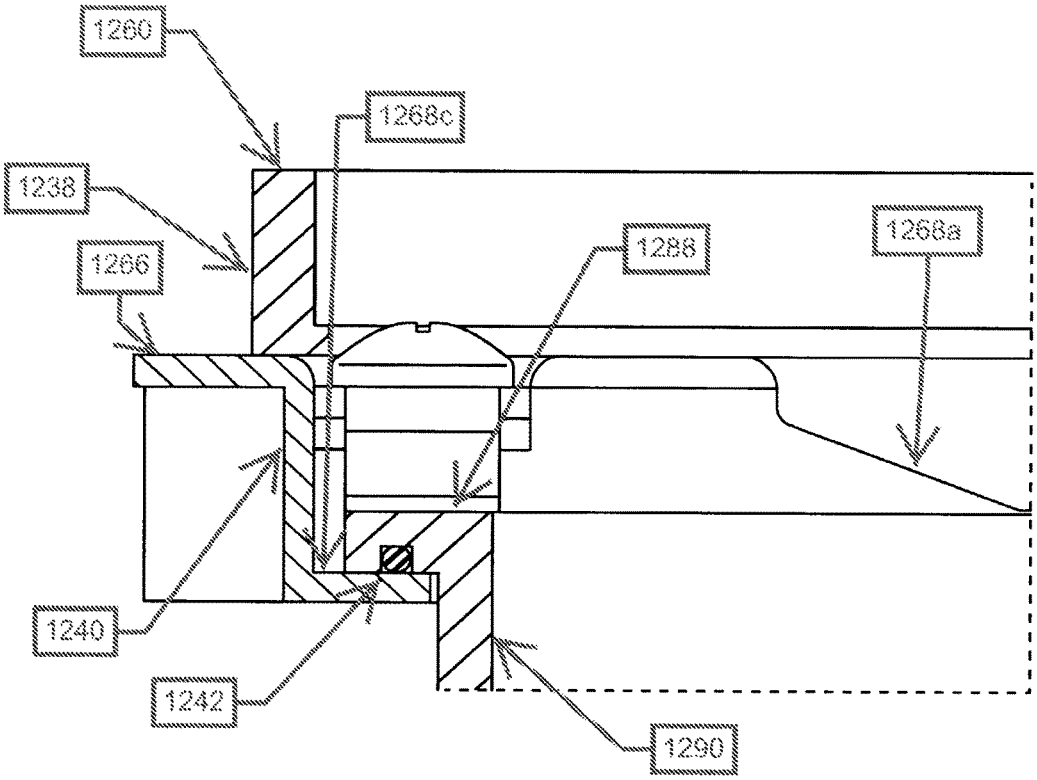
Figure 29E:
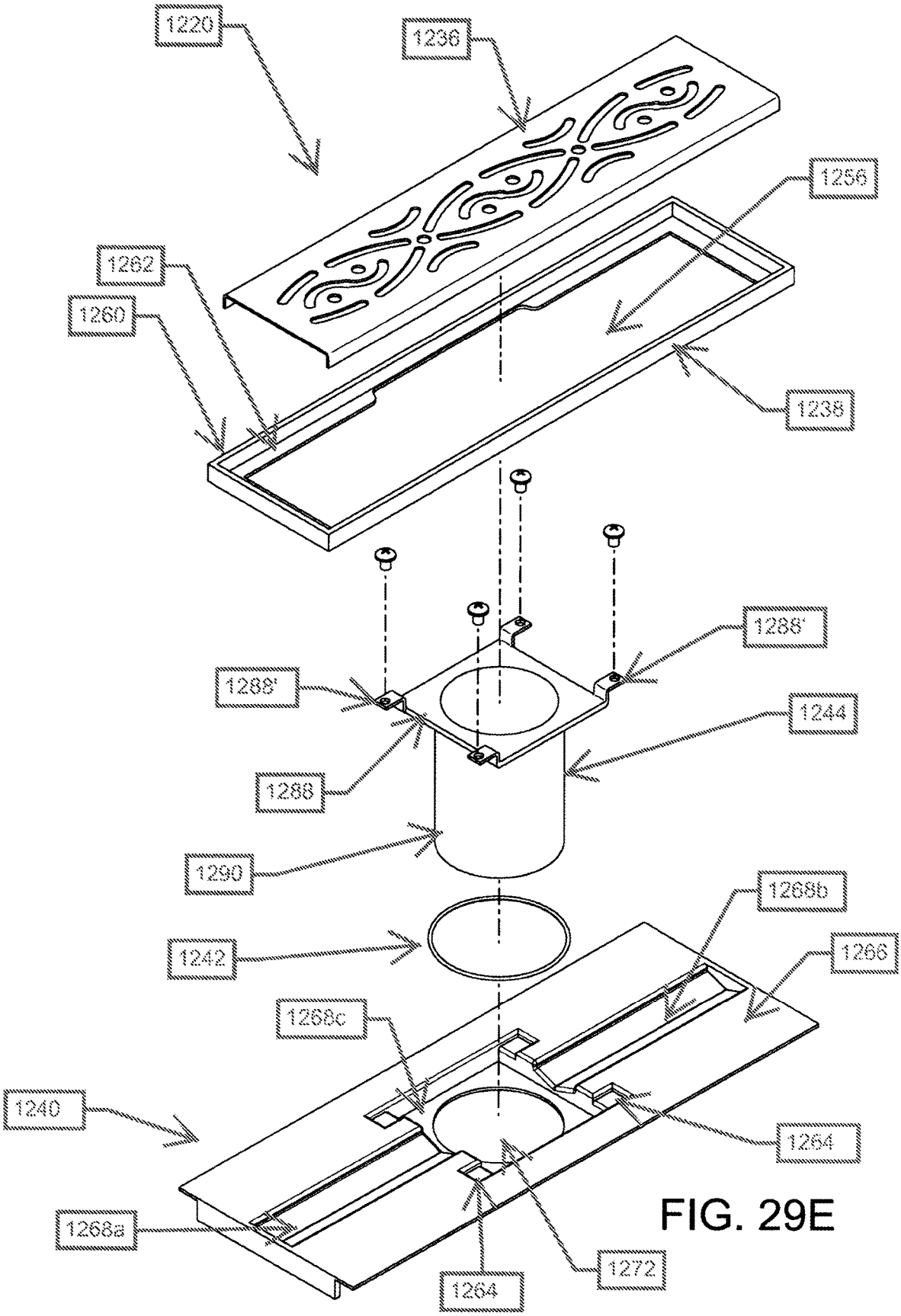
Figure 30A:
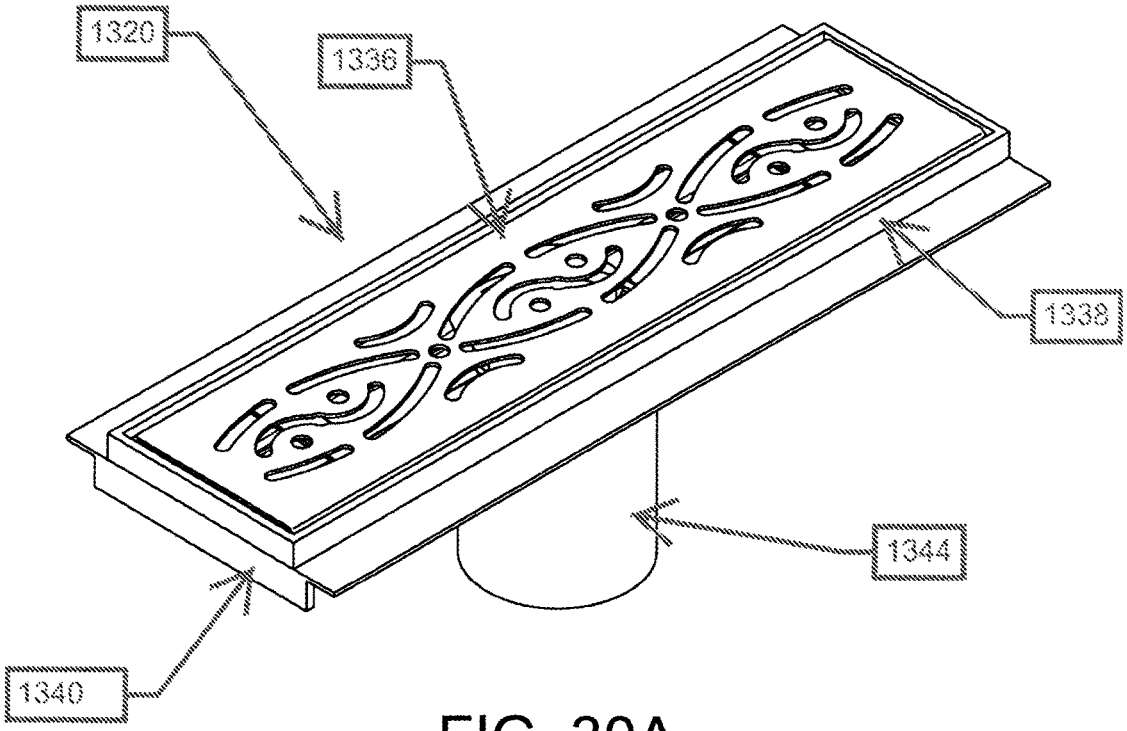
FIGS. 30A-E are various views of one possible drain embodiment.
Figure 30B:
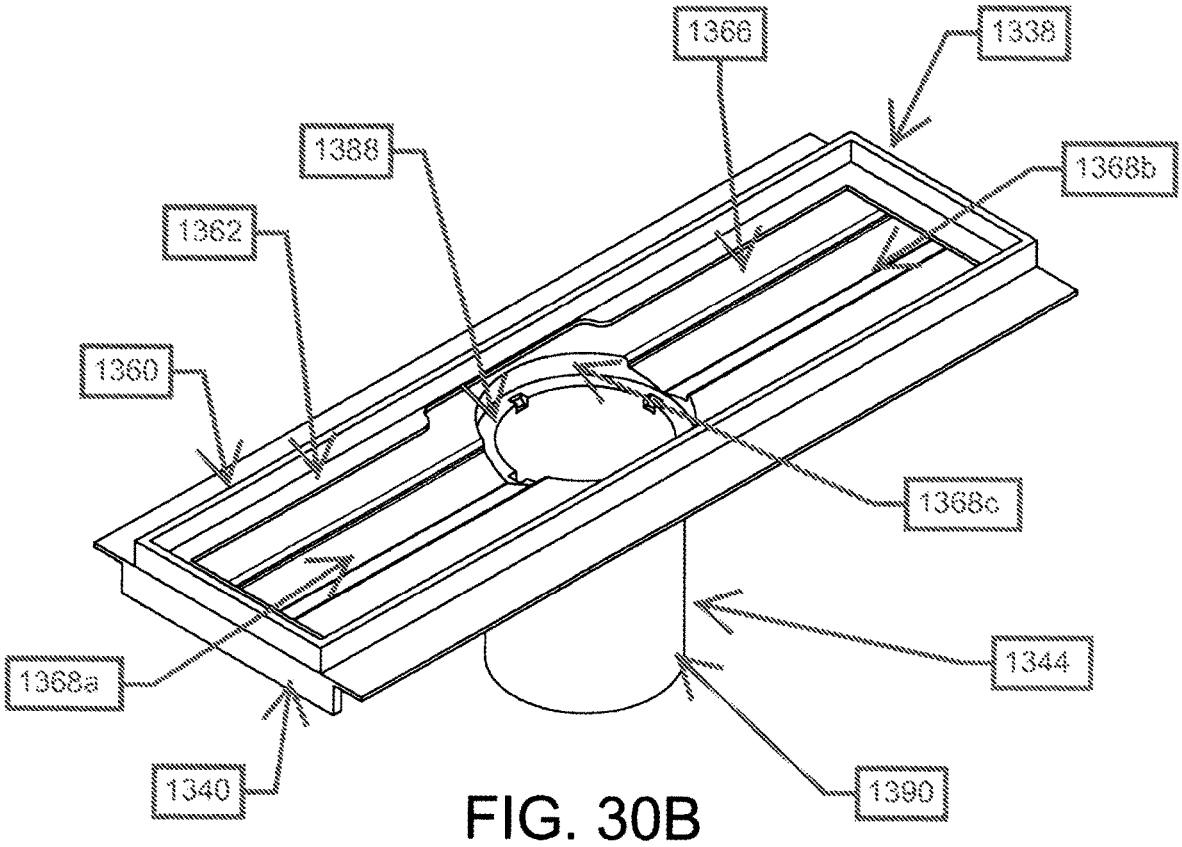
Figure 30C:
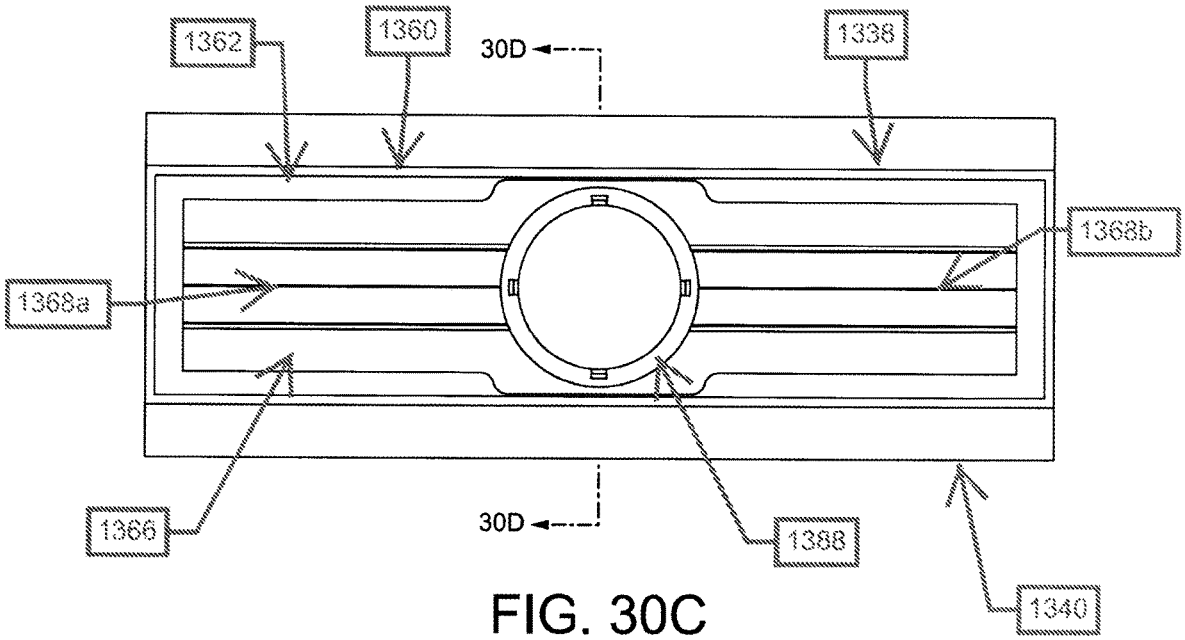
Figure 30D:
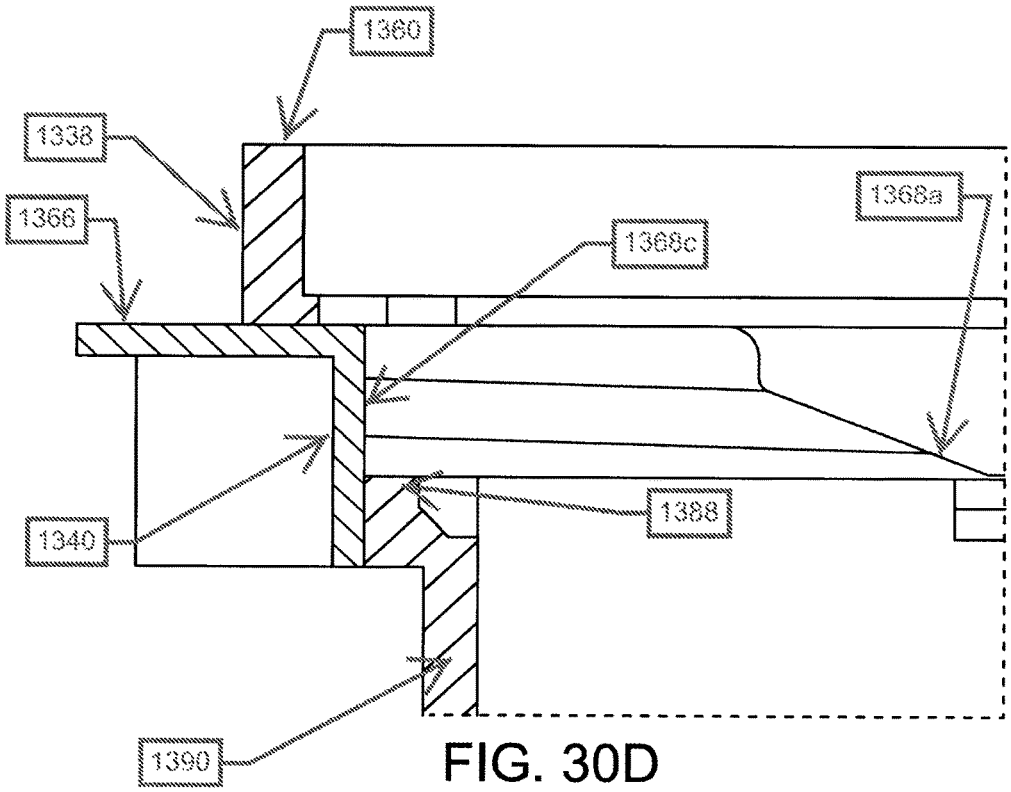
Figure 30E:
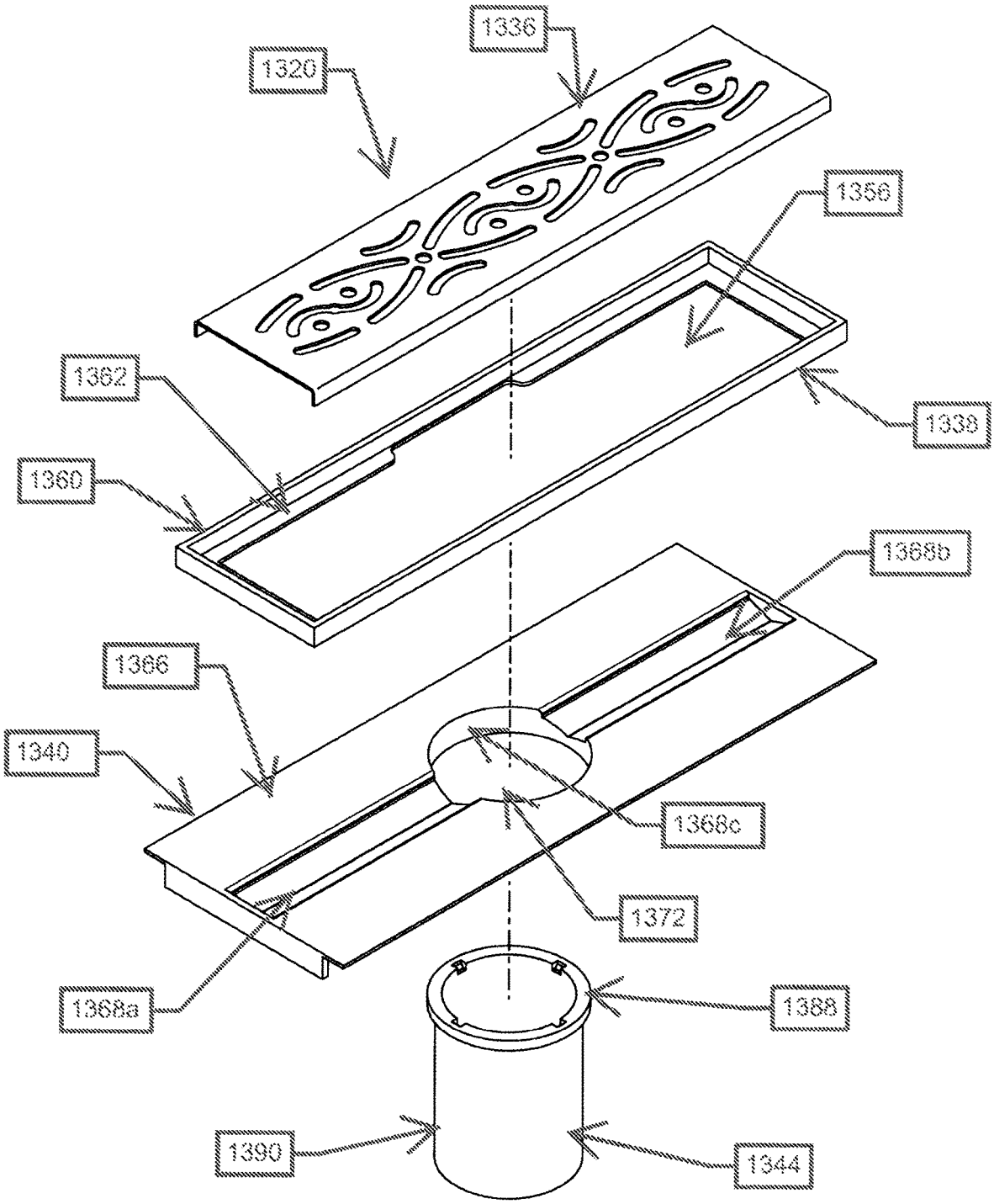
Figure 31A:
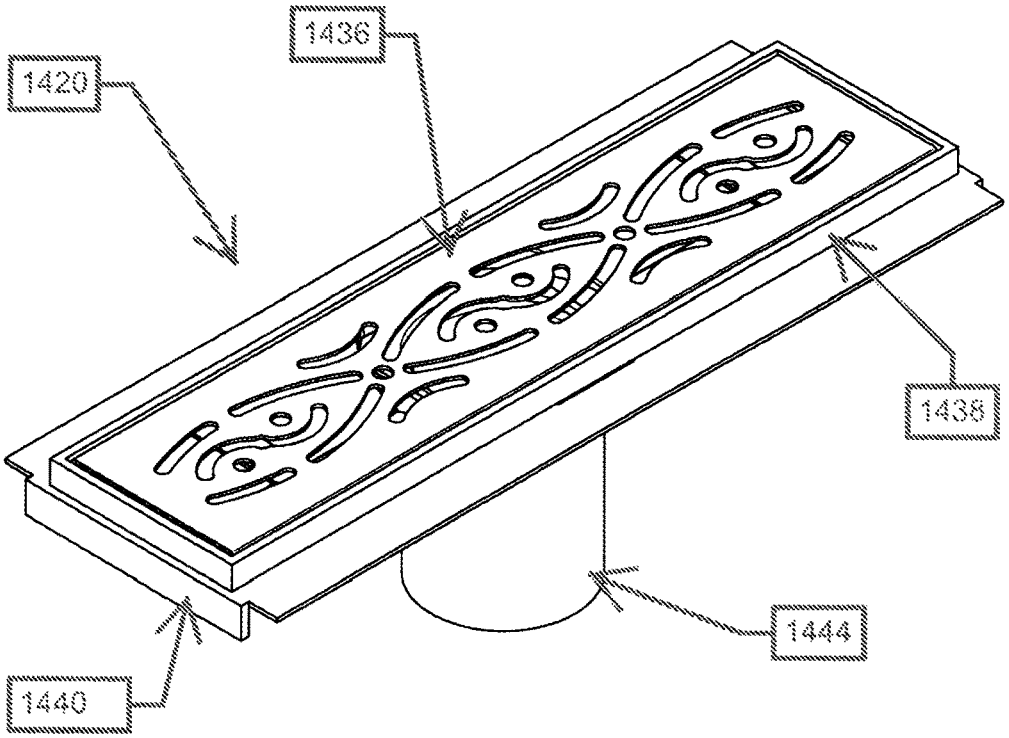
FIGS. 31A-E are various views of one possible drain embodiment.
Figure 31B:
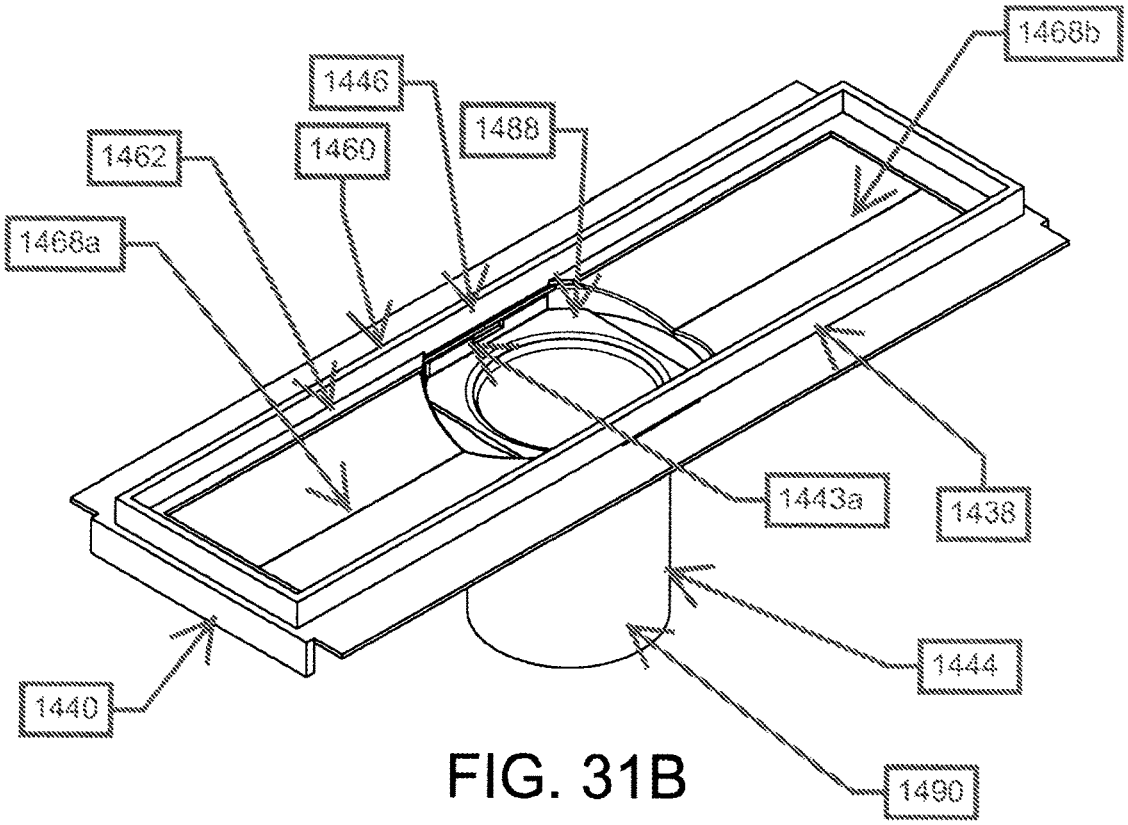
Figure 31C:
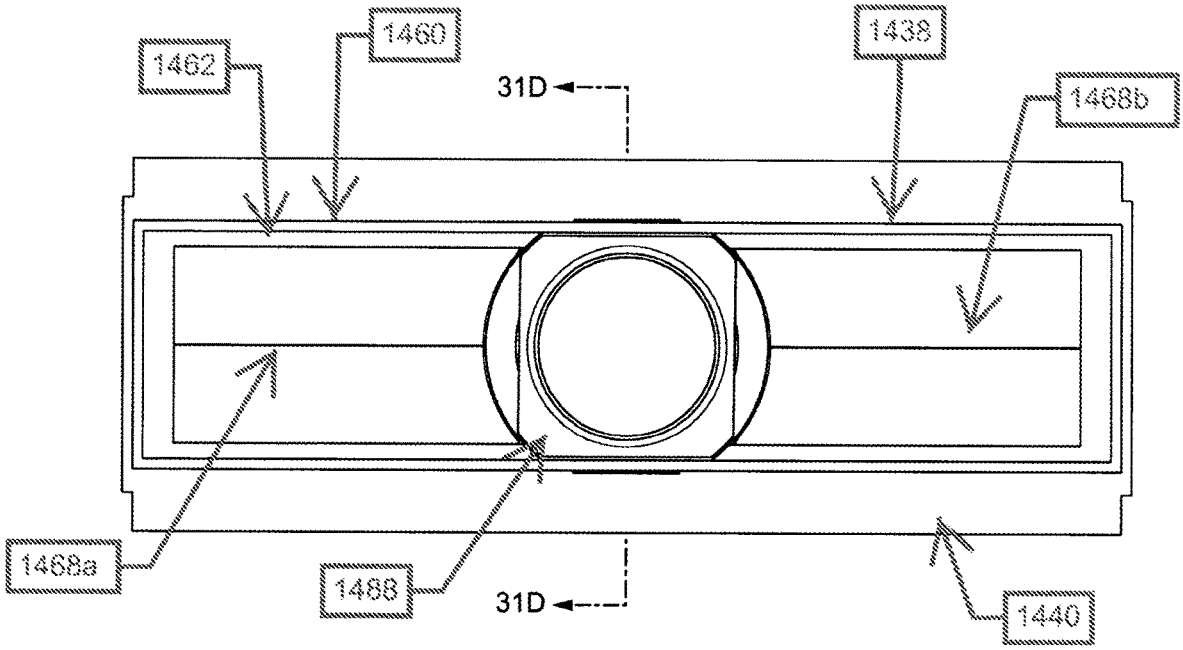
Figure 31D:
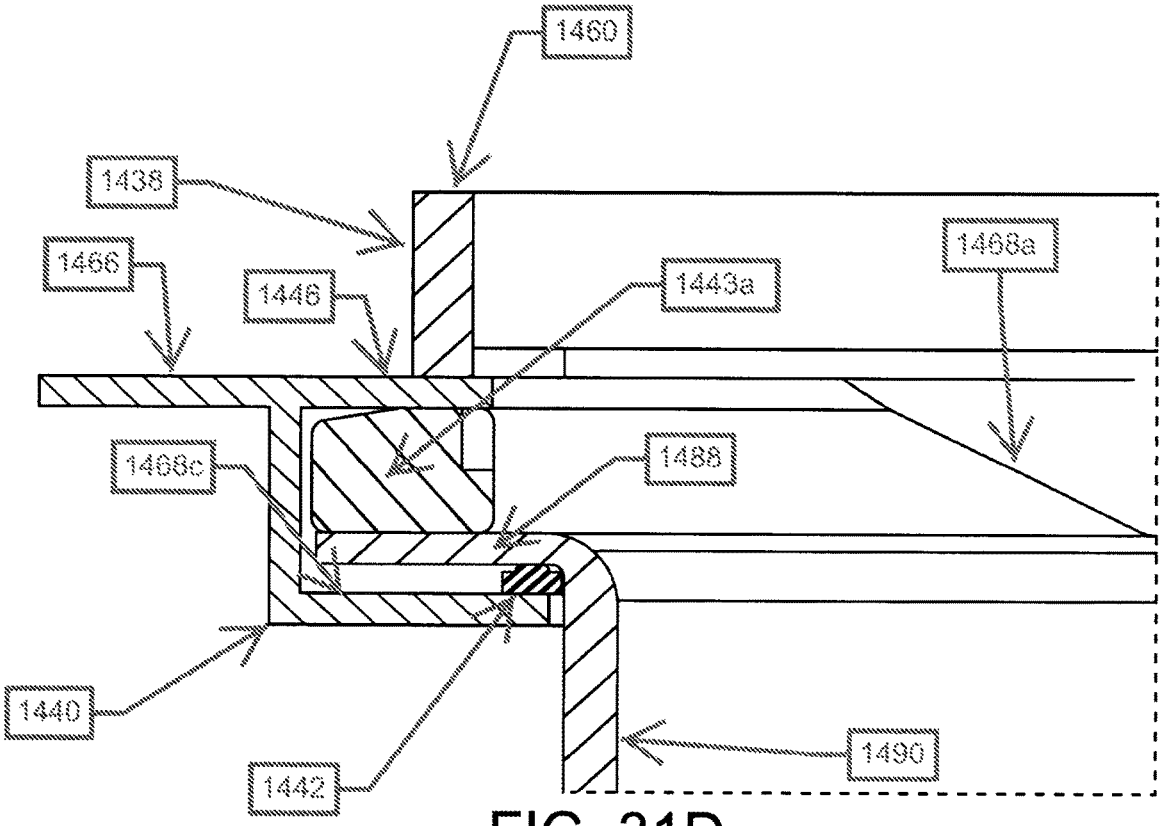
Figure 31E:
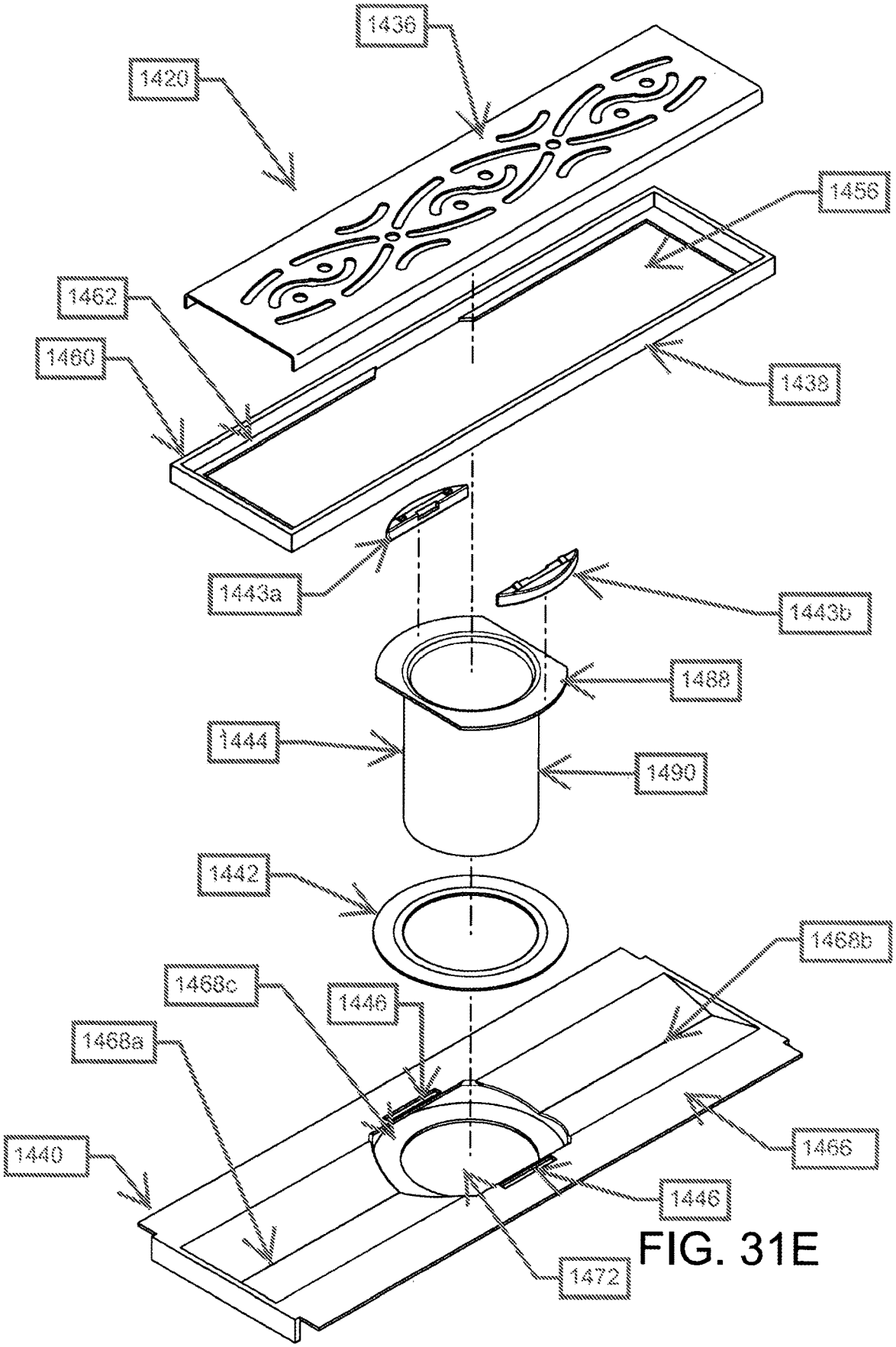
Figure 31F:
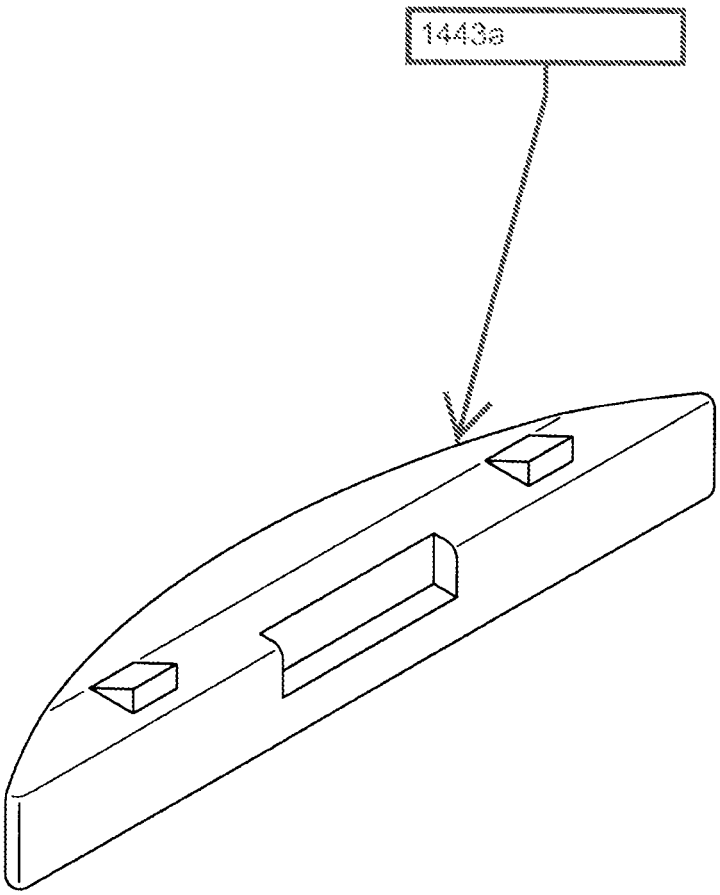
FIG. 31F is a close up view of a portion of the embodiment of FIGS. 31A-E.
Figure 32A:
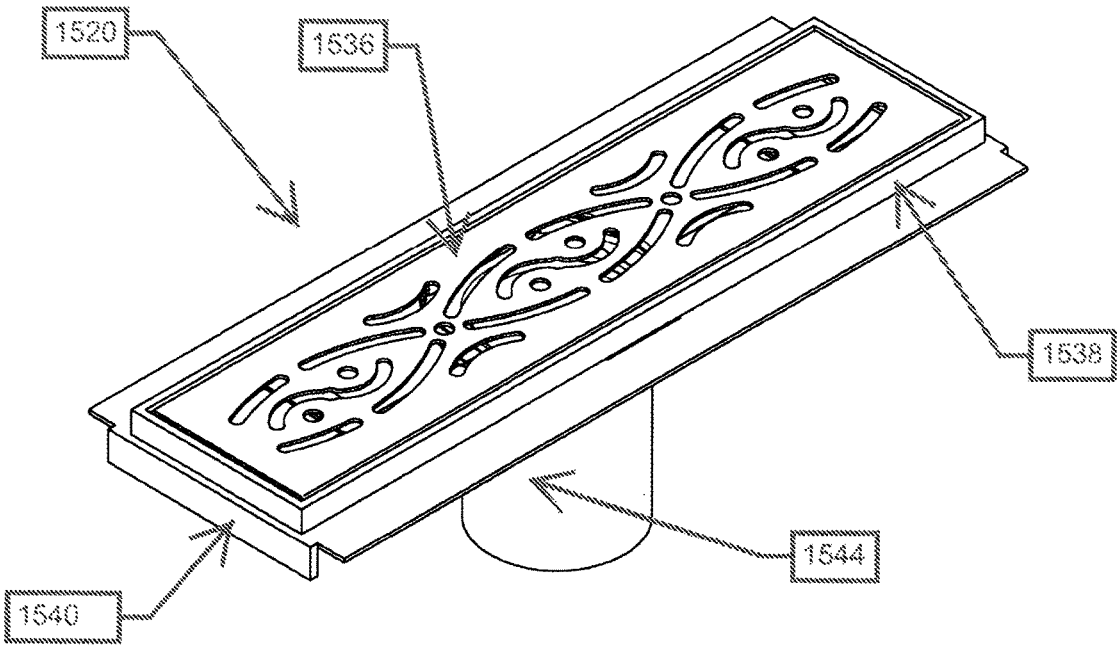
FIGS. 32A-E are various views of one possible drain embodiment.
Figure 32B:
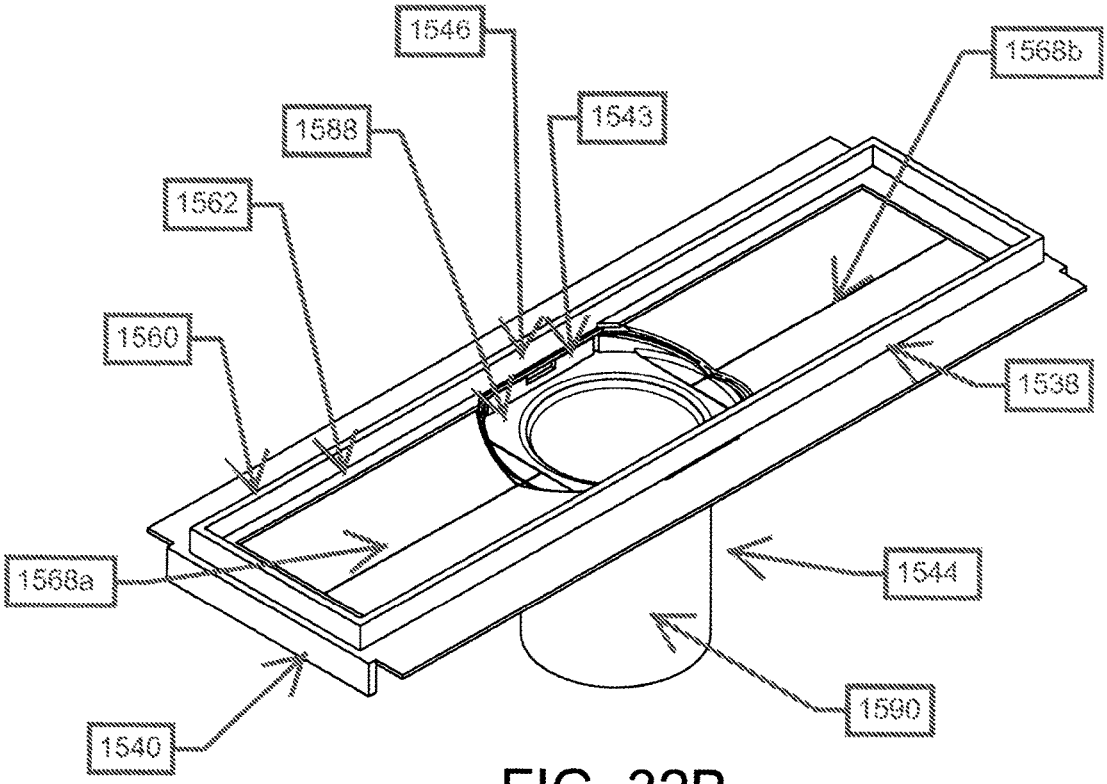
Figure 32C:
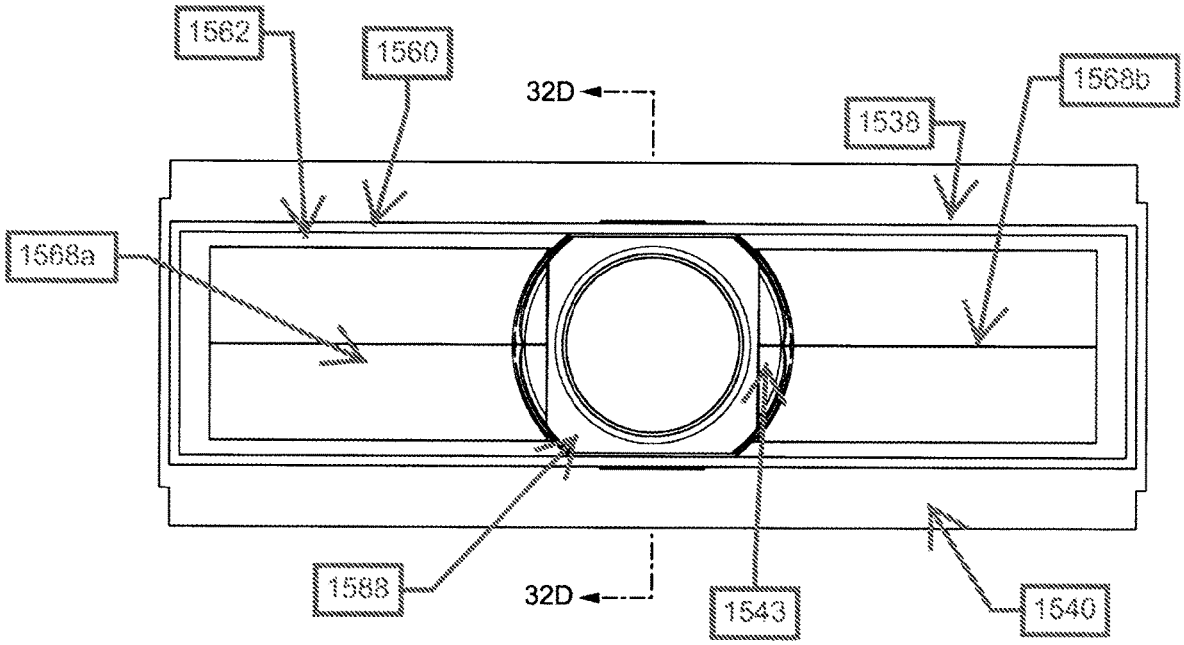
Figure 32D:
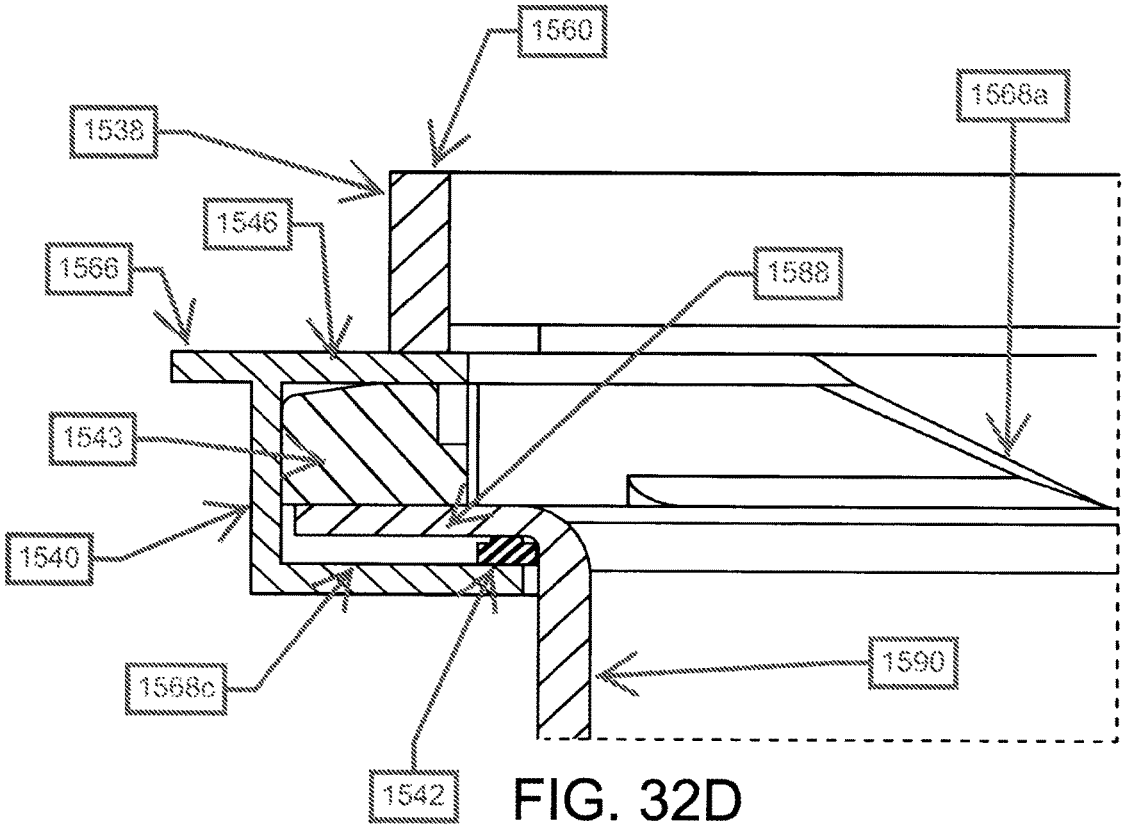
Figure 32E:
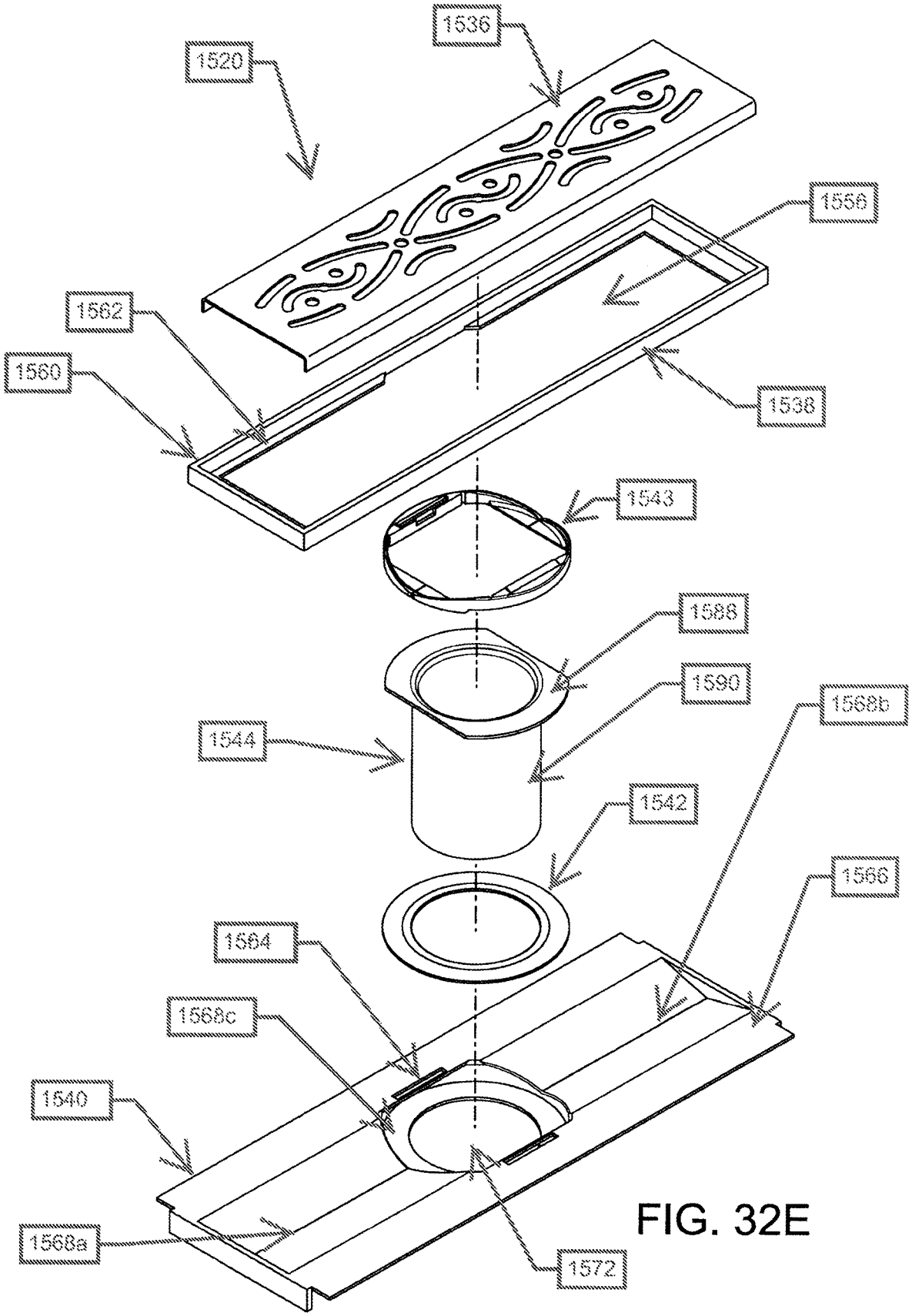
Figure 32F:
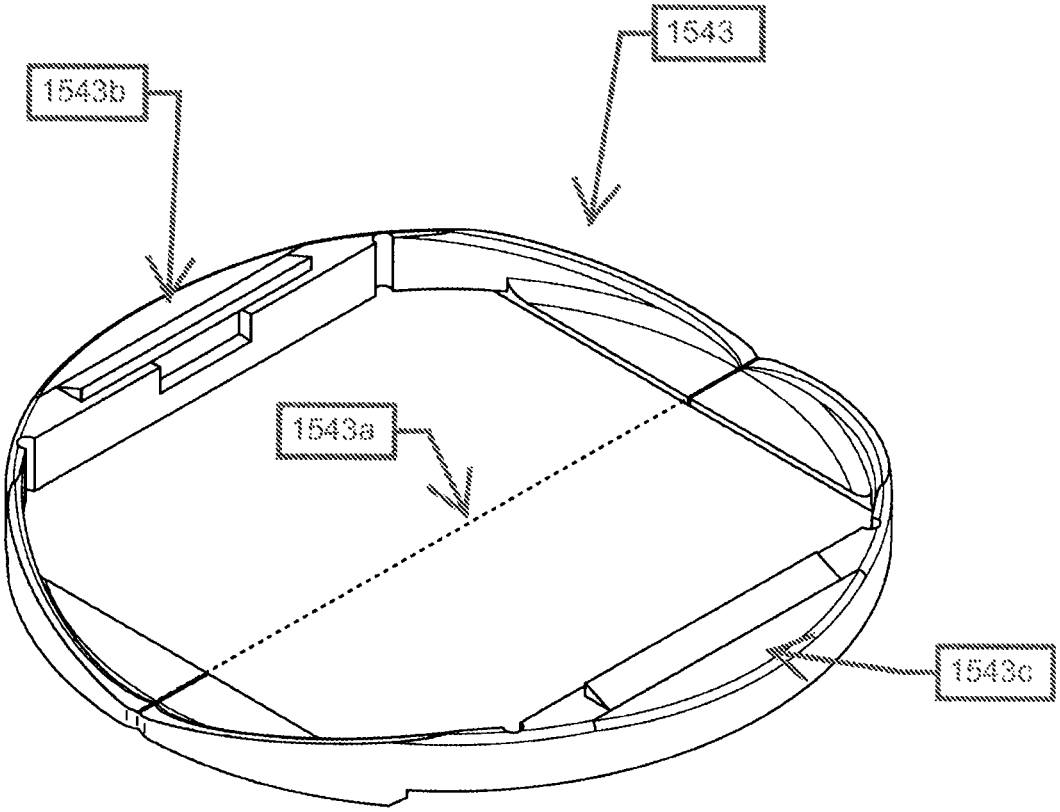
FIG. 32F is a close up view of a portion of the embodiment of FIGS. 32A-E.

FIG. 27F illustrates a variation of the embodiment of FIGS. 27A-E. FIG. 27F illustrates a drain 1020' including a frame 1038' having a raised lip 1060' around the perimeter and a recessed surface 1062' to receive a grate. The drain body 1040 includes a planar upper surface 1066' upon which the frame 1038 can rest and, optionally, be fixed by fasteners. The drain body 1040 includes first and second recessed portions 1068*a*', 1068*b*' extending along an elongate portion of the drain body 1040' and a third recessed portion 1068*c*' positioned between the first and second recessed portions 1068*a*, 1068*b*. Instead of flanges that protrude inward, a plurality of springs 1064' extend across a portion of the opening and are configured to receive fasteners. Four springs 1064' are illustrated but other quantities and configurations of springs are possible and are within the scope of the present disclosure. The first and second recessed portions 1068*a*', 1068*b*' direct fluid toward the third recessed portion 1068*c*' and toward the opening.

The outlet 1044 includes a flange 1088' and an elongated conduit 1090'. The flange 1088' includes a plurality of recesses. The outlet 1044' is inserted into the opening 1072'. Then the springs 1064' are connected to the drain body 1040' and fasteners are inserted into the springs 1064'. The fasteners abut against the flange 1088' to retain the outlet 1044' on the third recessed portion 1068*c*'. One or more seals, membranes and/or shims can be utilized to properly position the drain 1020' and to create a seal between the frame 1038', the drain body 1040' and the outlet 1044'.

FIGS. 28A-E illustrate another embodiment of a drain 1120 including a grate 1136, a frame 1138, a drain body 1140 and an outlet 1144. The illustrated grate 1136 and the illustrated frame 1138 are rectangular and have a smaller width and length than the drain body 1140. The grate 1136 has a slightly smaller width and length than the frame 1138. The frame 1138 includes a raised lip 1160 around the perimeter and a recessed surface 1162 to receive the grate 1136. In some embodiments, a plurality of fasteners can retain the grate 1136 in the frame 1138. The top of the grate 1136 and the top of the raised lip 1160 form a planar upper surface of the drain 1120. The frame 1138 defines a rectangular opening 1156 to permit fluid flow therethrough.

The drain body 1140 is circular and includes a planar upper surface 1166 upon which the frame 1138 can rest and, optionally, be fixed by fasteners. The upper surface can include flanges 1146 that apertures for receiving fasteners to retain the outlet 1144. The drain body 1140 includes first and second recessed portions 1168*a*, 1168*b* extending along an elongate portion of the drain body 1140. The illustrated first and second recessed portions 1168*a*, 1168*b* are trenches having angled sides and a trough between the angled sides. The drain body 1140 includes a third recessed portion 1168*c* positioned between the first and second recessed portions 1168*a*, 1168*b* and extends inward toward an opening 1172. The first and second recessed portions 1168*a*, 1168*b* direct fluid toward the third recessed portion 1168*c* and toward the opening 1172. The opening 1172 is generally centrally positioned along a width of the drain body 1140.

The outlet 1144 includes a flange 1188 and an elongated conduit 1190. The flange 1188 is an irregular shape that includes opposite circular portions and opposite square sides. The outlet 1144 is inserted into the opening 1172 while the flanges 1164 are aligned with the opposite square sides. Then, the outlet 1144 is rotated approximate ninety degrees to inhibit removal of the outlet 1144. Then fasteners are inserted into the flanges 1164 and abut against the flange 1188 to retain the outlet 1144 on the third recessed portion 1168*c*. One or more seals, membranes and/or shims can be utilized to properly position the drain 1120 and to create a seal between the frame 1138, the drain body 1140 and the outlet 1144.

FIGS. 29A-E illustrate another embodiment of a drain 1220 including a grate 1236, a frame 1238, a drain body 1240 a seal 1242 and an outlet 1244. The illustrated grate 1236 and the illustrated frame 1238 are rectangular and have a smaller width and length than the drain body 1240. The grate 1236 has a slightly smaller width and length than the frame 1238. The frame 1238 includes a raised lip 1260 around the perimeter and a recessed surface 1262 to receive the grate 1236. In some embodiments, a plurality of fasteners can retain the grate 1236 in the frame 1238. The top of the grate 1236 and the top of the raised lip 1260 form a planar upper surface of the drain 1220. The frame 1238 defines a rectangular opening 1256 to permit fluid flow therethrough.

The drain body 1240 is rectangular and includes a planar upper surface 1266 upon which the frame 1238 can rest and, optionally, be fixed by fasteners. The drain body 1240 includes first and second recessed portions 1268*a*, 1268*b* extending along an elongate portion of the drain body 1240. The illustrated first and second recessed portions 1268*a*, 1268*b* are trenches having angled sides and a trough between the angled sides. The drain body 1240 includes a third recessed portion 1268*c* positioned between the first and second recessed portions 1268*a*, 1268*b* and extends inward toward an opening 1272. A plurality of depressions 1264 extend away from the opening and are configured to receive mating protrusions of the outlet 1244. The first and second recessed portions 1268*a*, 1268*b* direct fluid toward the third recessed portion 1268*c* and toward the opening 1272. The opening 1272 is generally centrally positioned along a width of the drain body 1240.

The outlet 1244 includes a flange 1288 and an elongated conduit 1290. The flange 1288 includes a plurality of protrusions 1288' configured to extend into the respective depression 1264 of the drain body 1240. The seal 1242 is positioned on the third recessed portion 1268*c* and an underside of the flange 1288 presses against the seal 1242 against third recessed portion 1268*c*. The outlet 1244 is inserted into the opening 1272 while the depressions 1264 are aligned with the protrusions 1288' such that the flange 1288 rests on the third recessed portion 1268*c*. Then fasteners are inserted into the protrusions 1288' to compress the seal 1242 between the flange 1288 and the third recessed portion 1268*c* and to retain the outlet 1244 on the third recessed portion 1268*c*. One or more membranes and/or shims can be utilized to properly position the drain 1220 and to create a seal between the frame 1238, the drain body 1240, the seal 1242 and the outlet 1244.

FIGS. 30A-E illustrate another embodiment of a drain 1320 including a grate 1336, a frame 1338, a drain body 1340 and an outlet 1344. The frame 1338 includes a raised lip 1360 around the perimeter and a recessed surface 1362 to receive the grate 1336. The top of the grate 1336 and the top of the raised lip 1360 form a planar upper surface of the drain 1320. The frame 1338 defines a rectangular opening 1356 to permit fluid flow therethrough.

The drain body 1340 is rectangular and includes a planar upper surface 1366 upon which the frame 1338 can rest and, optionally, be fixed by fasteners. The drain body 1340 includes first and second recessed portions 1368*a*, 1368*b* extending along an elongate portion of the drain body 1340. The illustrated first and second recessed portions 1368*a*, 1368*b* are trenches having angled sides and a trough between the angled sides. The drain body 1340 includes a threaded inner surface 1368*c* that defines an opening 1372. The first and second recessed portions 1368*a*, 1368*b* direct fluid toward the opening 1372.

The outlet 1344 includes a flange 1388 and an elongated conduit 1390. The flange 1388 includes a threaded exterior surface that engages the threaded inner surface 1368*c*. One or more seals, membranes and/or shims can be utilized to properly position the drain 1320 and to create a seal between the frame 1338, the drain body 1340 and the outlet 1344.

FIGS. 31A-F illustrate another embodiment of a drain 1420 including a grate 1436, a frame 1438, a drain body 1440, a seal 1442, first and second wedges 1443*a*, 1443*b* and an outlet 1444. The frame 1438 includes a raised lip 1460 around the perimeter and a recessed surface 1462 to receive the grate 1436. The top of the grate 1436 and the top of the raised lip 1460 form a planar upper surface of the drain 1420. The frame 1438 defines a rectangular opening 1456 to permit fluid flow therethrough.

The drain body 1440 is rectangular and includes a planar upper surface 1466 upon which the frame 1438 can rest and, optionally, be fixed by fasteners. The upper surface can include flanges 1446 to selectively retain the outlet 1444. The drain body 1440 includes first and second recessed portions 1468*a*, 1468*b* extending along an elongate portion of the drain body 1440. The illustrated first and second recessed portions 1468*a*, 1468*b* are trenches having angled sides and a trough between the angled sides. The drain body 1440 includes a third recessed portion 1468*c* positioned between the first and second recessed portions 1468*a*, 1468*b* and extends inward toward an opening 1472. The first and second recessed portions 1468*a*, 1468*b* direct fluid toward the third recessed portion 1468*c* and toward the opening 1472. The opening 1472 is generally centrally positioned along a width of the drain body 1440.

The first wedge 1443*a* is positioned opposite the second wedge 1443*b* and is a substantial mirror image of the first wedge 1443*a*. The first wedge 1443*a* includes a first bulbous portion and the second wedge 1443*b* includes a second bulbous portion.

The outlet 1444 includes a flange 1488 and an elongated conduit 1490. The flange 1488 is an irregular shape that includes opposite circular portions and opposite square sides. The outlet 1444 is inserted into the opening 1472 while the opposite square sides are aligned with the flanges 1464. Then, the outlet 1444 is rotated approximate ninety degrees to inhibit removal of the outlet 1444.

The drain 1420 is assembled by positioning the seal 1443 on the third recessed portion 1468*c* and then inserting the outlet 1444 into the circular opening 1472 of the drain body 1440. The outlet 1444 is rotated approximately ninety degrees such that the flange 1488 is retained between the flanges 1446 and the third recessed portion 1468*c*. The flange 1488 rests on the seal 1443 on the third recessed portion 1468*c* when installed. The first wedge 1443*a* is inserted between one of the flanges 1446 and the third recessed portion 1468*c*, and the second wedge 1443*b* is inserted between the other of the flanges 1446 and the third recessed portion 1468*c*. The first and second wedge 1443*a*, 1443*b* press the flange 1488 against the seal 1442 to compress the seal against the third recessed portion 1468*c* of the drain body 1440.

FIGS. 32A-F illustrate another embodiment of a drain 1520 including a grate 1536, a frame 1538, a drain body 1540, a seal 1542, a wedge 1543 and an outlet 1544. The frame 1538 includes a raised lip 1560 around the perimeter and a recessed surface 1562 to receive the grate 1536. The top of the grate 1536 and the top of the raised lip 1560 form a planar upper surface of the drain 1520. The frame 1538 defines a rectangular opening 1556 to permit fluid flow therethrough.

The drain body 1540 is rectangular and includes a planar upper surface 1566 upon which the frame 1538 can rest and, optionally, be fixed by fasteners. The upper surface can include flanges 1546 to selectively retain the outlet 1544. The drain body 1540 includes first and second recessed portions 1568*a*, 1568*b* extending along an elongate portion of the drain body 1540. The illustrated first and second recessed portions 1568*a*, 1568*b* are trenches having angled sides and a trough between the angled sides. The drain body 1540 includes a third recessed portion 1568*c* positioned between the first and second recessed portions 1568*a*, 1568*b* and extends inward toward an opening 1572. The first and second recessed portions 1568*a*, 1568*b* direct fluid toward the third recessed portion 1568*c* and toward the opening 1572. The opening 1572 is generally centrally positioned along a width of the drain body 1540.

The wedge 1543 includes a centerline 1543*a* diving a first half and a second half that is a substantial mirror image of the first half. The first half includes a first bulbous portion 1543*b* and the second half includes a second bulbous portion 1543*c*. The wedge 1543 can be bent about the centerline 1543*a*.

The outlet 1544 includes a flange 1588 and an elongated conduit 1590. The flange 1588 is an irregular shape that includes opposite circular portions and opposite square sides. The outlet 1544 is inserted into the opening 1572 while the opposite square sides are aligned with the flanges 1564. Then, the outlet 1544 is rotated approximate ninety degrees to inhibit removal of the outlet 1544.

The drain 1520 is assembled by positioning the seal 1543 on the third recessed portion 1568*c* and then inserting the outlet 1544 into the circular opening 1572 of the drain body 1540. The outlet 1544 is rotated approximately ninety degrees such that the flange 1588 is retained between the flanges 1546 and the third recessed portion 1568*c*. The flange 1588 rests on the seal 1543 on the third recessed portion 1568*c* when installed. The wedge 1543 is bent about the centerline 1543*a* and the first and second bulbous portions are placed on top of the seal 1542 and the flange 1588. The wedge 1543 is flattened by pressing near the centerline 1543*a* to thereby press the first and second bulbous portions 1543*b*, 1543*c* into the recessed area between the flanges 1546 and the third recessed portion 1568*c*. The wedge 1543 presses the flange 1588 against the seal 1542 to compress the seal against the third recessed portion 1568*c* of the drain body 1540.

Figure 33A:
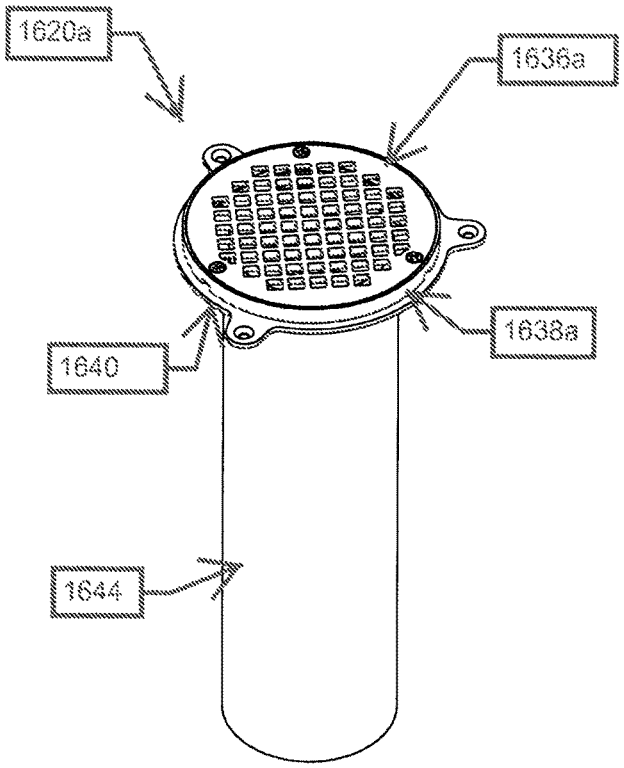
FIGS. 33A-D are perspective views of various drain embodiments.

FIGS. 33A-33D illustrate various grate and frame configurations according to some embodiments. FIG. 33A illustrates a first embodiment of a drain 1620*a* including a grate 1636*a*, a frame 1638*a*, a drain body 1640 and an outlet 1644. The illustrated grate 1636*a* and the illustrated frame 1638*a* are circular and have a smaller diameter than the drain body 1640. The grate 1636*a* has a slightly smaller diameter than the frame 1638*a*. The frame 1638*a* includes a raised lip 1660*a* around the perimeter and is recessed to receive the grate 1636*a*. A plurality of fasteners retain the grate 1636*a* in the frame 1638*a*. The top of the grate 1636*a* and the top of the raised lip 1660*a* form a planar upper surface of the drain 1620*a*. The frame 1638*a* defines a circular opening 1656*a* to permit fluid flow therethrough.

Figure 33B:
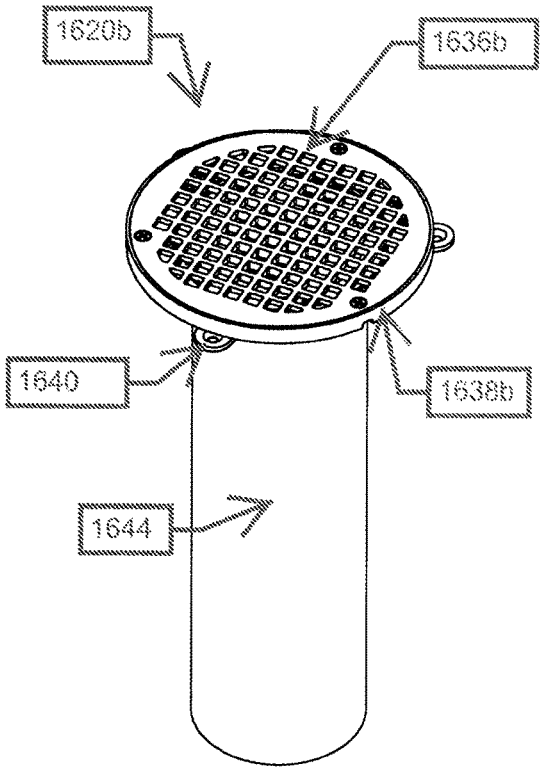

FIG. 33B illustrates a second embodiment of a drain 1620*b* including a grate 1636*b*, a frame 1638*b*, the drain body 1640 and the outlet 1644. The grate 1636*b* and the frame 1638*b* are circular and are larger in diameter than the grate 1636*a* and the frame 1638*a* of FIG. 33A.

Figure 33C:
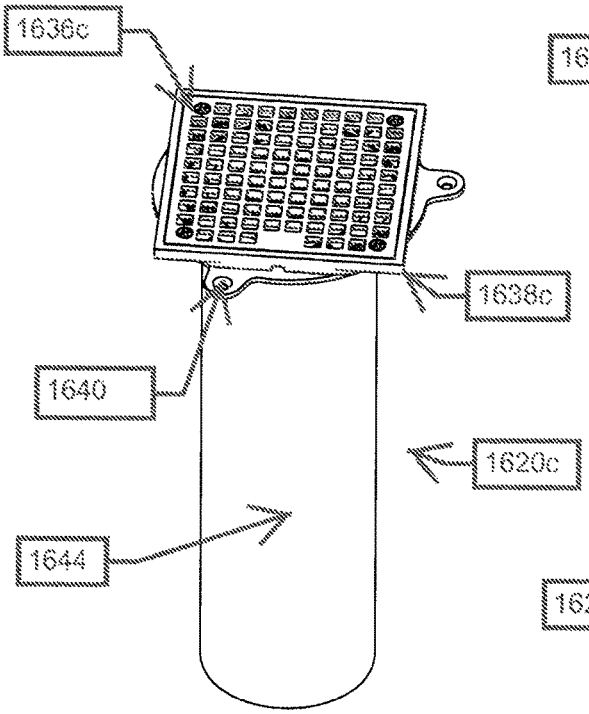

FIG. 33C illustrates a third embodiment of a drain 1620*c* including a grate 1636*c*, a frame 1638*c*, the drain body 1640 and the outlet 1644. The grate 1636*c* and the frame 1638*c* are square and have a width that is similar to the diameter of the grate 1636*a* and the frame 1638*a* of FIG. 33A.

Figure 33D:
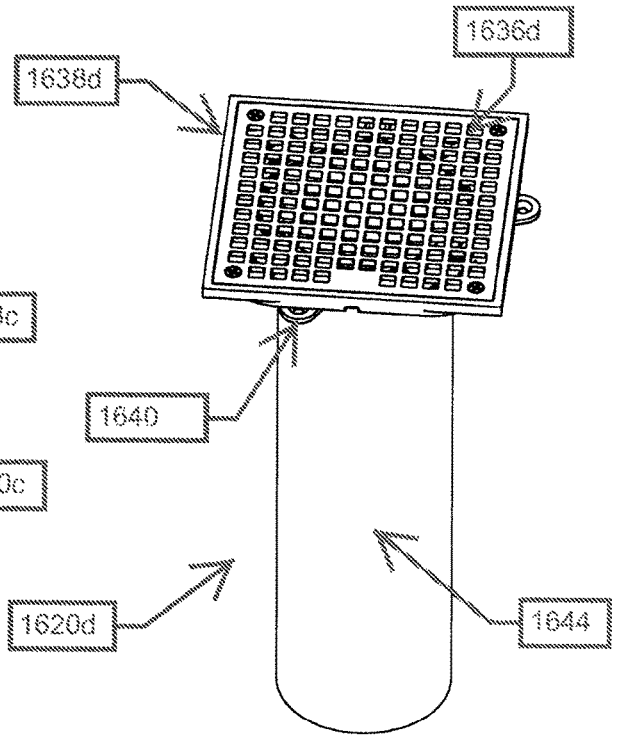

FIG. 33D illustrates a fourth embodiment of a drain 1620*d* including a grate 1636*d*, a frame 1638*d*, the drain body 1640 and the outlet 1644. The grate 1636*d* and the frame 1638*d* are square and have a width that is greater than the width of the grate 1636*c* and the frame 1638*c* of FIG. 33C.

Figure 34A:
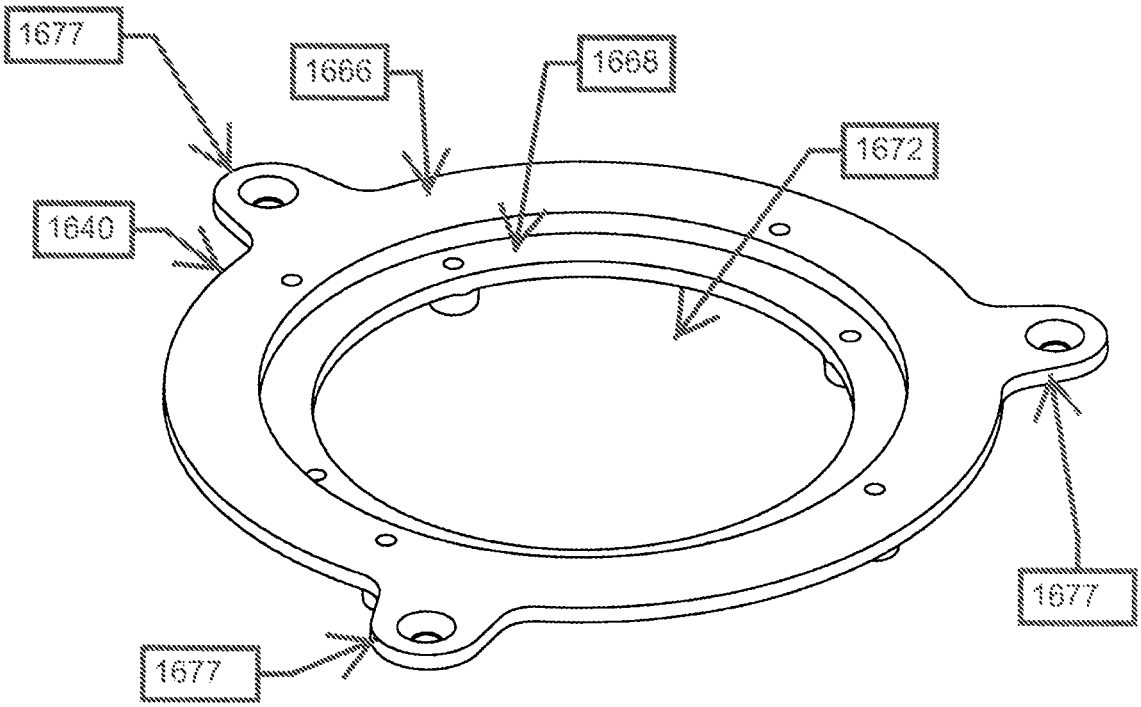
FIGS. 34A-B are top and bottom perspective views of a portion of the drain embodiments of FIGS. 33A-D.
Figure 34B:
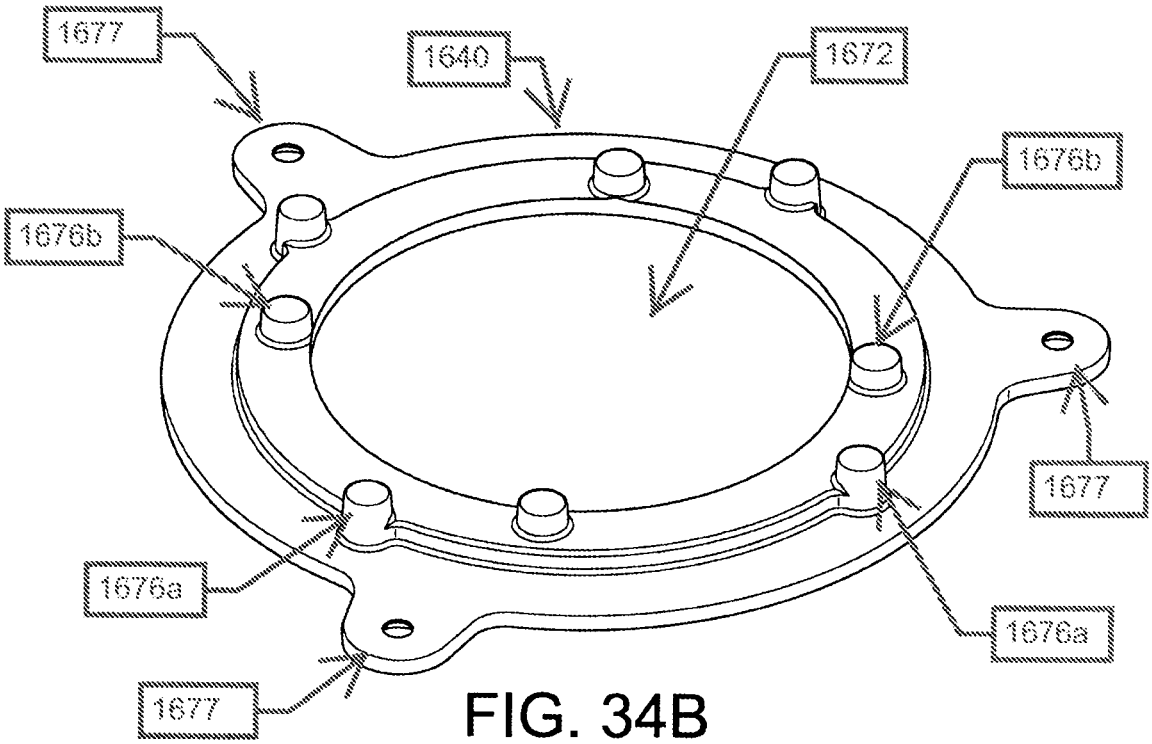

FIGS. 34A-B illustrate the drain body 1640 in greater detail. The drain body 1640 is circular and includes a planar upper surface 1666 upon which any one of the frames 1638*a*, 1638*b*, 1638*c*, 1638*d* can be fixed by fasteners. The drain body 1640 also includes a recessed portion 1568 and defines a central opening 1572. The drain body 1640 includes a first plurality of downwardly depending studs 1676*a* configured to received fasteners to connect the frame 1638*a*, 1638*b*, 1638*c*, 1638*d* to the drain body 1640. The drain body 1640 also includes a second plurality of downwardly depending studs 1676*b* configured to receive fasteners to connect the outlet 1644 to the drain body 1640. The drain body further defines three outwardly extending flanges 1677 configured to connect the drain body 1640 to a floor surface.

Figure 35A:
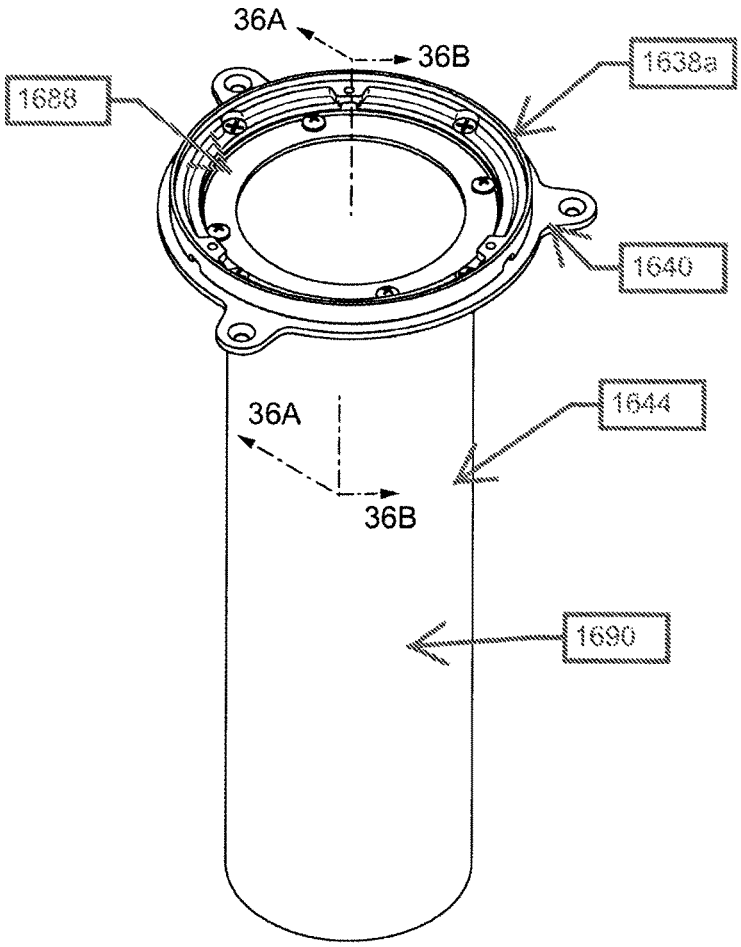
FIGS. 35A-B are top and bottom perspective views of a portion of the drain embodiments of FIGS. 33A-D.
Figure 35B:
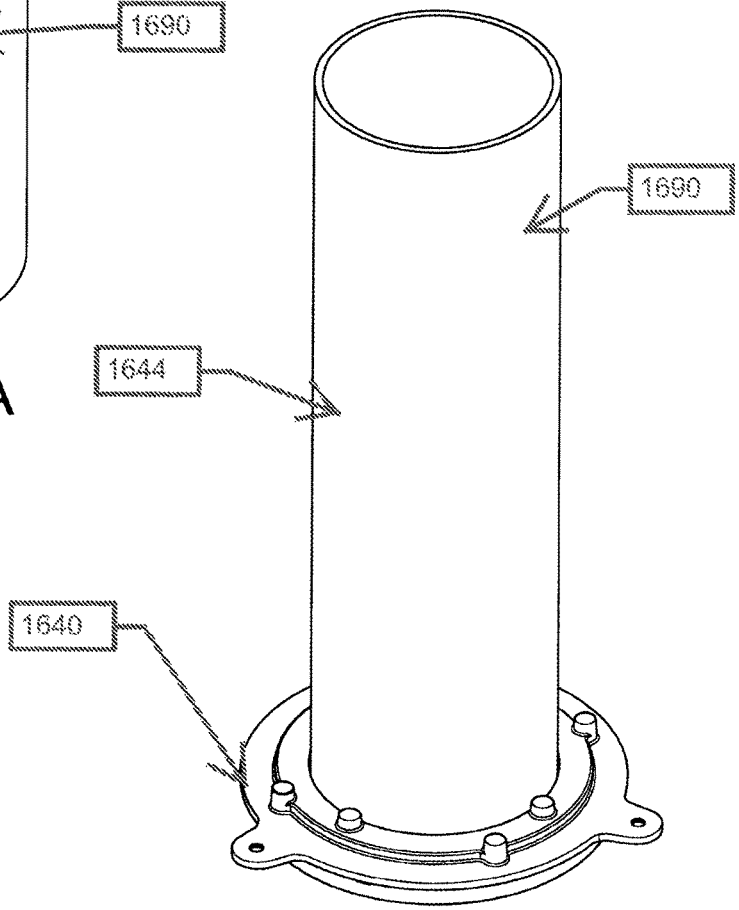

FIGS. 35A-B illustrate the frame 1638*a* connected to the drain body 1640 and the outlet 1644. The outlet 1644 includes a flange 1688 and an elongate conduit 1690. The flange 1688 rests on the recessed portion 1668 of the drain body 1640 when installed. The flange 1688 includes apertures configured to receive fasteners to connect the outlet 1644 to the drain body 1640. One or more gaskets can be positioned between the flange 1688 and the recessed portion 1668.

Figure 35C:
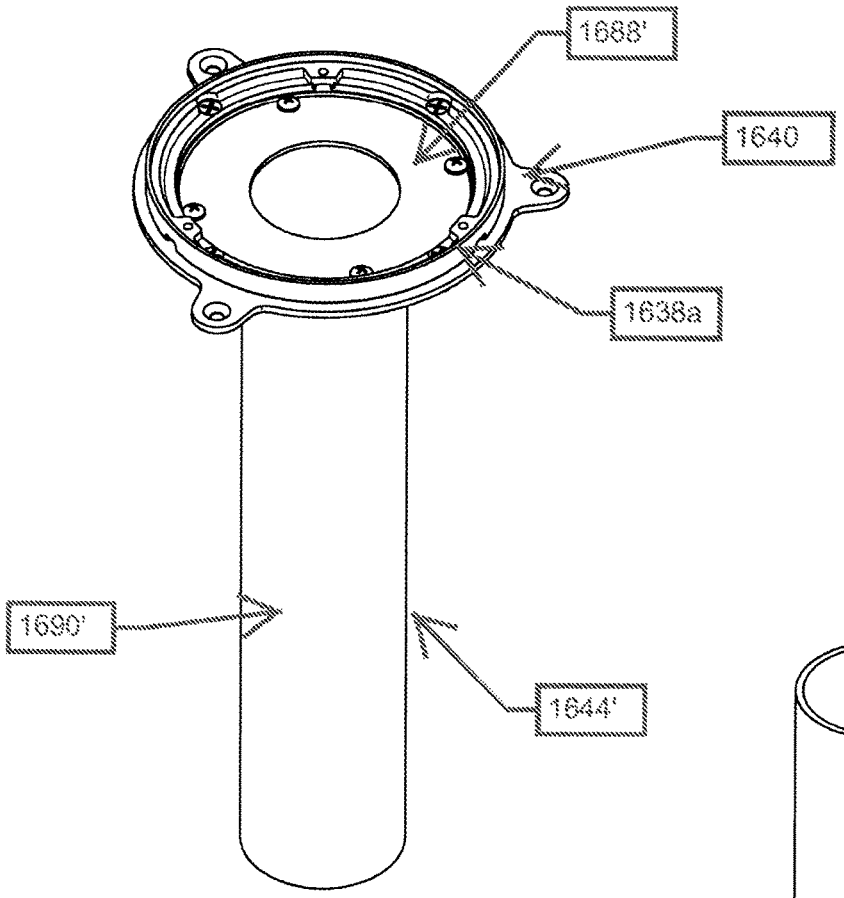
FIGS. 35C-D are top and bottom perspective view of another possible drain embodiment.
Figure 35D:
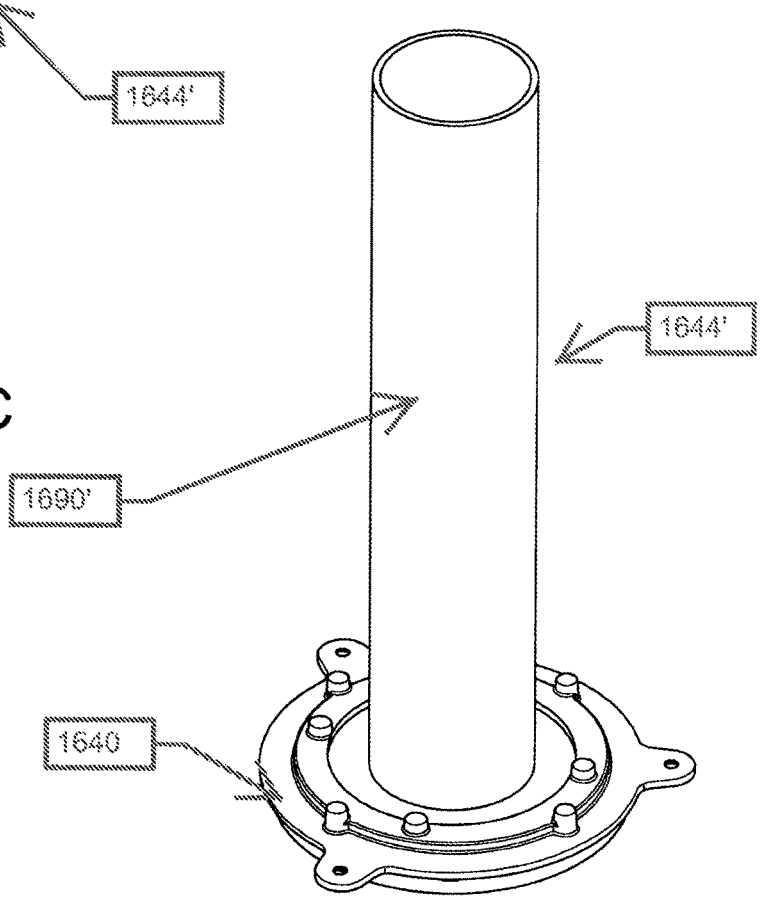

FIGS. 35C-D illustrate the frame 1638*a* connected to the drain body 1640 and an outlet 1644'. The outlet 1644' includes a flange 1688' and an elongate conduit 1690'. The flange 1688' is wider than the flange 1688 and the elongate conduit 1690' has a smaller diameter than the elongate conduit 1690. The flange 1688' rests on the recessed portion 1668 of the drain body 1640 when installed. The flange 1688' includes apertures configured to receive fasteners to connect the outlet 1644 to the drain body 1640. One or more gaskets can be positioned between the flange 1688' and the recessed portion 1668.

Figure 36A:
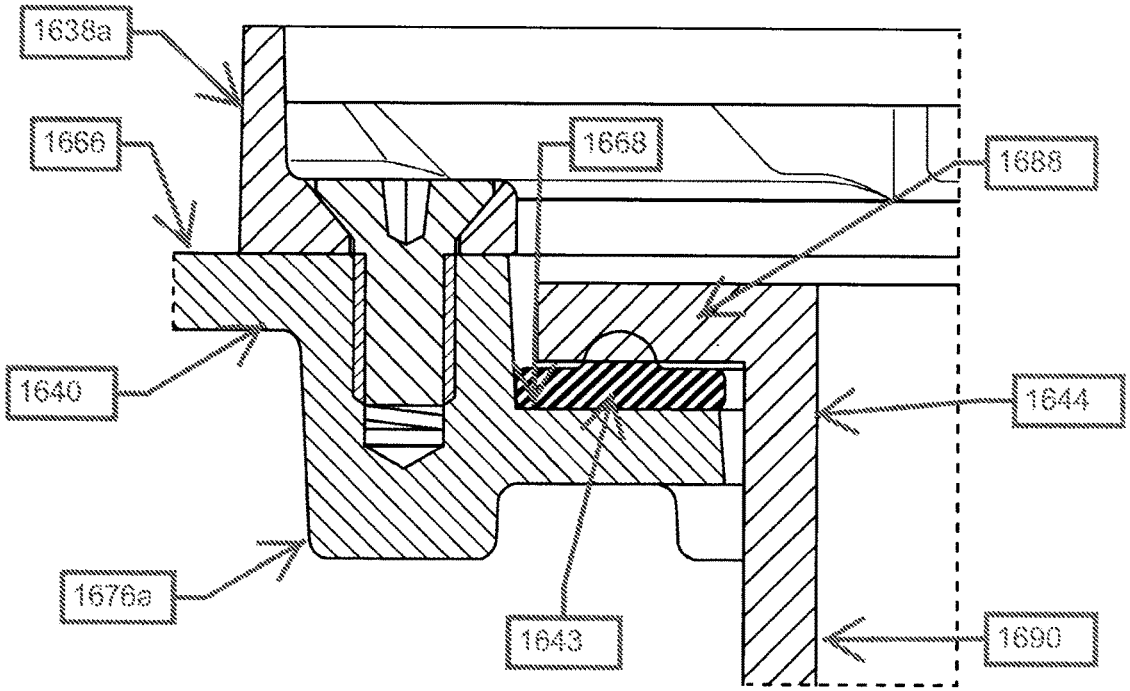
FIG. 36A is a cross-sectional view taken alone line 36A of FIG. 35A.
Figure 36B:
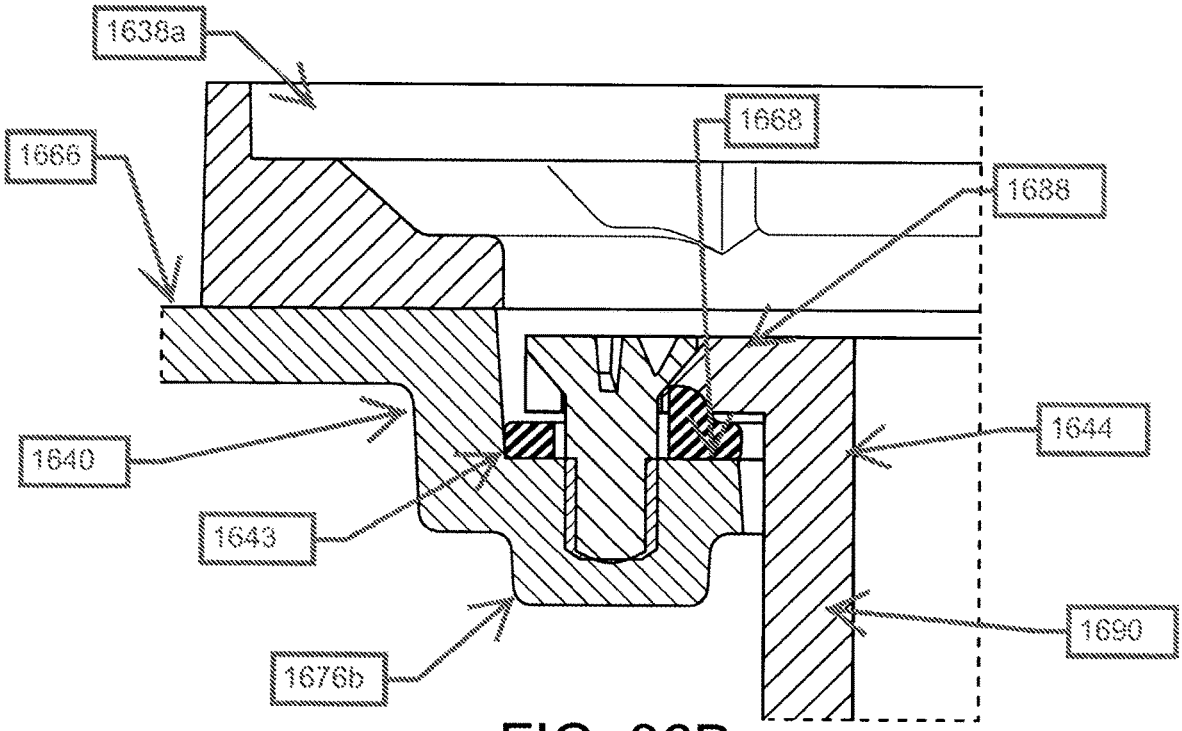
FIG. 36B is a cross sectional view taken alone line 36B of FIG. 35A.

FIGS. 36A-B illustrates the frame 1638*a* connected to the drain body 1640, a gasket 1643 and the outlet 1644. The gasket 1643 rests on the recessed portion 1668 of the drain body 1640 and the flange 1688 of the outlet 1644 rests on the gasket 1643. When the fasteners are tightened, the gasket 1643 forms a seal between the drain body 1640 and the outlet 1644.

Figure 37A:
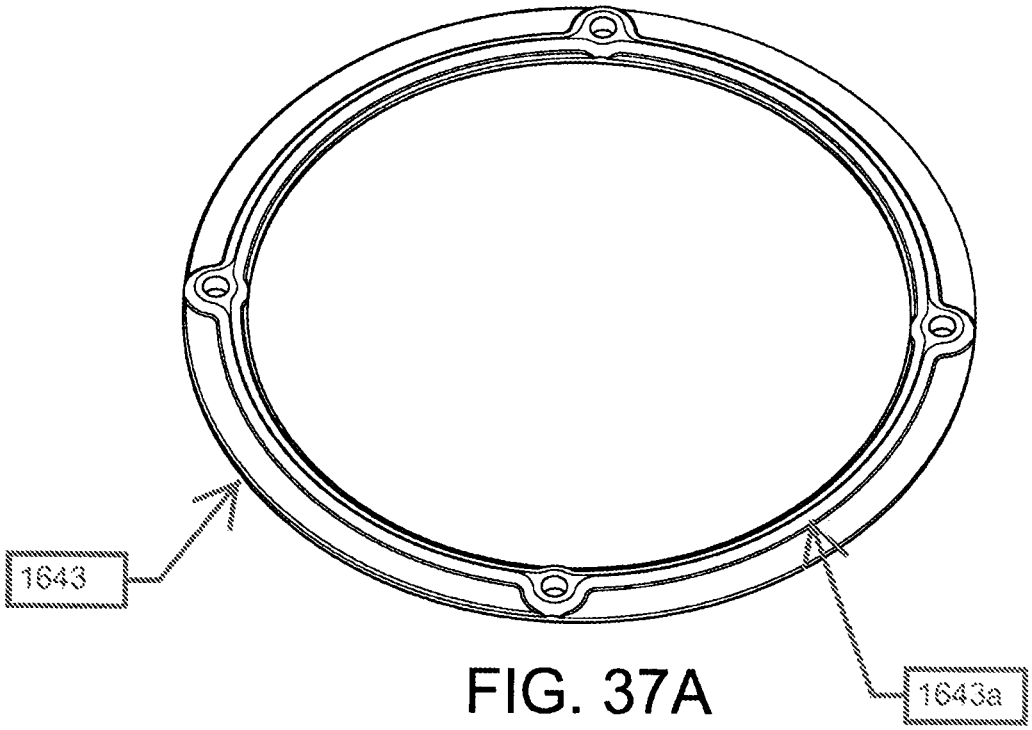
FIGS. 37A-B are top and bottom perspective views of a portion of the drain embodiment of FIGS. 35A-D.
Figure 37B:
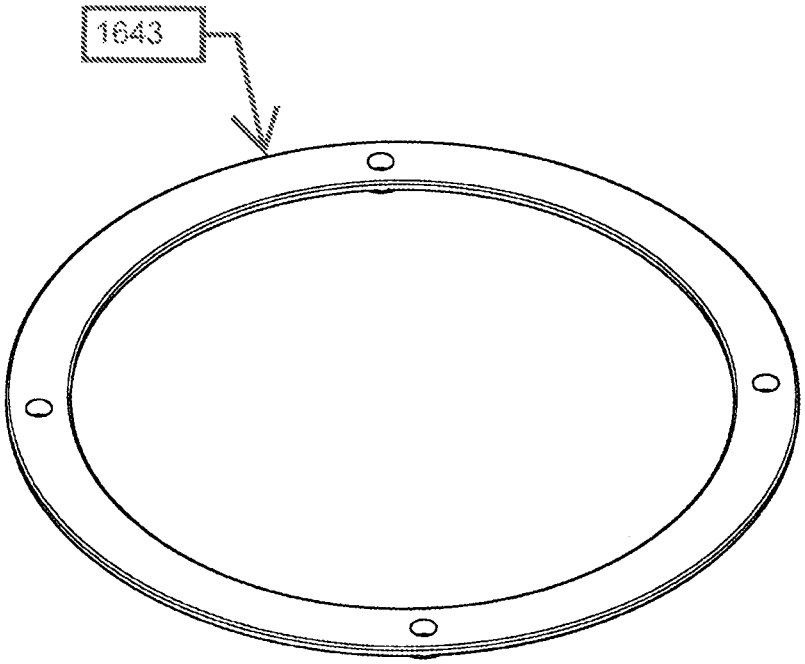

FIGS. 37A-B illustrates the gasket 1643 in greater detail. The gasket 1643 includes a bulbous protrusion 1643*a* extending around a perimeter of the gasket 1643 and apertures configured to receive fasteners.

In each of the configurations described herein, the body has a height measured from an uppermost surface to a lowermost surface measured in an axial direction. The overall height of the body in each of the embodiments is less than 2.5 inches. In some embodiments, the overall height of each of the bodies is less than two inches. In some embodiments, the overall height of each of the bodies is less than 1.5 inches. In some embodiments, the overall height of each of the bodies is less than one inch. In some embodiments, the overall height of each of the bodies is less than one half inch. Even though the drain body has a minimal height, the drain is capable of draining about 12 gallons per minute. In some embodiments, the drain is capable of draining at least 10 gallons per minute.

Although certain aspects have been described in detail with reference to certain preferred embodiments, variations and modifications exist within the scope and spirit of one or more independent aspects as described.

What is claimed is:

1. A drain assembly for installation in a shower floor, the drain assembly comprising:

a drain body including an upper surface defining a top side, and a lower surface opposite the upper surface defining a bottom side, wherein the upper surface includes a recessed portion formed therein and at least one angled surface configured to direct fluid toward the recessed portion, and wherein the drain body defines an aperture extending along an axis through the drain body between the upper surface and the lower surface; and an outlet including a flange and an elongated body, the elongated body removably insertable through the aperture along the axis such that the flange rests on the upper surface, the elongated body configured to extend below the lower surface of the drain body when the flange rests on the upper surface, the outlet configured to receive fluid flow from the drain body and direct the fluid flow away from the drain body; and one or more fasteners configured to couple the outlet to the drain body to form a water-tight seal therebetween, wherein each of the one or more fasteners are accessible from the top side.

2. The drain assembly of claim 1, wherein the aperture extends through the recessed portion.

3. The drain assembly of claim 2, wherein the flange rests on the upper surface of the recessed portion.

4. The drain assembly of claim 1, wherein the flange rests on the upper surface of the recessed portion.

5. The drain assembly of claim 1, wherein the drain body includes a plurality of threaded rods extending from the upper surface of the recessed portion, and wherein the one or more fasteners include nuts configured to threadably engage a corresponding one of the threaded rods.

6. The drain assembly of claim 1, further comprising a seal positioned between the outlet and the drain body.

7. The drain assembly of claim 1, wherein the drain body further comprises a raised lip around the perimeter thereof.

8. The drain assembly of claim 1, wherein the recessed portion is offset vertically below the at least one angled surface.

9. A shower floor assembly comprising:

a body having an upper surface defining a top side and a lower surface opposite the upper surface defining a bottom side, wherein the body includes a recessed portion formed therein and at least one angled surface configured to direct fluid toward the recessed portion;

an aperture formed in the body and extending along an axis through the body between the upper surface and the lower surface;

an outlet including a flange and an elongated body, the elongated body removably insertable through the aperture along the axis such that the flange rests on the upper surface, the elongated body configured to extend below the lower surface of the drain body when the flange rests on the upper surface, the outlet being configured to receive fluid flow from the body and direct the fluid flow away from the body; and at least one fastener configured to couple the outlet to the drain body to form a water-tight seal therebetween, wherein the at least one fastener is accessible from the top side.

10. The shower floor assembly of claim 9, further comprising at least one threaded rod extending from the upper surface of the body proximate the aperture, and wherein the at least one fastener is a nut configured to threadingly engage the threaded rod.

11. The shower floor assembly of claim 9, wherein the aperture is formed into the recessed portion of the body.

12. The shower floor assembly of claim 9, wherein the recessed portion is offset vertically below the at least one angled surface.

13. The shower floor assembly of claim 9, wherein the recessed portion is formed integrally with the at least one angled surface.

14. The shower floor assembly of claim 9, wherein the body further comprises a raised lip along at least a portion of the perimeter thereof.

15. The shower floor assembly of claim 9, further comprising a seal positioned between the outlet and the drain body.

16. A shower assembly comprising:

a floor having an upper surface defining a top side and a lower surface opposite the upper surface defining a bottom side, wherein the floor includes a recessed portion formed therein and at least one angled surface configured to direct fluid toward the recessed portion;

an aperture formed in the floor and extending along an axis through the body between the upper surface and the lower surface;

an outlet including a flange and an elongated body, the elongated body removably insertable through the aperture along the axis, the elongated body configured to extend below the lower surface of the floor, the outlet being configured to receive fluid flow from the upper surface and direct the fluid flow away from the floor; and at least one fastener configured to couple the outlet to the floor to form a water-tight seal therebetween, wherein the at least one fastener is accessible from the top side.

17. The shower assembly of claim 16, further comprising one or more tiles installed on the top side of the floor.

18. The shower assembly of claim 16, wherein the floor includes a first layer, and a second layer applied to the first layer, wherein the second layer is applied unevenly to the first layer so a greater amount is applied away from the recessed portion and less is applied proximate the recessed portion to produce the at least one sloped surface.

19. The shower floor assembly of claim 18, wherein the first layer is a rock layer, and wherein the second layer is comprised of a mud that is spread over the first layer.

20. The shower floor assembly of claim 18, further comprising a third layer on top of the second layer, and wherein the third layer includes one of a membrane of waterproof material.

21. The shower floor assembly of claim 20, further comprising a fourth layer on top of the third layer, and wherein the third layer includes a plurality of tiles.

22. The shower floor assembly of claim 16, wherein the floor includes a base layer, and wherein the base layer is formed from plywood.

23. The shower floor assembly of claim 16, wherein the aperture is formed into the recessed portion.

24. The shower floor assembly of claim 16, further comprising a seal positioned between the outlet and the floor.

25. A drain assembly for installation in a modular room, the drain assembly comprising:

a drain body including an upper surface defining a top side, and a lower surface opposite the upper surface defining a bottom side, wherein the upper surface includes a recessed portion formed therein, and wherein the drain body defines an aperture extending along an axis through the recessed portion between the upper surface and the lower surface; and an outlet including an elongated body, the elongated body removably insertable through the aperture along the axis such that the elongated body configured to extend below the lower surface of the drain body when coupled to the drain body, the outlet being configured to receive fluid flow from the drain body and direct the fluid flow away from the drain body; and at least one fastener configured to couple the outlet to the drain body to form a water-tight seal therebetween, wherein the at least one fastener is accessible from the top side.

26. The drain assembly of claim 25, further comprising a plurality of threaded rods extending from the upper surface proximate the aperture.

27. The drain assembly of claim 26, wherein the at least one fastener includes a nut configured to threadably engage a corresponding one of the threaded rods.

28. The drain assembly of claim 25, wherein the outlet includes a flange configured to engage the upper surface of the drain body.

29. The drain assembly of claim 25, further comprising at least one angled surface configured to direct fluid toward the recessed portion.

30. The drain assembly of claim 29, wherein the at least one angled surface and the recessed portion are formed from a single piece of material.

* * * * *